US007007824B2

(12) United States Patent
Danby et al.

(10) Patent No.: US 7,007,824 B2
(45) Date of Patent: Mar. 7, 2006

(54) LIQUID DISPENSER AND FLEXIBLE BAG THEREFOR

(75) Inventors: Hal C. Danby, Nr. Sudbury (GB); Michael W. Scharf, McHenry, IL (US); Julian Francis Ralph Swan, London (GB); David V. Bacehowski, Wildwood, IL (US)

(73) Assignee: Baxter International Inc., Deerfield, IL (US)

( * ) Notice: Subject to any disclaimer, the term of this patent is extended or adjusted under 35 U.S.C. 154(b) by 351 days.

(21) Appl. No.: 10/640,935

(22) Filed: Aug. 14, 2003

(65) Prior Publication Data

US 2004/0144800 A1 Jul. 29, 2004

Related U.S. Application Data

(63) Continuation-in-part of application No. 10/351,006, filed on Jan. 24, 2003, now abandoned.

(51) Int. Cl.
*B65D 35/28* (2006.01)

(52) U.S. Cl. ..... 222/103; 222/105; 222/129.1; 222/63; 222/504

(58) Field of Classification Search ..... 222/105, 222/129.1, 504, 94, 325, 63, 103
See application file for complete search history.

(56) References Cited

U.S. PATENT DOCUMENTS

| | | | |
|---|---|---|---|
| 33,943 | A | 12/1861 | Hopkins |
| 2,791,324 | A | 5/1957 | Knoop et al. |
| 2,872,081 | A | 2/1959 | Randall |
| 3,007,416 | A | 11/1961 | Childs |
| 3,144,976 | A | 8/1964 | Freshour |
| 3,257,072 | A | 6/1966 | Reynolds |
| 3,343,719 | A | 9/1967 | Kastamo et al. |
| 3,656,873 | A | 4/1972 | Schiff |
| 3,677,444 | A | 7/1972 | Merrill |
| 3,689,204 | A | 9/1972 | Prisk |
| 3,768,704 | A | 10/1973 | Beguin |
| 3,790,029 | A | 2/1974 | Ward |
| 3,808,772 | A | 5/1974 | Turtschan |
| 3,814,547 | A | 6/1974 | Kitrilakis et al. |
| 3,878,992 | A | 4/1975 | MacManus |
| 3,913,734 | A | 10/1975 | Siegel |
| 3,955,901 | A | 5/1976 | Hamilton |
| 4,025,739 | A | 5/1977 | Kull |
| 4,047,844 | A | 9/1977 | Robinson |

(Continued)

FOREIGN PATENT DOCUMENTS

DE 2131554 A 12/1972

(Continued)

OTHER PUBLICATIONS

International Search Report for PCT/US 03/39243 dated Jun. 8, 2004.

(Continued)

*Primary Examiner*—Philippe Derakshani
(74) *Attorney, Agent, or Firm*—Joseph P. Reagen; Senniger, Powers, Leavitt & Roedel

(57) ABSTRACT

A liquid dispenser uses a flexible bag having expansible and collapsible cells. A rigid manifold, and in one instance a rigid frame is provided in the bag to keep passages open in use and to isolate one of the cells from the remaining cells. The dispenser employs an efficient and quiet air pressure operating system. In one application, a concentrated drink mix may be held in a reservoir and diluted within other cells in the bag for dispensing to a cup or the like. A valve system allows for the particulates in the liquid without compromising the function of the valve.

111 Claims, 34 Drawing Sheets

U.S. PATENT DOCUMENTS

| | | | |
|---|---|---|---|
| 4,086,653 | A | 4/1978 | Gernes |
| 4,158,530 | A | 6/1979 | Bernstein |
| 4,166,412 | A | 9/1979 | Versteege |
| 4,174,872 | A | 11/1979 | Fessler |
| 4,181,245 | A | 1/1980 | Garrett et al. |
| 4,228,926 | A | 10/1980 | Gordon |
| 4,237,881 | A | 12/1980 | Beigler et al. |
| 4,265,601 | A | 5/1981 | Mandroian |
| 4,273,121 | A | 6/1981 | Jassawalla |
| 4,301,926 | A | 11/1981 | Chung |
| 4,303,376 | A | 12/1981 | Siekmann |
| 4,334,640 | A | 6/1982 | van Overbruggen et al. |
| 4,348,280 | A | 9/1982 | George et al. |
| 4,368,765 | A | 1/1983 | Larkin et al. |
| 4,375,346 | A | 3/1983 | Kraus et al. |
| 4,389,436 | A | 6/1983 | Weiner |
| 4,401,239 | A | 8/1983 | Thomassen |
| 4,421,506 | A | 12/1983 | Danby et al. |
| 4,430,048 | A | 2/1984 | Fritsch |
| 4,477,054 | A | 10/1984 | Danby et al. |
| 4,479,760 | A | 10/1984 | Bilstad et al. |
| 4,479,761 | A | 10/1984 | Bilstad et al. |
| 4,479,762 | A | 10/1984 | Bilstad et al. |
| 4,482,299 | A | 11/1984 | Eulass |
| 4,513,885 | A | 4/1985 | Hogan |
| 4,515,589 | A | 5/1985 | Austin et al. |
| 4,537,387 | A | 8/1985 | Danby et al. |
| 4,548,023 | A | 10/1985 | Danby et al. |
| 4,552,512 | A | 11/1985 | Gallup et al. |
| 4,552,552 | A | 11/1985 | Polaschegg et al. |
| D283,225 | S | 4/1986 | Canvasser |
| 4,618,399 | A | 10/1986 | Li |
| 4,624,663 | A | 11/1986 | Danby et al. |
| 4,634,430 | A | 1/1987 | Polaschegg et al. |
| 4,639,251 | A | 1/1987 | Kirkland |
| 4,642,098 | A | 2/1987 | Lundquist |
| 4,648,810 | A | 3/1987 | Schippers et al. |
| 4,686,125 | A | 8/1987 | Johnston et al. |
| 4,708,266 | A | 11/1987 | Rudick |
| 4,717,047 | A | 1/1988 | van Overbruggen et al. |
| 4,717,117 | A | 1/1988 | Cook |
| 4,718,778 | A | 1/1988 | Ichikawa |
| 4,741,461 | A | 5/1988 | Williamson et al. |
| 4,753,370 | A | 6/1988 | Rudick |
| 4,765,512 | A | 8/1988 | Bull, Jr. |
| 4,768,547 | A | 9/1988 | Danby et al. |
| 4,778,451 | A | 10/1988 | Kamen |
| 4,804,118 | A | 2/1989 | Mullen et al. |
| 4,804,360 | A | 2/1989 | Kamen |
| 4,808,161 | A | 2/1989 | Kamen |
| 4,808,346 | A | 2/1989 | Strenger |
| 4,816,019 | A | 3/1989 | Kamen |
| 4,818,186 | A | 4/1989 | Pastrone et al. |
| 4,826,482 | A | 5/1989 | Kamen |
| 4,828,545 | A | 5/1989 | Epstein et al. |
| 4,830,586 | A | 5/1989 | Herter et al. |
| 4,848,722 | A | 7/1989 | Webster |
| 4,852,851 | A | 8/1989 | Webster |
| 4,857,055 | A | 8/1989 | Wang |
| 4,858,883 | A | 8/1989 | Webster |
| 4,860,923 | A | 8/1989 | Kirschner et al. |
| 4,872,813 | A | 10/1989 | Gorton et al. |
| 4,886,432 | A | 12/1989 | Kimberlin |
| 4,898,303 | A | 2/1990 | Large et al. |
| 4,918,907 | A | 4/1990 | Roach et al. |
| 4,927,411 | A | 5/1990 | Pastrone et al. |
| 4,942,735 | A | 7/1990 | Mushika et al. |
| 4,976,162 | A | 12/1990 | Kamen |
| 4,983,102 | A | 1/1991 | Swain |
| 4,997,661 | A | 3/1991 | Kromer et al. |
| 5,000,351 | A | 3/1991 | Rudick |
| 5,002,471 | A | 3/1991 | Perlov |
| 5,006,050 | A | 4/1991 | Cooke et al. |
| 5,033,651 | A | 7/1991 | Whigham et al. |
| 5,080,652 | A | 1/1992 | Sancoff et al. |
| 5,082,143 | A | 1/1992 | Schramm, Jr. |
| 5,088,515 | A | 2/1992 | Kamen |
| 5,090,963 | A | 2/1992 | Gross et al. |
| 5,096,092 | A | 3/1992 | Devine |
| 5,097,989 | A | 3/1992 | Nakayama et al. |
| 5,105,983 | A | 4/1992 | Sancoff et al. |
| 5,135,485 | A | 8/1992 | Cohen et al. |
| 5,151,019 | A | 9/1992 | Danby et al. |
| 5,178,182 | A | 1/1993 | Kamen |
| 5,193,990 | A | 3/1993 | Kamen et al. |
| 5,199,852 | A | 4/1993 | Danby |
| 5,230,566 | A | 7/1993 | Jackson et al. |
| D338,891 | S | 8/1993 | Folk |
| 5,242,083 | A | 9/1993 | Christine et al. |
| 5,249,706 | A | 10/1993 | Szabo |
| 5,265,518 | A | 11/1993 | Reese et al. |
| 5,284,481 | A | 2/1994 | Soika et al. |
| 5,302,088 | A | 4/1994 | Gronski et al. |
| 5,306,257 | A | 4/1994 | Zdeb |
| 5,332,372 | A | 7/1994 | Reynolds |
| 5,341,957 | A | 8/1994 | Sizemore |
| 5,344,292 | A | 9/1994 | Rabenau et al. |
| 5,350,357 | A | 9/1994 | Kamen et al. |
| 5,353,963 | A | 10/1994 | Gorski et al. |
| 5,356,039 | A | 10/1994 | Christine et al. |
| 5,361,943 | A | 11/1994 | Du |
| 5,369,999 | A | 12/1994 | Yoshida |
| 5,385,540 | A | 1/1995 | Abbott et al. |
| 5,409,355 | A | 4/1995 | Brooke |
| 5,429,485 | A | 7/1995 | Dodge |
| 5,458,468 | A | 10/1995 | Ye et al. |
| 5,465,619 | A | 11/1995 | Sotack et al. |
| 5,476,368 | A | 12/1995 | Rabenau et al. |
| 5,487,649 | A | 1/1996 | Dorsey, III et al. |
| 5,507,415 | A | 4/1996 | Sizemore |
| 5,542,919 | A | 8/1996 | Simon et al. |
| 5,578,001 | A | 11/1996 | Shah |
| 5,584,811 | A | 12/1996 | Ross et al. |
| 5,588,816 | A | 12/1996 | Abbott et al. |
| 5,593,290 | A | 1/1997 | Greisch et al. |
| 5,609,572 | A | 3/1997 | Lang |
| 5,613,835 | A | 3/1997 | Tyner |
| 5,620,420 | A | 4/1997 | Kriesel |
| 5,628,908 | A | 5/1997 | Kamen et al. |
| 5,634,896 | A | 6/1997 | Bryant et al. |
| 5,649,910 | A | 7/1997 | Kriesel et al. |
| 5,656,032 | A | 8/1997 | Kriesel et al. |
| 5,656,033 | A | 8/1997 | Atkinson |
| 5,660,477 | A | 8/1997 | Ichikawa |
| 5,669,764 | A | 9/1997 | Behringer et al. |
| 5,673,820 | A | 10/1997 | Green et al. |
| 5,682,726 | A | 11/1997 | Green et al. |
| 5,690,253 | A | 11/1997 | LaFleur |
| 5,693,018 | A | 12/1997 | Kriesel et al. |
| 5,693,019 | A | 12/1997 | Kriesel |
| 5,697,525 | A | 12/1997 | O'Reilly et al. |
| 5,700,245 | A | 12/1997 | Sancoff et al. |
| 5,716,343 | A | 2/1998 | Kriesel et al. |
| 5,720,728 | A | 2/1998 | Ford |
| 5,722,957 | A | 3/1998 | Steinbach |
| 5,728,086 | A | 3/1998 | Niedospial, Jr. |
| 5,730,165 | A | 3/1998 | Philipp |
| 5,735,818 | A | 4/1998 | Kriesel et al. |
| 5,749,854 | A | 5/1998 | Shen |
| 5,766,150 | A | 6/1998 | Langkau |
| 5,785,688 | A | 7/1998 | Joshi et al. |
| 5,803,317 | A | 9/1998 | Wheeler |
| 5,816,779 | A | 10/1998 | Lawless et al. |
| 5,836,482 | A | 11/1998 | Ophardt et al. |

| | | | |
|---|---|---|---|
| 5,836,908 | A | 11/1998 | Beden et al. |
| 5,842,841 | A | 12/1998 | Danby et al. |
| 5,853,247 | A | 12/1998 | Shroyer |
| 5,857,951 | A | 1/1999 | Ichikawa |
| 5,921,951 | A | 7/1999 | Morris |
| 5,938,634 | A | 8/1999 | Packard |
| 5,964,583 | A | 10/1999 | Danby |
| 6,003,733 | A | 12/1999 | Wheeler |
| 6,016,935 | A | 1/2000 | Huegerich et al. |
| 6,024,252 | A | 2/2000 | Clyde |
| 6,036,056 | A | 3/2000 | Lee et al. |
| 6,039,214 | A | 3/2000 | Hewett |
| 6,062,425 | A | 5/2000 | Brown et al. |
| 6,092,695 | A | 7/2000 | Loeffler |
| 6,096,358 | A | 8/2000 | Murdick et al. |
| 6,098,524 | A | 8/2000 | Reese |
| 6,116,460 | A | 9/2000 | Kim et al. |
| 6,126,403 | A | 10/2000 | Yamada |
| 6,139,531 | A | 10/2000 | Danby |
| 6,142,340 | A | 11/2000 | Watanabe et al. |
| 6,158,484 | A | 12/2000 | Greenlee |
| 6,165,154 | A | 12/2000 | Gray et al. |
| 6,167,683 | B1 | 1/2001 | Wong |
| 6,173,862 | B1 | 1/2001 | Buca et al. |
| 6,186,361 | B1 | 2/2001 | Teetsel, III |
| 6,189,736 | B1 | 2/2001 | Phallen et al. |
| 6,213,738 | B1 | 4/2001 | Danby et al. |
| 6,250,506 | B1 | 6/2001 | Geiger et al. |
| 6,253,968 | B1 | 7/2001 | Van Dijk et al. |
| 6,257,844 | B1 | 7/2001 | Stern |
| 6,296,450 | B1 | 10/2001 | Westberg et al. |
| 6,302,653 | B1 | 10/2001 | Bryant et al. |
| 6,332,564 | B1 | 12/2001 | Ichikawa |
| 6,345,734 | B1 | 2/2002 | Schalow et al. |
| 6,382,470 | B1 | 5/2002 | Hu et al. |
| 6,398,760 | B1 | 6/2002 | Danby |
| 6,416,293 | B1 | 7/2002 | Bouchard et al. |
| 6,419,121 | B1 | 7/2002 | Gutierrez et al. |
| 6,428,518 | B1 | 8/2002 | Brengle et al. |
| 6,505,758 | B1 | 1/2003 | Black et al. |
| 6,516,997 | B1 | 2/2003 | Tanazawa |
| 6,527,518 | B1 | 3/2003 | Ostrowski |
| 6,536,188 | B1 | 3/2003 | Taggart |
| 2003/0017066 | A1 | 1/2003 | Danby et al. |

FOREIGN PATENT DOCUMENTS

| | | | |
|---|---|---|---|
| EP | 0 033 096 | A2 | 8/1981 |
| EP | 0 132 632 | A2 | 2/1985 |
| EP | 0 482 721 | B1 | 9/1995 |
| EP | 0 847 769 | A2 | 6/1998 |
| EP | 0 660 725 | B1 | 10/1998 |
| GB | 1 547 025 | | 6/1979 |
| GB | 2 098 963 | A | 5/1981 |
| GB | 2255073 | A | 10/1992 |
| JP | 2001/139040 | A | 5/2001 |
| WO | WO 81/02002 | A1 | 7/1981 |
| WO | WO 87/05223 | A1 | 9/1987 |
| WO | WO 89/01795 | A1 | 3/1989 |
| WO | WO 94/20158 | A1 | 9/1994 |
| WO | WO 95/25459 | A1 | 9/1995 |
| WO | WO 03/038770 | A2 | 5/2003 |

OTHER PUBLICATIONS

International Search Report for PCT/US 02/18631 dated Jul. 10, 2002.

International Search Report for PCT/US 02/27984 dated Dec. 13, 2002.

International Search Report for PCT/US 03/16020 dated Sep. 19, 2003.

LIQUID DISPENSER AND FLEXIBLE BAG THEREFOR

CROSS-REFERENCE TO RELATED APPLICATION

This application is a continuation-in-part of U.S. patent application Ser. No. 10/351,006, filed Jan. 24, 2003 now abandoned, entitled "LIQUID DISPENSER AND FLEXIBLE BAG THEREFOR," which is hereby incorporated herein by reference in its entirety for all purposes.

BACKGROUND OF THE INVENTION

This invention relates generally to pumps which act on flexible bags to dispense fluent material, and more particularly to a liquid dispenser employing a flexible bag suitable for higher flow rate operation.

Pumps are often used in applications where the surfaces contacting a fluent material being pumped should be kept clean. Such fluent materials include food, beverages, and medicinal products in the form of liquids, powders, slurries, dispersions, particulate solids or other pressure transportable fluidizable material. For instance, where the fluent material is a food additive for a food product, it is imperative that surfaces contacting the material are maintained in an aseptic condition. Accordingly, the parts of the pump which contact the food are made of materials (e.g., stainless steel) which are highly resistant to corrosion and can be cleaned.

It is known to isolate the material from the pump by having the pump act on a flexible bag containing the fluent material, rather than on the fluent material itself. There are many examples in the context of delivery of medicines. Co-pending and co-assigned U.S. patent application Ser. No. 09/909,422, filed Jul. 17, 2001, Ser. No. 09/978,649, filed Oct. 16, 2001, Ser. No. 10/156,732, filed May 28, 2002 and 10/351,006, filed Jan. 24, 2003 disclose pumps of this general type and illustrate applications in the handling of food and products other than medicine. The disclosure of these applications is incorporated herein by reference. Use of pumps of this general type are also desirable, even when it is not necessary to maintain aseptic conditions.

The application of pumps of the aforementioned type outside the field of medicine often requires higher flow rates. The flow rates may produce fluid flow effects which act on the flexible bag in ways which are detrimental to its operation. For instance, the bag material may tend to collapse under pressure drops caused by rapid fluid flow rates. It is desirable to be able to perform several manipulations of the fluent material in the flexible bag, such as mixing of two component materials. Handling of the fluent material in this manner requires valving which operates without direct contact with the fluent material. If the fluent material is liquid containing particulate matter, the particulate matter can block a valve from reaching a fulling closed position, causing leakage past the valve. One such example of fluent material containing particulate matter is orange juice which contains pulp. Different juices have differently sized pulp, which presents different problems for sealing. It is desirable to provide flow paths which can be selectively sealed to block flow, but which are not tortuous or otherwise affect the flow in the open, free-flowing condition. Still further, pumps of this general type use vacuum and pressure pumps for applying a vacuum and a positive pressure to the flexible bag to induce flow of fluent material. In many contexts, it is less desirable to employ vacuum pumps and pressure pumps because they require space and can generate undesirable noise.

In one application, the flexible bag may contain a concentrate which is diluted by water (or another diluent) added to the concentrate. If another fluid is to be supplied to the flexible bag in use, a connection is necessary. Fittings to make such connections require additional structure and additional time to make the connection. Moreover, it is imperative that the connections not leak either upon connection or disconnection. Different concentrates often require different dilution ratios. Conventionally, changes in dilution ratios are achieved by dedicating a pump to a particular type of concentrate or by physically altering the pump.

SUMMARY OF THE INVENTION

In one aspect of the present invention, a flow control apparatus for controlling the flow of a fluent material generally comprises a flexible container comprising a first flexible sheet and a second flexible sheet at least partially in opposed relation with the first sheet such that the first and second sheets define at least one cell capable of holding the fluent material. The flexible container further comprises a manifold located between the first and second sheets for passaging fluent material within the container includes port structure extending into said cell and defining a port providing fluid communication between the cell and the manifold, the port structure being substantially rigid. A shell of the apparatus is sized and shaped for receiving at least a portion of the flexible container therein. A fluid pressure system capable of selectively applying positive pressure and vacuum pressure to the flexible container is capable of deforming at least one of the first and second flexible sheets to move fluent material within the container. The port structure of the manifold holds the port open as the fluid pressure system deforms the flexible material.

In another aspect of the present invention, a flexible container substantially as set forth in the preceding paragraph.

In still another aspect of the present invention, a flow control apparatus controls the flow of a fluent material containing particulate matter having a known maximum length from a flexible container by acting on the container. The flow control apparatus comprises a shell sized and shaped for receiving at least a portion of the flexible container therein. A valve is disposed for movement relative to the shell between an open position in which fluent material may flow within the flexible container in a direction past the location of the valve and a closed position in which fluent material is blocked from flowing within the flexible container past the location of the valve. The valve includes a compliant tip adapted to resiliently deform for at least partially enveloping and sealing around particulate matter in the fluent material to inhibit leaking of fluent material past the valve. The compliant tip of the valve engages the container in the closed position to stop the flow of fluent material and has a sealing surface arranged for engaging the flexible container. The sealing surface has a dimension in the direction of flow which is greater than the maximum length of the particulate matter.

In yet another aspect of the present invention, a flow control apparatus for controlling the flow of a fluent material from a flexible container by acting on the container comprises a shell sized and shaped for receiving at least a portion of the flexible container therein. A valve is disposed for movement relative to the shell between an open position in which fluent material may flow within the flexible container in a direction past the location of the valve and a closed position in which fluent material is blocked from flowing within the flexible container past the location of the valve. The valve includes a valve tip for engaging the flexible container to stop flow of fluent material past the valve tip. The valve tip is elongate and arranged such that the lengthwise extension of the valve tip is generally perpendicular to the flow direction of the fluent material.

In a further aspect of the present invention, a flow control apparatus for controlling the flow of a fluent material from a flexible container by acting on the container, comprises a shell sized and shaped for receiving at least a portion of the flexible container therein such that passages for flow of fluent material are defined in the flexible container. A valve is disposed for movement relative to the shell between an open position in which fluent material may flow within the flexible container in a direction past the location of the valve and a closed position in which fluent material is blocked from flowing within the flexible container past the location of the valve. The valve includes a valve tip for engaging the flexible container to stop flow of fluent material past the valve. A valve seat is located generally opposite the valve for the valve tip to act against in the closed position of the valve. The valve seat, valve and shell are arranged such that the direction of flow remains the same through the valve seat.

In still a further aspect of the present invention, a flexible container for delivery of metered quantities of fluent material therefrom comprises first and second flexible sheets. The second flexible sheet is at least partially in opposed relationship with the first sheet such that the first and second sheets define at least one cell having a volume for holding a quantity of the fluent material. A manifold located between the first and second sheets and defining at least one passage transporting fluent material within the container includes a port providing fluid communication between the cell and the manifold. At least one valve seat located in the passage is arranged for receiving a deformed portion of one of the first and second flexible sheets to close the passage and block flow therethrough.

In another aspect of the present invention, a flow control apparatus for controlling flow of a fluent material from a container comprises a frame for locating the container and a dry connect device for communication of a fluent material into the container. The dry connect device is adapted to pierce the container upon engagement therewith for establishing fluid communication with the interior of the container. The dry connect device is automatically shut off when disengaged from the container to prevent flow of fluid out of the dry connect device, and is automatically opened upon piercing engagement with the container to permit flow of fluid out of the dry connect device into the flexible container.

In a further aspect of the present invention, a flexible container for delivery of metered quantities of fluent material therefrom comprises first and second flexible sheets. The second flexible sheet is at least partially in opposed relationship with the first sheet such that the first and second sheets define at least one cell having a volume for holding a quantity of the fluent material. A manifold located between the first and second sheets for passaging fluent material within the container includes a port providing fluid communication between the cell and the manifold. A volume control is disposed in the cell and occupying a portion of the volume to control the volume of fluent material received into the cell.

In still another aspect of the present invention, a method of changing the concentration of a concentrate present in a mixture of fluent material dispensed by a dispenser from a flexible container prefilled with the concentrate comprises installing a first flexible container having a first cell with a first concentrate volume into a flow control apparatus of the dispenser such that the first cell is received in a pressure chamber of the flow control apparatus. A selectively variable fluid pressure is applied to the first cell in the pressure chamber such that the first cell expands to draw concentrate into the first cell and collapses to discharge concentrate from the first cell. The concentrate discharged from the first cell is diluted with a quantity of diluent to a first concentration and then dispensed in the first concentration. The first flexible container is removed from the flow control apparatus, and a second flexible container having a second cell with a second concentrate volume is installed in the flow control apparatus such that the second cell is received in the pressure chamber. A selectively variable fluid pressure is applied to the second cell in the pressure chamber such that the second cell expands to draw concentrate into the second cell and collapses to discharge concentrate from the second cell. The concentrate discharged from the second cell is diluted with the quantity of diluent to a second concentration different from the first concentration, and dispensed in the second concentration.

In a further aspect of the present invention, a method of manufacturing flexible containers prefilled with a fluent concentrate for use in a flow control apparatus capable of acting on the flexible container to dispense fluent material including the concentrate comprises the step of forming a first flexible container by operatively joining first and second sheets of flexible material together in sealing relation such that at least a first cell is defined between the first and second sheets having a first volume capable of receiving concentrate in a first quantity for dilution to a first concentration. At least a portion of the first flexible container is filled with concentrate. A second flexible container is formed by operatively joining third and fourth sheets of flexible material together in sealing relation such that at least a second cell is defined between the third and fourth sheets having the first volume. The step of forming including locating a volume control in the second cell for reducing the volume capable of receiving concentrate so that the second cell receives concentrate in a second quantity for dilution to a second concentration more dilute than the first concentration. At least a portion of the second flexible container is filled with concentrate.

In yet another aspect of the present invention, a flexible container for delivery of metered quantities of fluent material therefrom comprises first and second flexible sheets. A container frame defines a space including an open front and an open back generally aligned with the open front. The first flexible sheet is joined to the frame over the open front and the second flexible sheet is joined to the frame over the open back to enclose the space, making the space capable of containing a fluent material. The first and second flexible sheets are deformable to move the fluent material within the enclosed space.

In a further aspect of the present invention, a method of making a flexible container comprises forming a frame defining a space having an open front and an open back. A first sheet of flexible material is joined to the frame such that the first sheet covers the open front. A second sheet of flexible material is joined to the frame such that the second sheet covers the open back. The first and second sheets enclose the space for containing a fluent material therein.

In another aspect of the present invention, a flow control apparatus for controlling the flow of a fluent material comprises a shell sized and shaped for receiving at least a portion of the flexible container therein. The shell defines at least one region for fluidically isolating the flexible container for application of fluid pressures thereto. A fluid pressure system capable of selectively applying positive pressure and vacuum pressure to the flexible container in the shell in said at least one region is capable of deforming at least one of the first and second flexible sheets to move fluent material within the container. The fluid pressure system is adapted to deliver a selected fluid pressure on demand free of any positive or negative fluid pressure accumulators.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
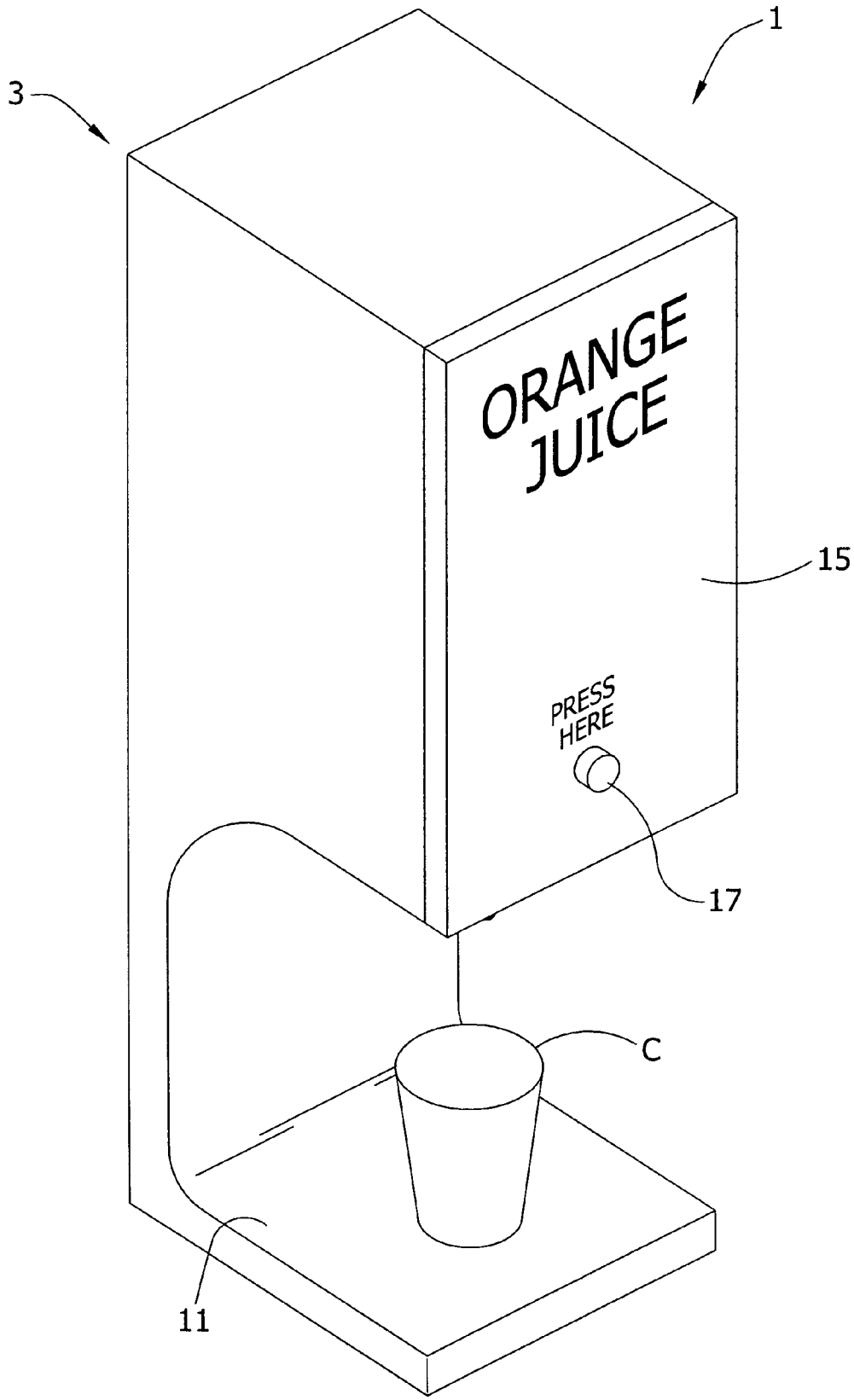
FIG. 1 is a perspective of a juice dispenser constructed according to the principles of the present invention.

Referring now to the drawings and in particular FIGS. 1–4, a drink dispenser 1 is shown to comprise a rectangular housing or cabinet 3 defining a compartment 5 containing flow control apparatus 7 constructed according to the principles of the present invention for dispensing a drink from a flexible bag 9 acted upon by the flow control apparatus. The foregoing reference numerals designate their subject generally. A stand 11 (which may be formed integrally with the cabinet 3) supports the cabinet in an elevated position above the stand providing a space for placing a cup C or other suitable container below an output nozzle 13 to receive the beverage dispensed (e.g., orange juice). Although the illustrated embodiments show the invention in the context of a consumable liquid dispenser, the invention may be used to dispense other, nonconsumable liquids as well as matter which is fluent, but not liquid. One such use involving nonconsumable liquids is contemplated to be for the mixing of paint.

The cabinet 3 includes a front door 15 which is hinged to the remainder of the cabinet. The front door may be swung open to access the flow control apparatus 7 on the interior of the cabinet 3. For simplicity and clarity of illustration, the front door 15 has been completely removed in FIGS. 2–4. A button 17 on the front door 15 is connected to a controller (described hereinafter) for controlling the dispenser 1 to dispense the beverage into the cup C when the button is pressed. The drink dispenser 1 may operate to deliver a fixed volume of the beverage each time the button 17 is pressed, or to deliver the beverage in a continuous flow so long as the button is held down. Of course, levers or other types of devices (not shown) for activating the dispenser may be employed.

Figure 3:
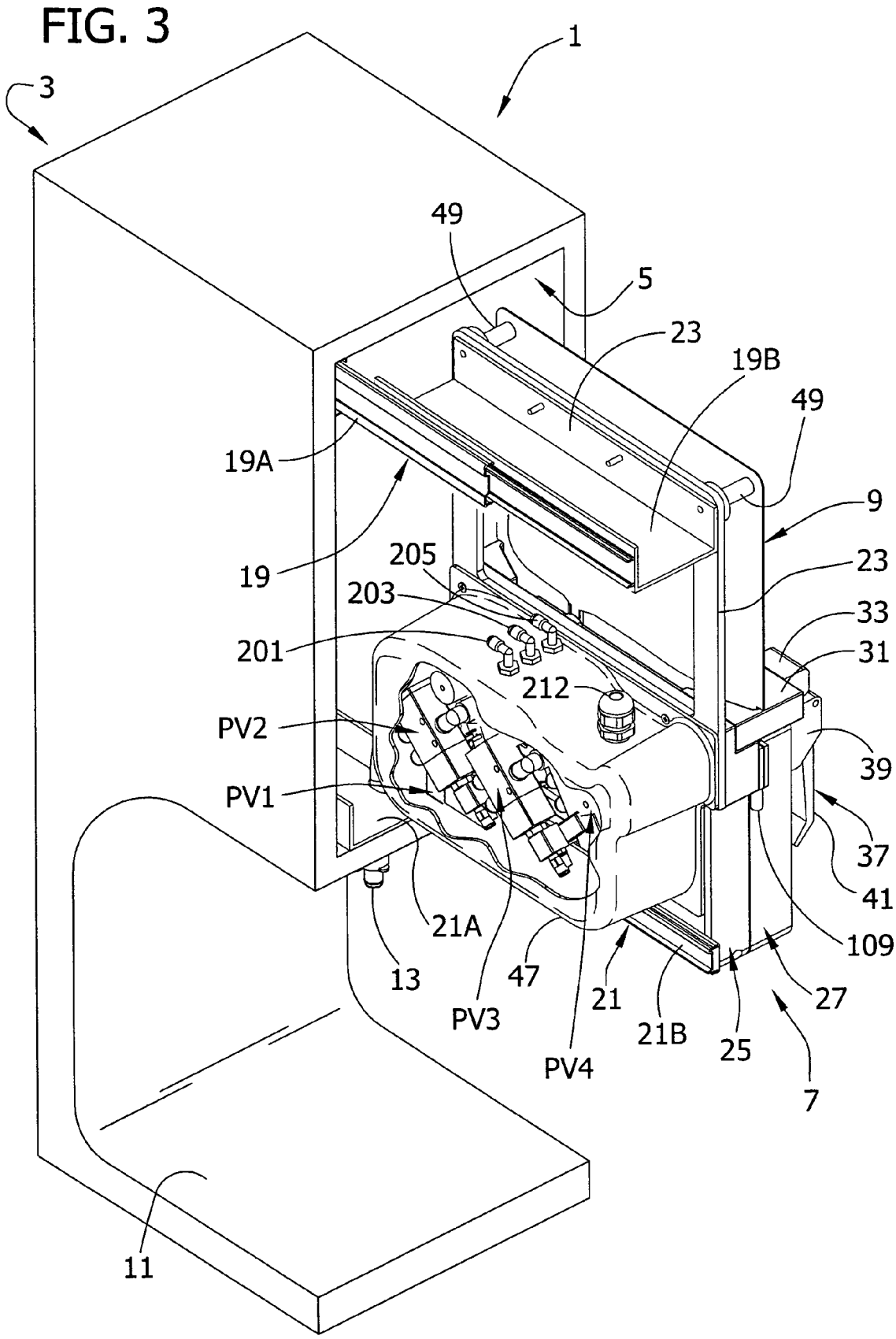
FIG. 3 is the perspective of FIG. 2, but with the flow control apparatus moved out from the dispenser housing.
Figure 4:
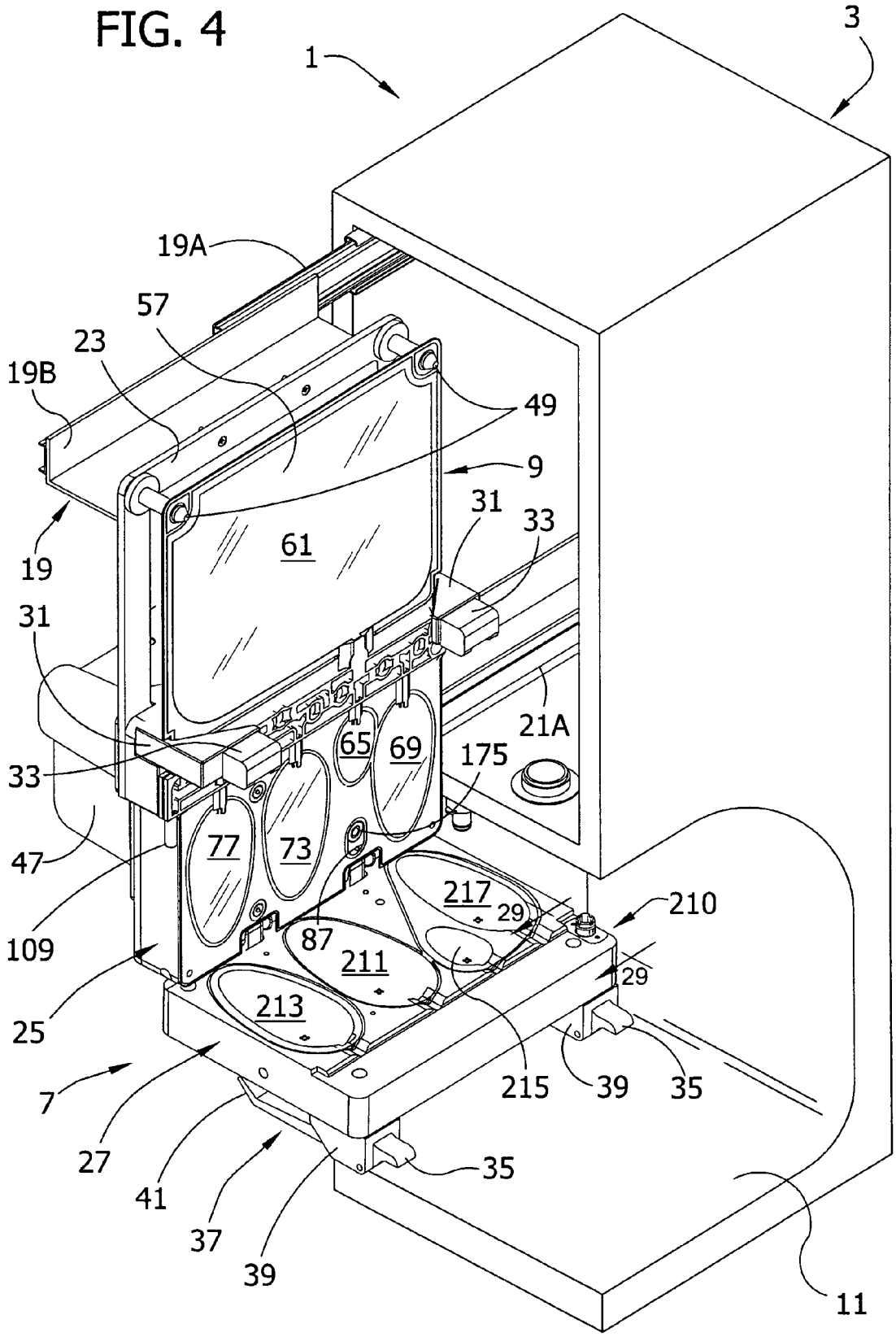
FIG. 4 is a perspective similar to FIG. 3, but showing the dispenser from a right-hand side vantage.
Figure 16:
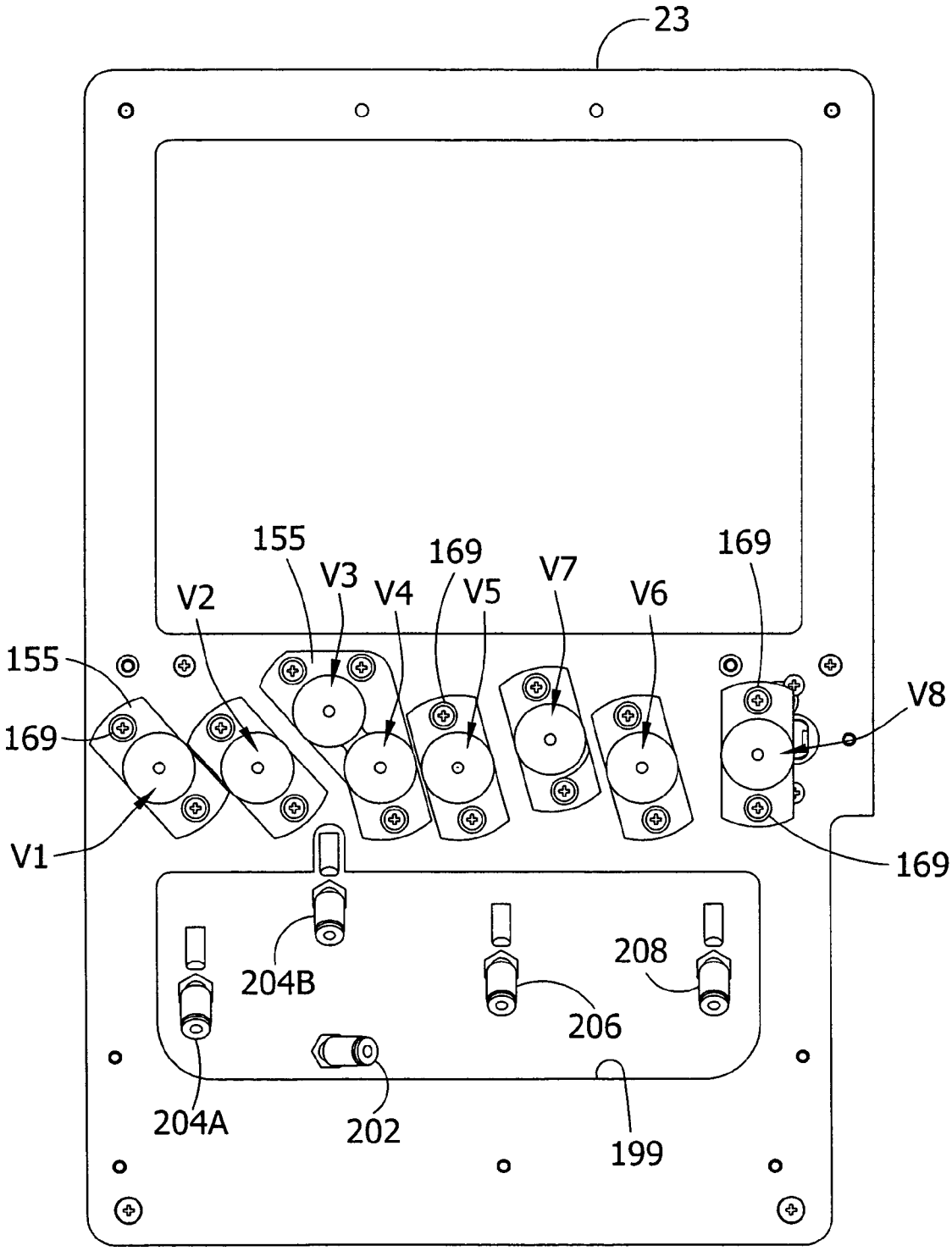
FIG. 16 is a rear elevation thereof.

The flow control apparatus 7 is mounted on an upper slide and a lower slide (indicated generally at 19 and 21, respectively), both of which are fixed to the cabinet 3 within the compartment 5. Each slide 19, 21 includes telescoping sections (19A, 19B and 21A, 21B) which allow the flow control apparatus 7 to be moved out of the compartment 5 for servicing, as shown in FIGS. 3 and 4. A rectangular frame, generally indicated at 23, is connected as by bolts to the outer slide sections 19B, 21B of both the upper and lower slides 19, 21 and forms the basis for connection of the other components of the flow control apparatus 7. A fixed shell member 25 is attached to the lower end of the frame 23 and a pivoting shell member 27 is attached by hinges (generally indicated at 29, see FIG. 19) to the fixed shell member for pivoting between a closed operating position (FIG. 3) and an open position (FIG. 4). A pair of V-blocks 31 mounted on an upper end of the fixed shell member 25 extend outwardly from the fixed shell member in the direction of the pivoting shell member 27. The V-blocks 31 locate the flexible bag 9 and mount respective latch bolt receptacles 33 for receiving latch bolts 35 of latching mechanisms, generally indicated at 37, attached to the pivoting shell member 27. The latching mechanisms 37 each include a base 39, a lever 41 pivotally mounted on the base and connected to the latch bolt 35 for extending and retracting the latch bolt to lock the pivoting shell member 27 in the closed position (FIG. 3), and unlock the pivoting shell member for swinging down to the open position (FIG. 4). The fixed shell member 25 also mounts eight solenoid valves (designated generally by references, V1–V8) which operate to control flow of fluent material within the flexible bag 9 in operation of the drink dispenser 1, and fluid pressure control valves (designated generally by references PV1–PV4) used in the application of vacuum and positive pressures to the flexible bag. The operation of the solenoid valves V1–V8 and control valves PV1–PV4 will be explained more fully hereinafter. The solenoid valves V1–V8 and control valves PV1–PV4 are enclosed by a cover 47 releasably attached to the frame 23. The cover is shown broken away in FIG. 3 so that the internal arrangement of the control valves PV1–PV4 may be seen. The solenoid valves are shown in FIG. 16. The compartment 5 is refrigerated, and the cover 47 shields the solenoid valves V1–V8 and control valves PV1–PV4 from condensing moisture within the cold compartment.

Figure 5:
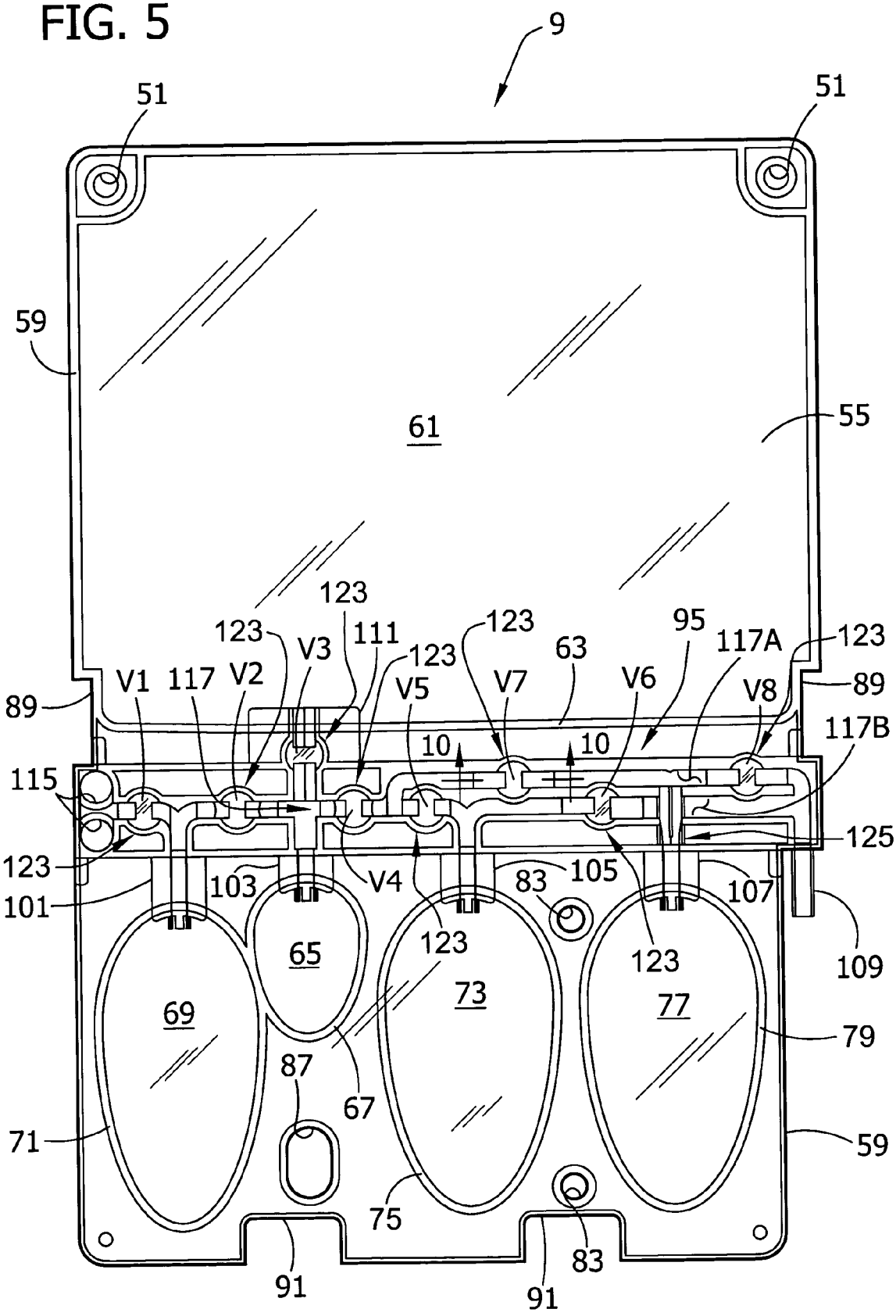
FIG. 5 is an elevation of a disposable flexible bag as seen from the left side as the bag is oriented in FIG. 3.
Figure 6:
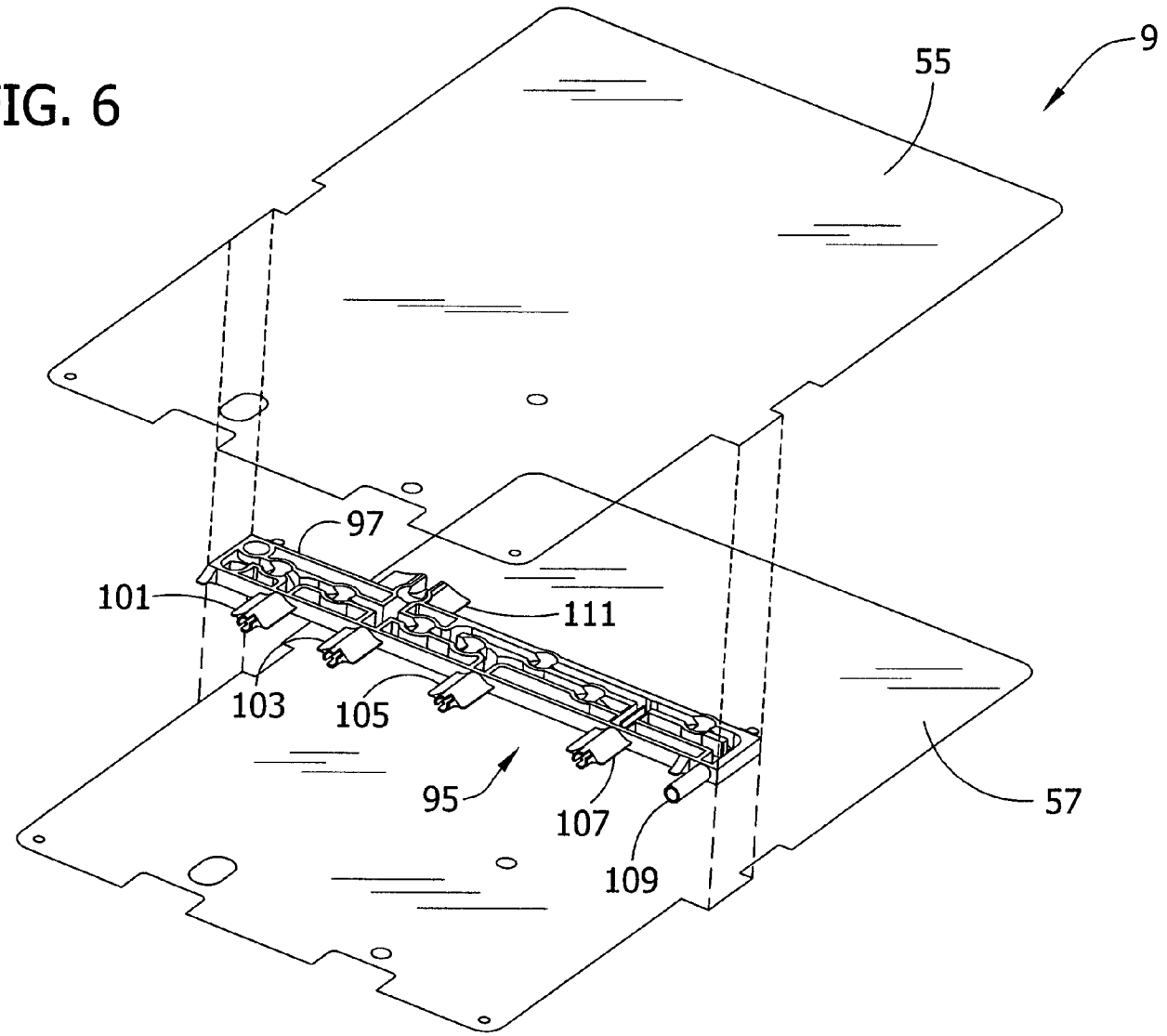
FIG. 6 is an exploded perspective of the flexible bag.

The upper corners of the frame 23 mount pins 49 which are received through openings 51 (see FIG. 5) in corresponding corners of the flexible bag 9 for hanging the bag on the frame. The pins 47 each have annular grooves 53 near their distal ends (see FIG. 19) which receive and locate the bag 9 axially of the pins. The flexible bag extends down from the pins 47 between the V-blocks 31 and into the space between the fixed shell member 25 and the pivoting shell member 27 when they are in the closed position. Referring now to FIGS. 5 and 6, the flexible bag 9 is shown to comprise a first sheet 55 and a second sheet 57. The flexible bag 9 is seen in FIG. 5 from the side facing the fixed shell member 25. The first and second sheets 55, 57 have the same generally rectangular size and shape, and are superposed with each other. The first and second sheets 55, 57 are liquid impervious, limp sheet material, and are sealingly secured together in a peripheral seam 59 along their peripheral edge margins to form an envelope. The first and second sheets 55, 57 may each be single-ply, but is more preferably a composition of multiple plies of sheet material. In addition, the first and second sheets 55, 57 are also joined together internally of the peripheral seam 59 to form several distinct cells, each capable of containing its own volume of liquid. The distinct cells include a large reservoir cell 61 at the top of the flexible bag 9 which contains in the illustrated embodiment orange juice concentrate liquid. The reservoir cell 61 is defined in part by the peripheral seam 59, but also by a transverse seam 63. There is also a concentrate dosing cell 65 defined by seam 67, a water dosing cell 69 defined by seam 71, a first mixing cell 73 defined by seam 75 and a second mixing cell 77 defined by seam 79. It may be seen that the seams 67, 71 of the concentrate dosing cell 65 and the water dosing cell 69 converge at one location, but still separate the cells.

The flexible bag 9 further includes a pair of openings 83 extending through the entire bag, which allow locators on the fixed and pivoting shell members 25, 27 to engage each other when the shell members are closed. An oval passage 87 also extends through the bag 9 and allows for communication of vacuum pressure to the pivoting shell member 27 from the fixed shell member 25. The flexible bag 9 is formed with a pair of notches 89 aligned on laterally opposite sides. These notches 89 are located to mate with the "V" of the V-block 31. A second pair of notches 91 is located on the lower edge of the bag provide clearance for hinges 29 which connect the fixed and pivoting shell members 25, 27 together.

Figure 7:
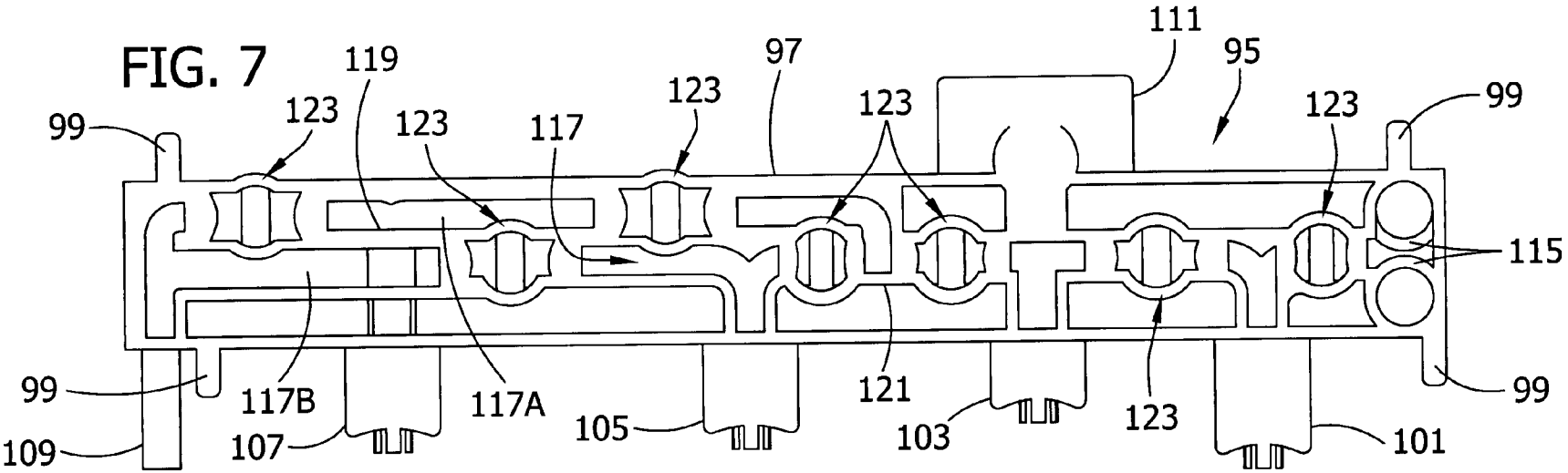
FIG. 7 is a front elevation of a manifold of the flexible bag.
Figure 8:
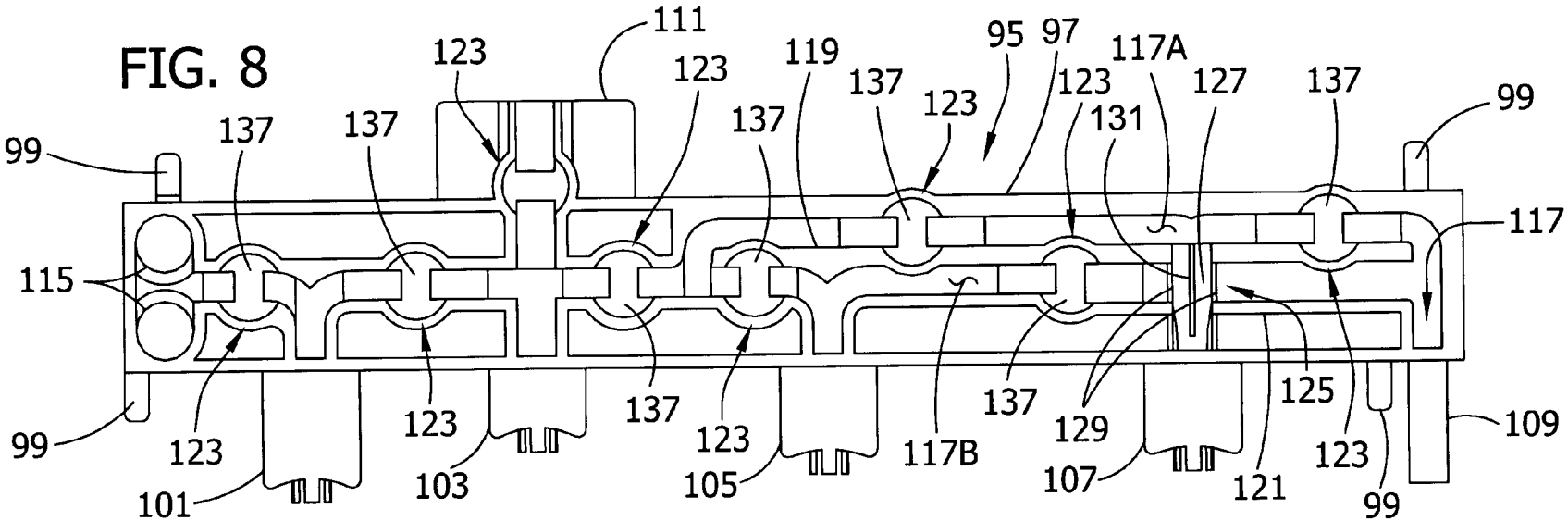
FIG. 8 is a rear elevation of the manifold.
Figures 9, 10:
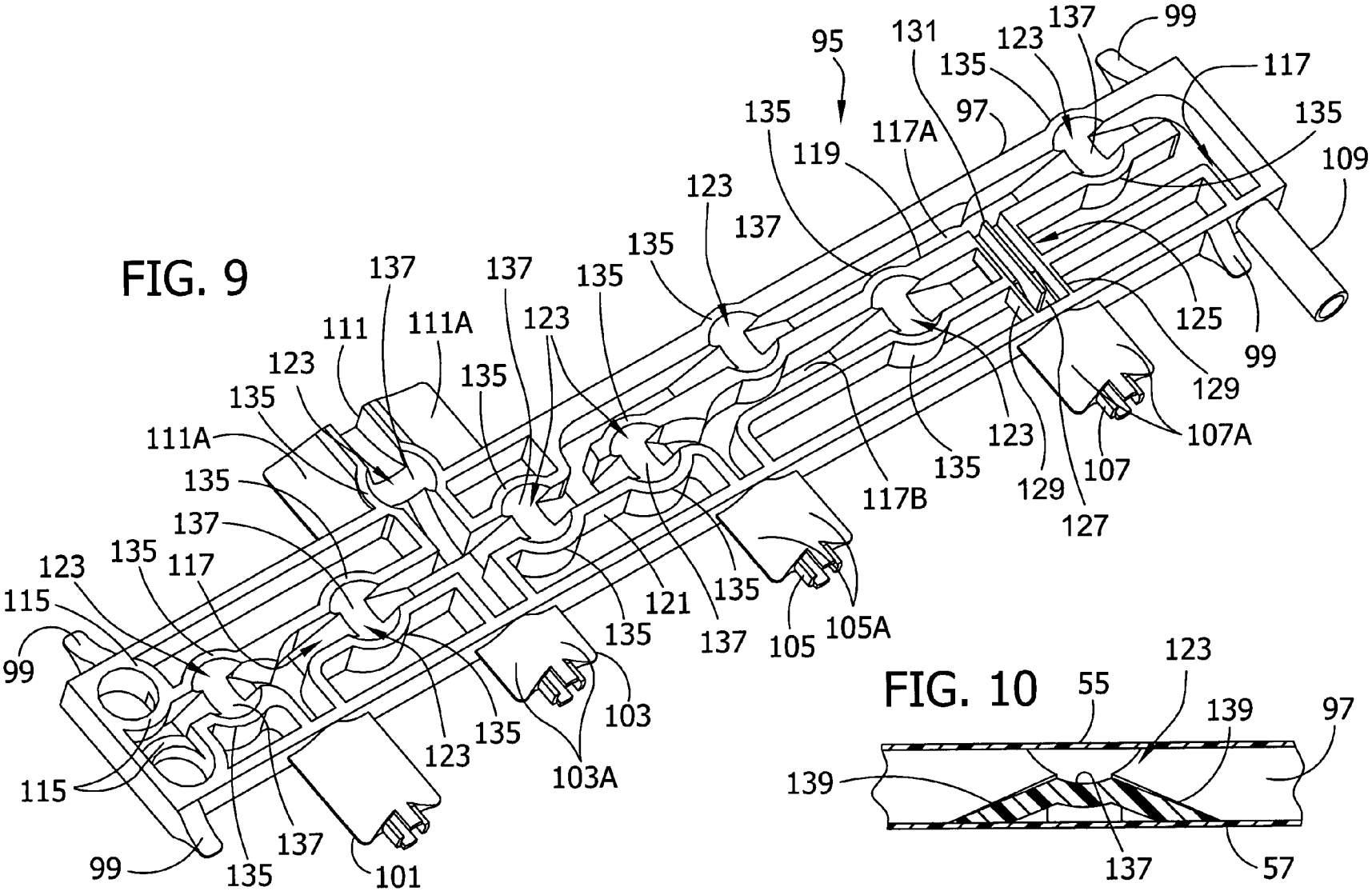
FIG. 9 is a perspective of the manifold.
FIG. 10 is a section taken in the plane including line 10—10 of FIG. 9 and showing a valve seat of the manifold.

The first and second sheets 55, 57 sandwich a rigid plastic manifold (generally indicated at 95) between them which defines, along with the first and second sheets, flow paths for liquid within the flexible bag 9. The manifold 95 may be a molded piece, but other materials and methods of construction may be used without departing from the scope of the present invention. The rigidity of the manifold 95 is sufficient to keep the paths open under the pressure differentials experienced during relatively high speed flow of liquid through the paths. Moreover, the rigid manifold 95 isolates the reservoir cell 61 from the dosing cells 65, 69 and mixing cells 73, 77 so that it is not influenced by the forces producing repeated expansion and contraction of these cells in operation. Referring to FIGS. 7–9, it may be seen that the manifold 95 is a skeletal frame, essentially defining side walls of flow paths, but not the tops and bottoms which are defined by the first and second sheets 55, 57. More particularly, the manifold 95 includes a rectangular exterior frame element 97 supporting the remaining elements of the manifold.

Triangular elements 99 having sloping sides project outwardly from the rectangular frame element 97 near its edges. These triangular elements 99 facilitate attachment of the first and second sheets 55, 57 to the manifold 95, avoiding a sharp edge where the first and second sheets encounter the manifold along their vertical side edges. Tubes formed as part of the manifold 95 provide fluid communication of the manifold with the cells 65, 69, 73, 77 formed in the flexible bag 9. The tubes include a water dosing cell tube 101, a concentrate dosing cell tube 103, a first mixing cell tube 105, a second mixing cell tube 107 and an outlet tube 109. These tubes are formed from the material of the manifold 95 and define flow paths independently of the first and second sheets 55, 57. The outer ends of the tubes 101, 103, 105, 107, 109 open into their respective cells 69, 65, 73 and 77, and the tubes extend through the rectangular frame element 97 into the interior of the manifold 95. The reservoir cell 61 is serviced by an inlet channel 111 projecting outwardly from the rectangular frame element 97 and opening into the reservoir cell. In shipment and prior to use in a drink dispenser 1, a clamp, peel-seal connection of the flexible sheets, or the like (not shown) located at the intersection of the reservoir cell 61 and the inlet channel 111 may be used to retain the concentrate in the reservoir cell. Unlike the tubes 101, etc., the inlet channel 111 is open to one side of the manifold 95 and uses the first sheet 55 to enclose a flow path for liquid from the reservoir cell 61 for reasons which will be explained hereinafter. All of the tubes except the outlet tube 109, and the inlet channel 111 have wings 101A, 103A, 105A, 107A, 11A, which taper in a radial direction outward from the tube. These wings provide larger and smoother surfaces for joining the first and second sheets 55, 57 to the tubes 101, 103, 105, 107 and inlet channel 111 to facilitate a sealing connection which will not be broken under forces ordinarily experienced by the flexible bag 9 during shipment and use.

The rigid manifold 95 provides many advantages. However, it is also possible to form the flow paths in other ways. For instance, flow paths may be formed entirely by making seals (not shown) within the flexible bag 9 to define passages. Moreover, instead of a single rigid manifold, individual rigid tubes or other support pieces (not shown) could be used at critical locations (e.g., at the openings into the cells 65, 69, 73, 77) in otherwise flexible passages to keep the passages open. The presence of the tubes 101, 103, 105, 107 is particularly useful where the cells 65, 69, 73, 77 are subjected cyclically to positive and negative air pressure. In the absence of tubes 101, 103, 105, 107, the cells 65, 69, 73, 77 would tend to occlude where the fluent material enters and exits the cell under the cyclical application of pressure. In that event, the cells 65, 69, 73, 77 would not fill and/or empty properly. As one further alternative, the passages could be formed by individual tubes (not shown) sealed between sheets 55, 57 of the flexible bag 9. Valve windows could be formed between adjacent tubes by forming small pockets in the bag 9 by sealing the sheets 55, 57 of the bag together. Two (or more) aligned tubes would open into the valve window. Valve heads could then act to collapse (by pressing on) and release the windows to prevent or allow passage of liquid.

Water inlet openings are defined by two generally circular frame elements 115 on the left hand side of the manifold 95 (as oriented in FIGS. 8 and 9). The circular frame elements 115 converge in part with the rectangular frame element 97. Each circular frame element 115 is capable of receiving a water inlet line (not shown) for delivery of water, such as from a public drinking water line, into the manifold 95. Two circular frame elements 115 are provided so that the water line can be attached on either side of the flexible bag 9. Thus, the bag does not require a particular orientation to function. A passage (generally indicated at 117) of the manifold 95 is defined largely by first and second internal wall frame elements (designated 119 and 121, respectively) extending lengthwise of the manifold within the rectangular frame element 97. The internal wall frame elements 119, 121 are opposed to each other and define sides of the passage 117. The passage is enclosed by the securement of the first and second sheets 55, 57 to the tops of the first and second internal wall frame elements 119, 121. At certain locations, the manifold 95 is formed with valve seats (generally indicated at 123) which are open on the side closed by the first sheet 55, but closed on the side adjacent the second sheet 57. The first wall frame element 119 has a break aligned with the reservoir inlet channel 111 for passage of liquid concentrate (i.e., orange juice concentrate) into the manifold 95 and another break where two branches 117A, 117B of the passage 117 intersect. The second internal wall frame element 121 includes four breaks where the second internal wall frame element extends to an intersection with the rectangular wall frame element 97. These breaks are aligned with the locations where the tubes 101, 103, 107 and 109 pass through the rectangular frame element for passage of liquid into and/or out of the manifold 95.

The two branches 117A, 117B of the passage 117 provide for separate flow to the first and second mixing cells 73, 77 from the dosing cells 65, 69, and from the mixing cells to the outlet tube 109. The branches extend from a break in the first internal wall frame element 119 to the right end of the manifold 95 (as oriented in FIGS. 8 and 9). One branch (117B) is defined by a continuation of the first and second internal wall frame elements 119, 121 down the center of the manifold 95. The other branch 117A is defined by the first wall frame element 119 and the interior of the rectangular frame element 97 such that the branch extends along the top of the manifold 95, parallel to branch 117B. The branch 117B opens to the first mixing cell 73, but not the second mixing cell 77. Branch 117A opens to the second mixing cell 77, but not the first mixing cell 73. The branch 117B communicates with the second mixing cell 77 by one of the breaks in the second internal wall frame element 121.

The branch 117A communicates with the second mixing cell 77 by way of a channel element (generally indicated at 125). The channel element 125 extends from the opening in the rectangular frame element 97 associated with the first mixing cell tube 107, through branch 117B and to a third break in the first internal wall frame element 119 where it opens into the branch 117A. The channel 125 is closed from branch 117B by the presence of a bottom wall 127 and two lateral walls 129 of the channel. The channel 125 is split in two by an internal divider 131. The divider 131 supports the sheet 55 against collapsing into the channel 125. The channel is not as deep as the thickness of the manifold 95 or the height of the opposing walls 119, 121. Therefore, liquid in branch 117B is able to continue past the channel 125 by passing behind it (as the manifold 95 is viewed in FIGS. 8 and 9). The two branches 117A, 117B join together again into a single passage 117 adjacent to the outlet tube 109 so that both the first and second mixing cells 73, 77 deliver the mixed liquid to the same location.

The valve seats 123 are used in the control of the direction of liquid flow inside the manifold 95. The overall operation of the flow control apparatus 7, including the routing of liquid within the manifold 95, will be described more completely below. The valve seats 123 are defined in part by opposed arcuate sections 135 which may be formed by the rectangular frame element 97 and first internal wall frame element 119, the first and second internal wall frame elements 119, 121, or by opposed sections of the reservoir cell inlet channel 111. Each pair of opposed arcuate sections defines a valve window. All of the valve seats 123 have substantially the same construction, and a representative one of the valve seats is shown in cross section in FIG. 10. The valve seat 123 joins together the internal wall frame element 119 and the rectangular frame 97 defining the passage branch 117A on one side adjacent to the second sheet 57. The valve seat 123 includes a sealing surface 137 in the shape of a segment of a sphere. Ramps 139 extend from the side of the manifold 95 adjacent to the second sheet 57 to the sealing surface 137, facilitating flow of liquid to and from the region of the sealing surface. It will be appreciated that the sealing surface 137 of the valve seat 123 provides a hard, rigid surface against which to form a seal to close the passage 117A at the location of the valve seat. The valve seat 123 has a cross sectional area in the region of the sealing surface 137 which is about the same as (and not less than) the cross sectional area of the passage 117A to facilitate flow through the valve seat at the location where the valve deforms the first flexible sheet 55 into engagement with the sealing surface.

Figure 11:
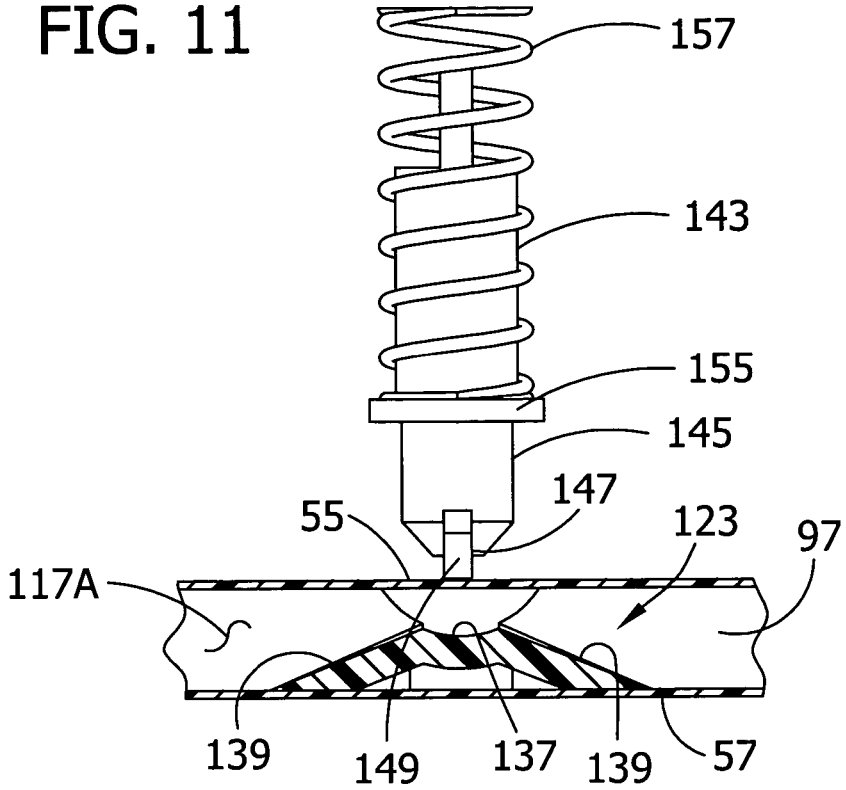
FIG. 11 is a schematic section similar to FIG. 10 illustrating a valve in an open position.
Figure 12:
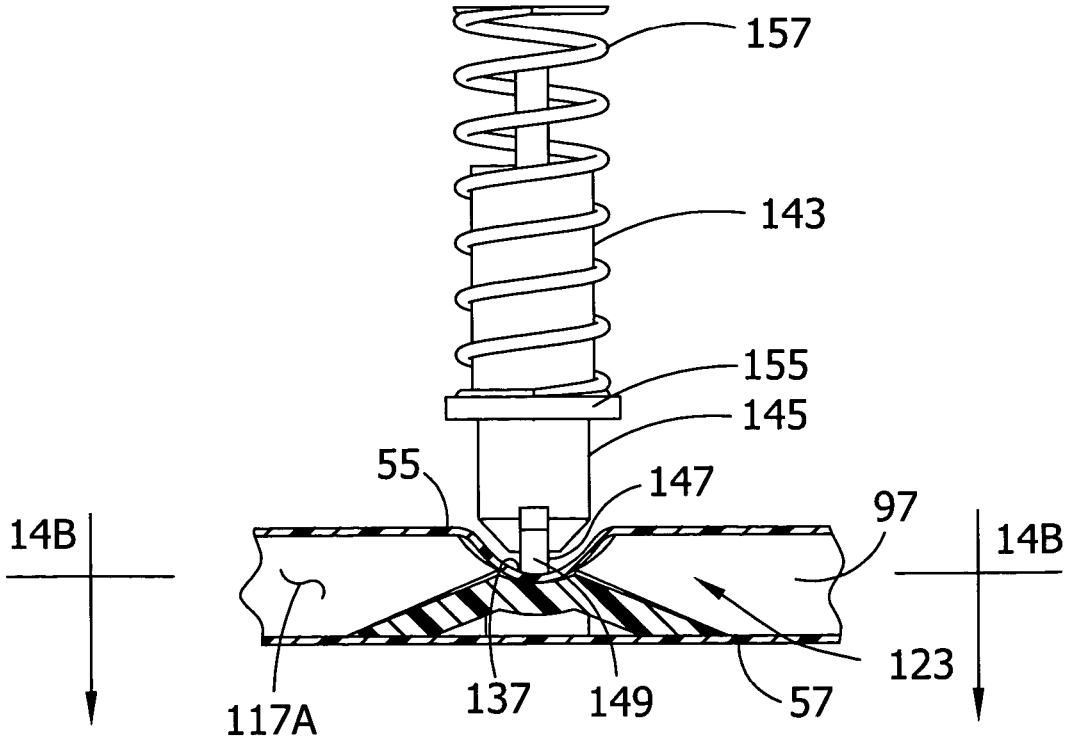
FIG. 12 is a schematic section like FIG. 11, but showing the valve in a closed position.

FIGS. 11 and 12 schematically illustrate a valve stem 143 and valve head 145 of one of the solenoid valves (V7) which is used to selectively close the passage branch 117A at the valve seats 123 illustrated in FIG. 10. There is one solenoid valve (V1–V8) for each valve seat 123, but other arrangements (not shown) could be used wherein a single solenoid valve services more than one valve seat. The association of each solenoid valve (V1–V8) with its corresponding valve seat 123 is schematically indicated in FIG. 5. The solenoid valves V1–V8 are not illustrated in FIG. 5, only their association with a particular valve seat 123. The valve head 145 includes a valve tip 147 attached to the valve head. A distal surface 149 of the valve tip 147 is shaped in correspondence with the shape of the sealing surface 137 of the valve seat 123. The valve head 145 is spaced from the valve seat 123 in FIG. 11 so that the passage branch 117A is unobstructed and liquid may flow unimpeded through the passage past the valve seat. To block the flow of liquid through the point of the passage coinciding with the location of the valve seat 123, the valve stem 143 is extended by the solenoid valve V7 so that the valve tip 147 engages the first sheet 55 and deforms it into the valve seat window 135. The first sheet 55 is pressed tightly against the sealing surface 137 of the valve seat 123 and substantially conforms to the sealing surface over the surface area of the distal surface 149 of the valve tip 147 so that so that the passage is occluded by the deformed portion of the first sheet, as shown in FIG. 12. The valve tip 147 is preferably made of an elastomeric material which is capable of resilient deformation. An example of such a material is silicone rubber having a hardness of 25–30 Shor A. Generally speaking, the hardness of the material should be less than about 55 Shor A, more preferably less than 40 Shor A and most preferably less than 35 Shor A. Other materials could be used, such as a soft polyurethane, natural rubber and a thermoplastic elastomer (e.g., Hytrel® thermoplastic elastomer available from E. I. Du Pont De Nemours & Co. of Wilmington, Del.).

It is not uncommon for the liquid flowing within the manifold 95 to contain particulate matter, for example, orange juice may contain pulp. Should a piece of pulp become lodged between the first sheet 55 and the valve seat 123, it could cause separation of the first sheet from the sealing surface 137, resulting in leakage past the valve seat. However, the resiliently deformable valve tip 147 of the present invention is capable of deforming itself and the first sheet 55 about the pulp (or other particulate) in the liquid so that the first sheet is forced down against the sealing surface 137 around the pulp, at least partially enveloping the pulp and sealing around it. In this way, the passage 117A is still blocked notwithstanding the presence of pulp or another particulate at the valve seat 123. When the solenoid valve V7 is opened (i.e., moves the valve head 145 and tip 147 back to the position of FIG. 11), the first sheet 55 resiliently springs back to its original position above the sealing surface 137, reopening the passage past the valve seat 123.

Figure 13:
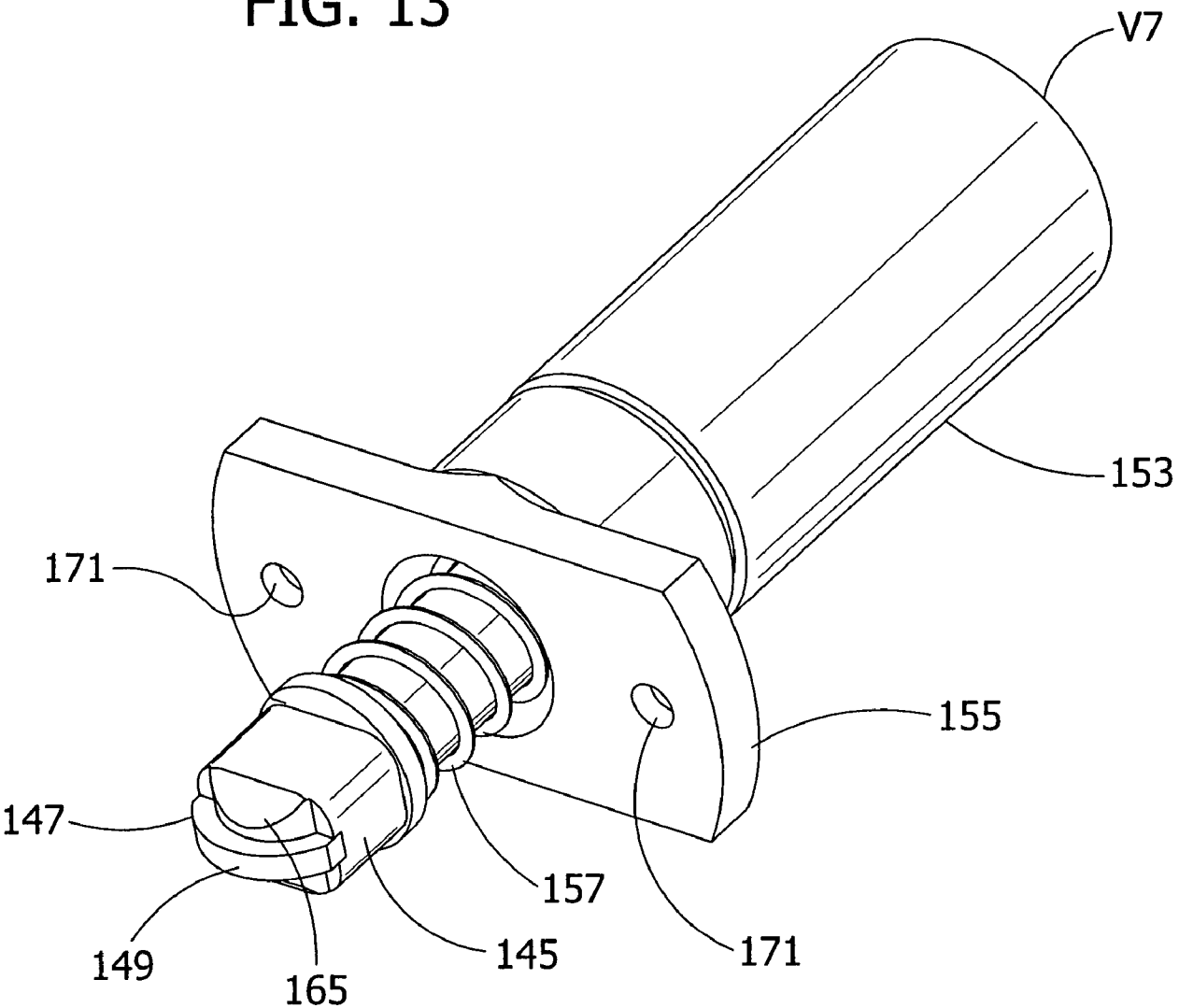
FIG. 13 is an enlarged perspective of the valve including its solenoid driver.
Figure 14:
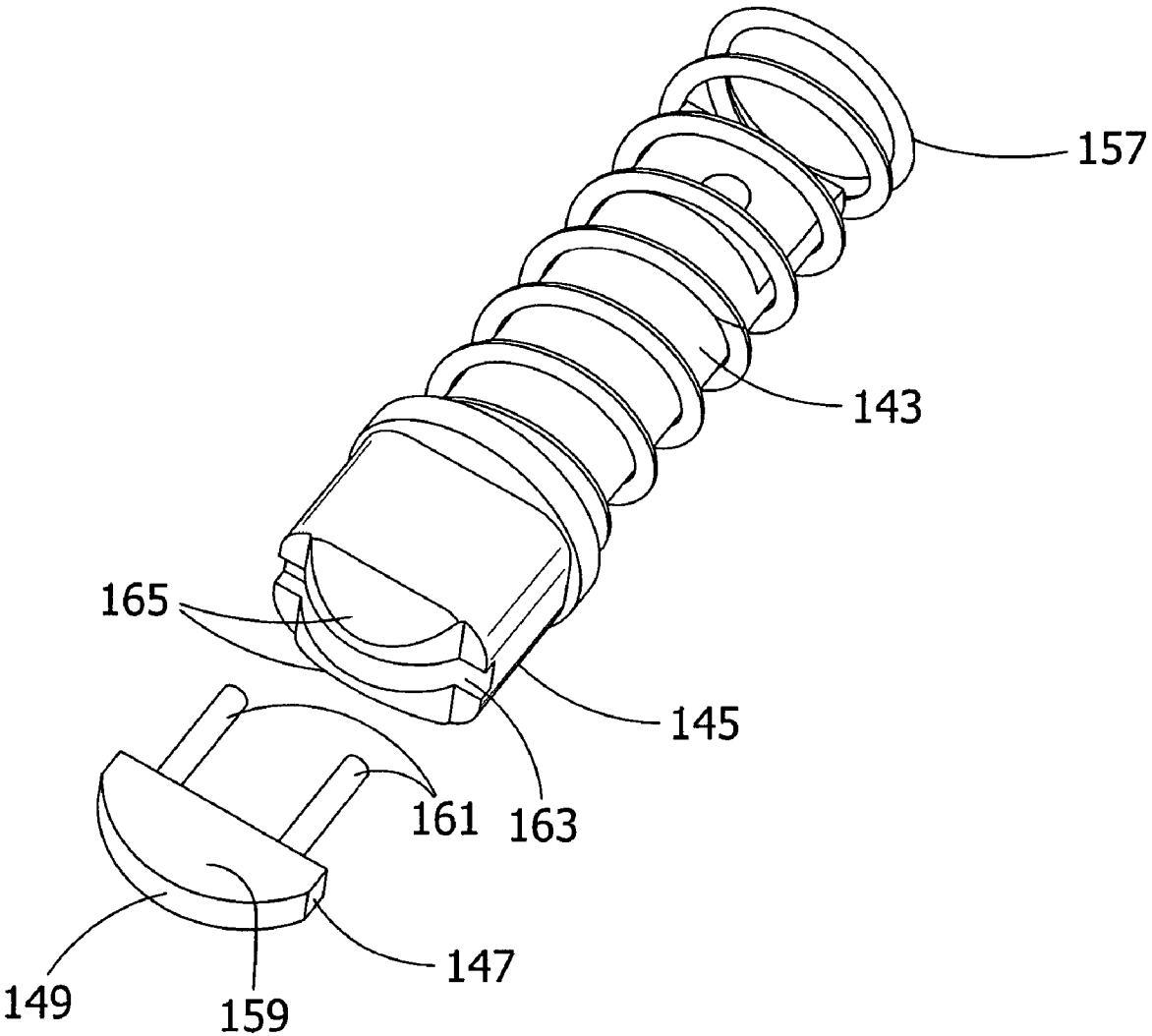
FIG. 14 is an enlarged perspective of a head of the valve with a valve tip exploded therefrom.

Referring now to FIGS. 13 and 14, each solenoid valve, including illustrated solenoid valve V7, includes a cylinder 153 having a flange 155 at one end for use in mounting on the frame 23 and fixed shell member 25. The cylinder 153 receives the valve stem 143 which is biased outwardly from the cylinder by a coil spring 157 which engages the cylinder and the valve head 145. Thus, the ordinary or unenergized position of the solenoid valve V7 is to close the passage 117A by force of the spring 157. The cylinder 153 contains a suitable electromagnetic device which is operable upon energization to draw the valve stem 143 into the cylinder and to open the valve seat 123 for transfer of liquid through the passage 117A. The solenoid valve V7 may be configured differently than shown and other types of valves may be used without departing from the scope of the present invention. As shown in FIG. 14, the valve tip 147 comprises a roughly half-moon shaped piece 159 of silicone rubber and a pair of attachment rods 161. The attachment rods are received in holes (not shown) in the valve head 145 for securing the valve tip 147 to the head. The valve head 145 includes a transverse groove 163 which receives the inner end margin of the rubber piece 159. Tongues 165 project longitudinally of the solenoid valve V7 from the head 145 on opposite sides of the rubber piece 159 when received in the groove 163. The tongues 165 have roughly arcuate shapes in correspondence to the shape of the distal surface 149 of the valve tip 147 to provide support against lateral movement of the valve tip in directions perpendicular to the major surfaces of the piece 159.

Figure 14A:
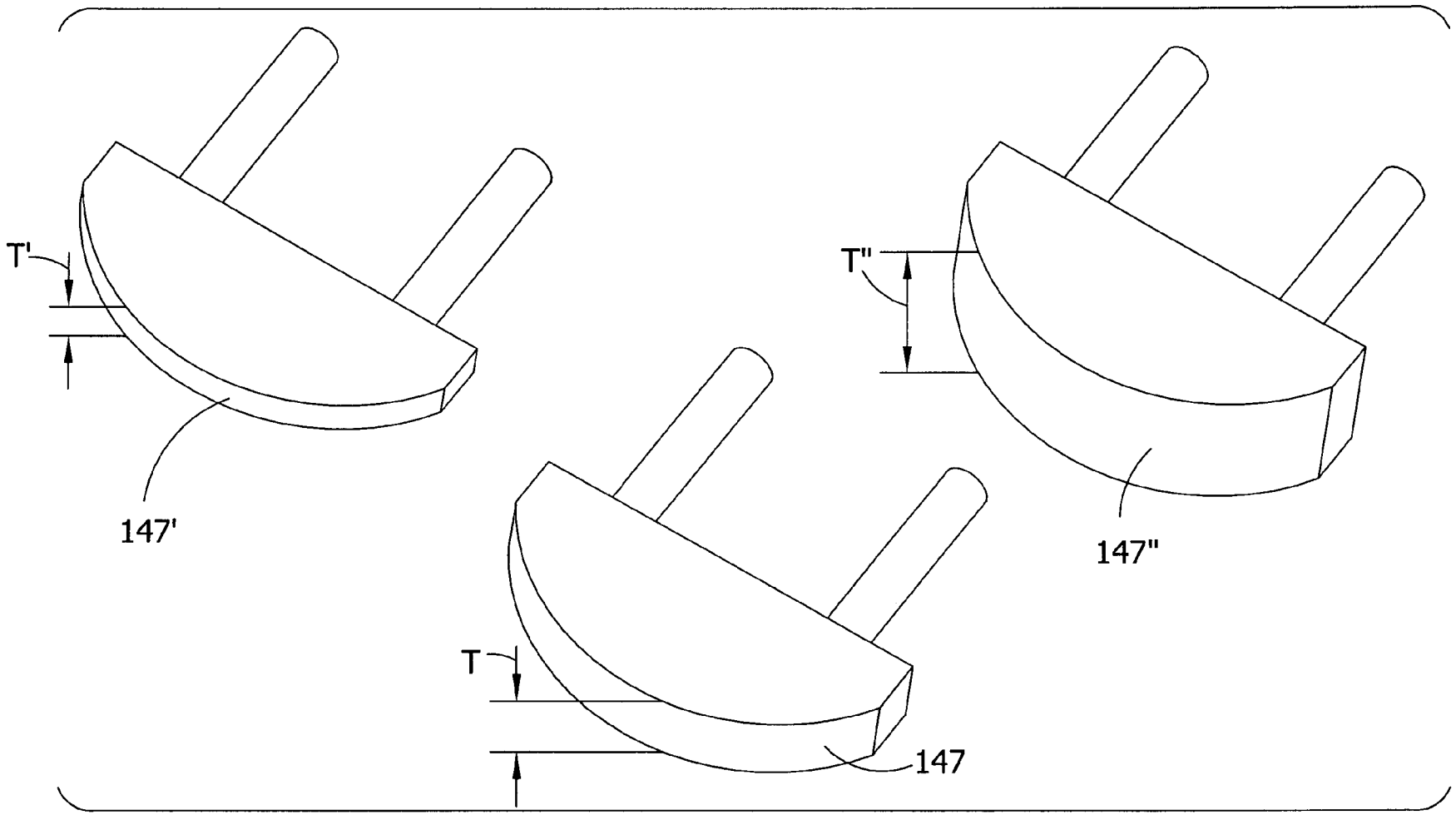
FIG. 14A is a perspective of valve tips having three different thicknesses.
Figure 14B:
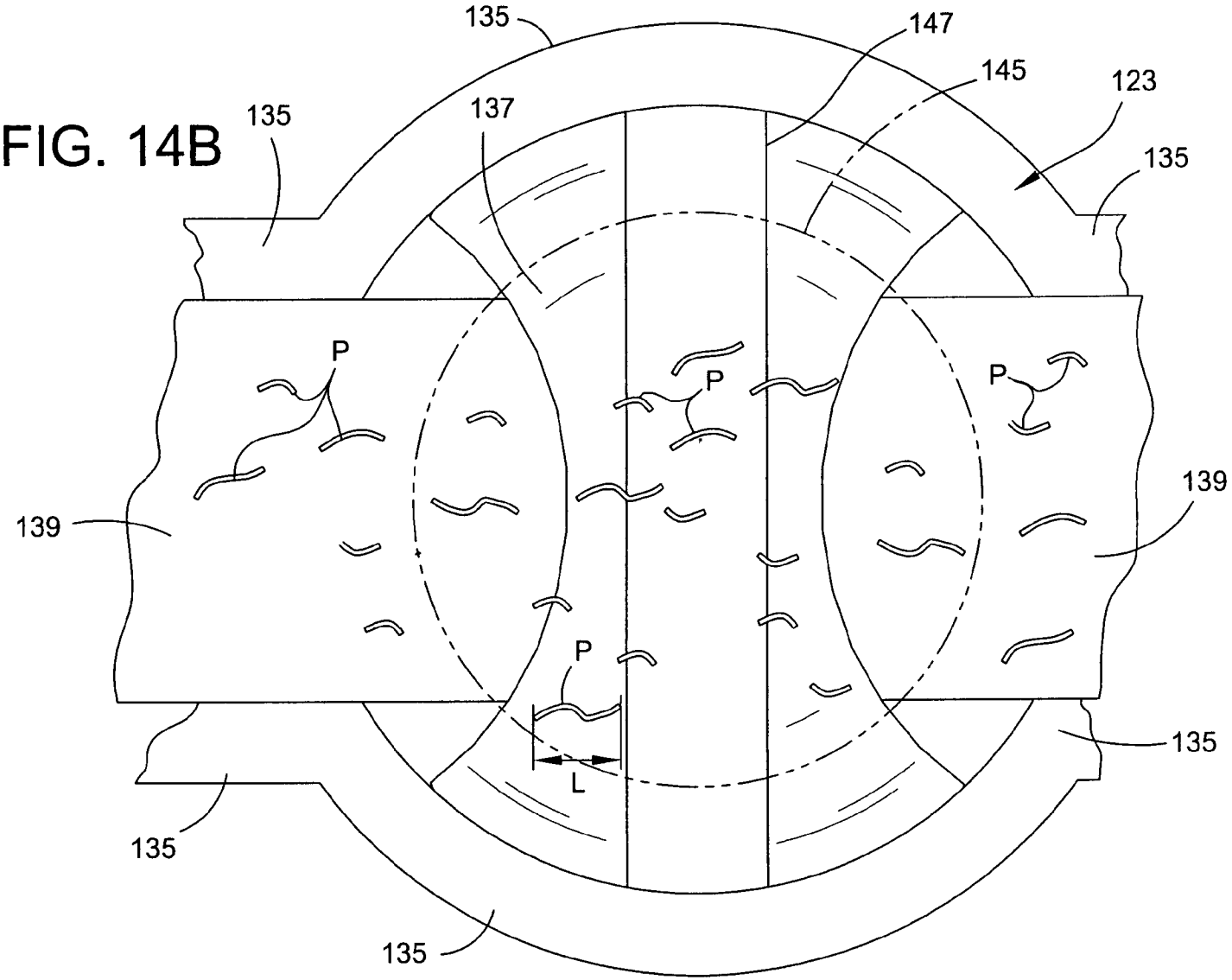
FIG. 14B is a schematic section taken as indicated by line 14A—14A of FIG. 12 and illustrating engagement of the valve tip with the valve seat.

The valve tip 147 may be provided in different thicknesses T, T' and T" to facilitate sealing for different kinds of fluent material having particulate matter of different sizes. FIG. 14A shows valve tip 147 with valve tips 147' and 147", having a lesser and greater thickness dimension (T' and T", respectively) than the thickness T of the valve tip 147. As stated previously, the valve tip 147 is made of a relatively soft elastomer which causes the sheet 55 to conform around any particulates present in the fluent material so that sealing is achieved. However, this capability is insufficient to insure that sealing will be achieved if the length of the longest particulate is greater than the thickness of the valve tip. 147. Referring to FIG. 14B, particulate matter in the form of juice pulp P is illustrated next to and underlying the valve tip 147. The longest length L of pulp P in a particular kind of juice can be established by known methods. The valve tip (147, 147', 147") is preferably selected to be thicker than the longest piece of pulp P in the juice. Thus, even the longest piece of pulp P will not be able to extend completely under the valve tip 147. It will be appreciated that if a piece of pulp (not shown) could extend along the valve seat 123 under the valve tip 147 a distance greater than the thickness of the valve seat, leakage could occur. Even though the valve tip 147 is able to conform the sheet 55 around the pulp, it could not completely envelope it, leaving open the possibility that juice could migrate under the valve tip along the piece of pulp.

The solenoid valves V1–V8 are mounted on the frame 23 and fixed shell member 25 by respective pairs of bolts 169 which extend through holes 171 in the flanges 155 of the cylinders 153, through the frame and into the fixed shell member. It is noted with reference to FIG. 16 that one pair of solenoid valves (V3 and V4), because of their orientation and close proximity to each other share a flange 155 which receives three bolts 169 to mount the pair of valves. The valve stem 143 of each valve (V1–V8) extends into the fixed shell member 25 and the valve head 145 is located in a respective one of openings 173 formed on the interior face of the fixed shell member (see FIG. 15). Each solenoid valve (e.g., solenoid valve V7) is operable to move the valve tip 147 through the opening 173 to deform the first sheet 55 into engagement with a sealing surface 137 of the corresponding valve seat 123 of the flexible bag 9 to occlude the passage 117 at the location of that particular valve, and to retract into the opening to open the passage. It will be appreciated that in operation, these openings 173 are aligned with respective valve seats 123 of the manifold 95. An aperture 175 in the inner face of the fixed shell member 25 is provided for passing vacuum pressure to the pivoting shell member 27. The aperture 175 is surrounded by an O-ring 177 for sealing engagement with the pivoting shell member 27 through the oval passage 87 in the flexible bag 9. Two cavities 179 at the bottom of the fixed shell member 25 are provided for the hinge 29 connecting the pivoting shell member 27 to the fixed shell member. Hinge pins 181 used to make the connection may be seen in each cavity 179.

Figure 15:
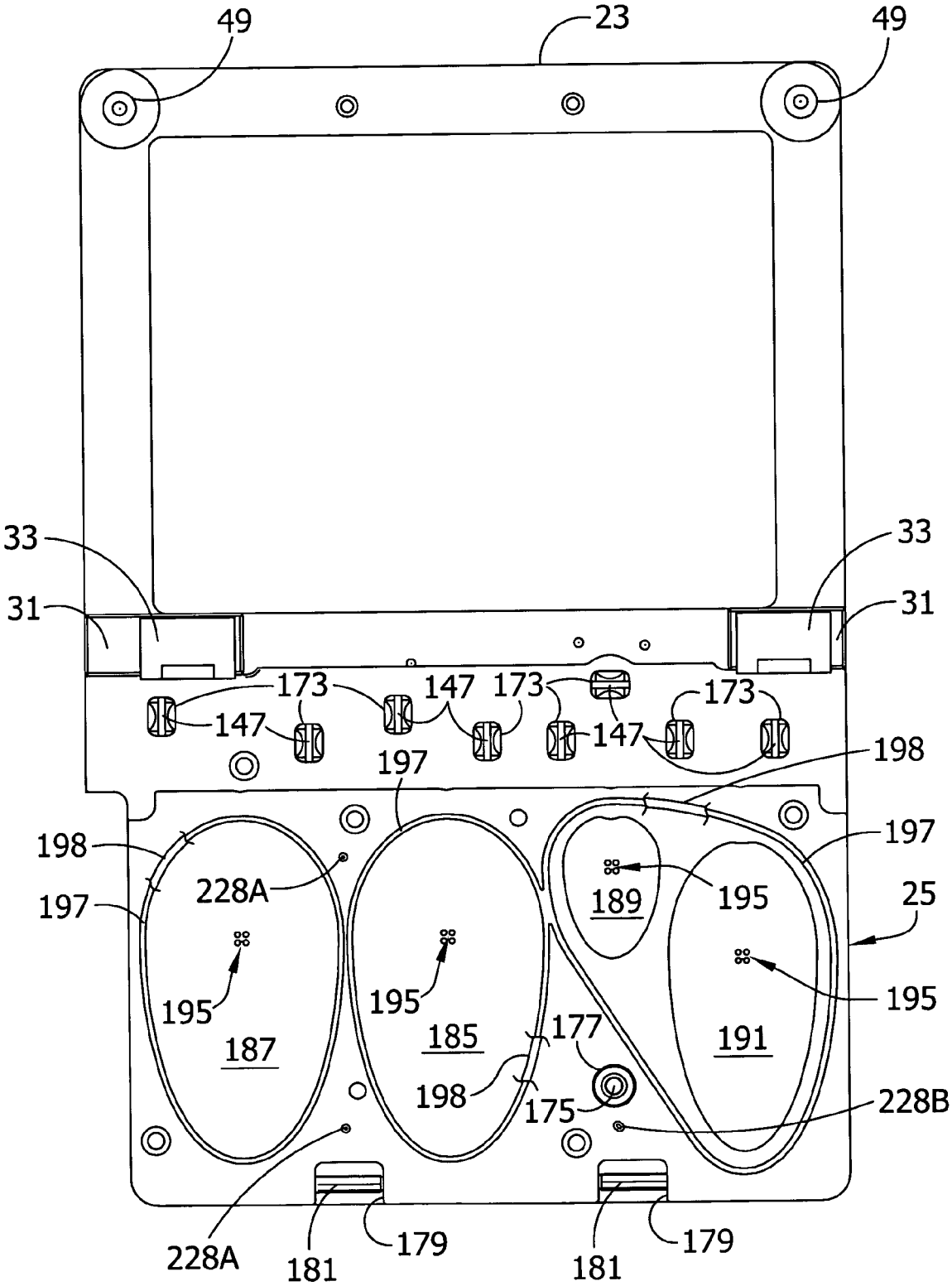
FIG. 15 is a front elevation of a fixed shell member of the flow control apparatus.

As shown in FIG. 15, the interior face of the fixed shell member 25 is formed with two roughly oval (or egg-shaped) recesses indicated at 185 and 187, which are sized and shaped to receive the first mixing cell 73 and the second mixing cell 77, respectively, of the flexible bag 9. A third recess 189 is sized to receive the concentrate dosing cell 65, and a fourth recess 191 is sized to receive the water dosing cell 69. Each of the recesses (185, 187, 189, 191) in the fixed shell member 25 has a grouping of four small ports (the grouping indicated generally at 195) in each recess is used for applying fluid pressure to the recess and the cell (73, 77, 65, 69) contained therein. An opening (not shown) in the fixed shell member 25 in each of the recesses 185, 187, 189, 191 may be provided to sensors (not shown) to ascertain the state of the corresponding cell (65, 69, 73 and 77). The first two recesses 185, 187 are surrounded by channels 197 which hold respective O-rings 198 for sealing with the flexible bag 9 adjacent to the portion of the mixing cells 73, 77 received in the recesses. The third and fourth recesses 189, 191 are both surrounded by a single channel 197 and O-ring 198 because the concentrate dosing cell 65 and the water dosing cell 69 are operated conjointly in the illustrated embodiment. Thus, each of the first two recesses 185, 187, and the third and fourth recesses 189, 191 are isolated in their own regions from the other regions and from the ambient so that the fluid pressure applied in each region is entirely independent of that applied in any other region. Only fragments of the O-rings 198 are shown in FIG. 15, but they extend completely around the channels 197.

The fluid pressure control valves PV1–PV4 (see FIG. 3) are mounted on the outer face of the fixed shell member 25 through an opening 199 (FIG. 16) in the frame 23. The control valves PV1–PV4 are not shown in FIG. 16 for clarity. There is one control valve (PV2–PV4) for each of the aforementioned isolated regions in the fixed shell member inner face, and one control valve PV1 for the application of vacuum pressure to the pivoting shell member 27. The control valves PV1–PV4 are each connected to a high pressure input connector 201, a low pressure input connector 203 and a vacuum pressure input connector 205 extending through the cover 47 on the top side thereof (see FIG. 3). The high pressure input connector 201 may for example deliver air pressurized to about 40 psi for use in driving the operation of the control valves PV1–PV4. The control valves PV1–PV4 are also connected to a source of electrical power (not shown) for use in driving operation of the valves.

The low pressure input connector 23 may for example deliver air pressurized to about 10 psi for use in apply pressure tending to collapse the cells 65, 69, 73, 77 of the flexible bag 9. The vacuum pressure connector 205 may for example deliver a vacuum pressure of about −7 psi for expanding the cells 65, 69, 73, 77 and also for holding the second sheet 57 of the flexible bag 9 against the pivoting shell member 27, as will be more fully described. Other pressures may be applied without departing from the scope of the present invention. It is also possible to apply pressure and vacuum to the side of the flexible bag 9 facing the pivoting shell member 27 within the scope of the present invention. The control valves PV1–PV4 operate so that positive or vacuum pressure is applied to the respective cells 65, 69, 73, 77 through the ports 195 in the recesses of the fixed shell member 25 for collapsing or expanding the cells to selectively discharge or draw in liquid. Control valve PV1 is connected to the fixed shell member 25 by a fitting 202, control valve PV2 is connected by fittings 204A, 204B, control valve PV3 is connected by a fitting 206 and control valve PV4 is connected by a fitting 208. The fittings 202, 204A, 204B, 206, 208 are connected by passaging in the fixed shell member 25 and (in the case of fitting 202) in the pivoting shell member 27 to respective ones of the recesses 185, 187, 189, 191, 211, 213, 215, 217 for applying positive and vacuum pressure. A member 212 projecting from the cover 47 (FIG. 3) is provided for making electrical connection to the valves PV1–PV4 and for venting air to ambient.

Figure 17:
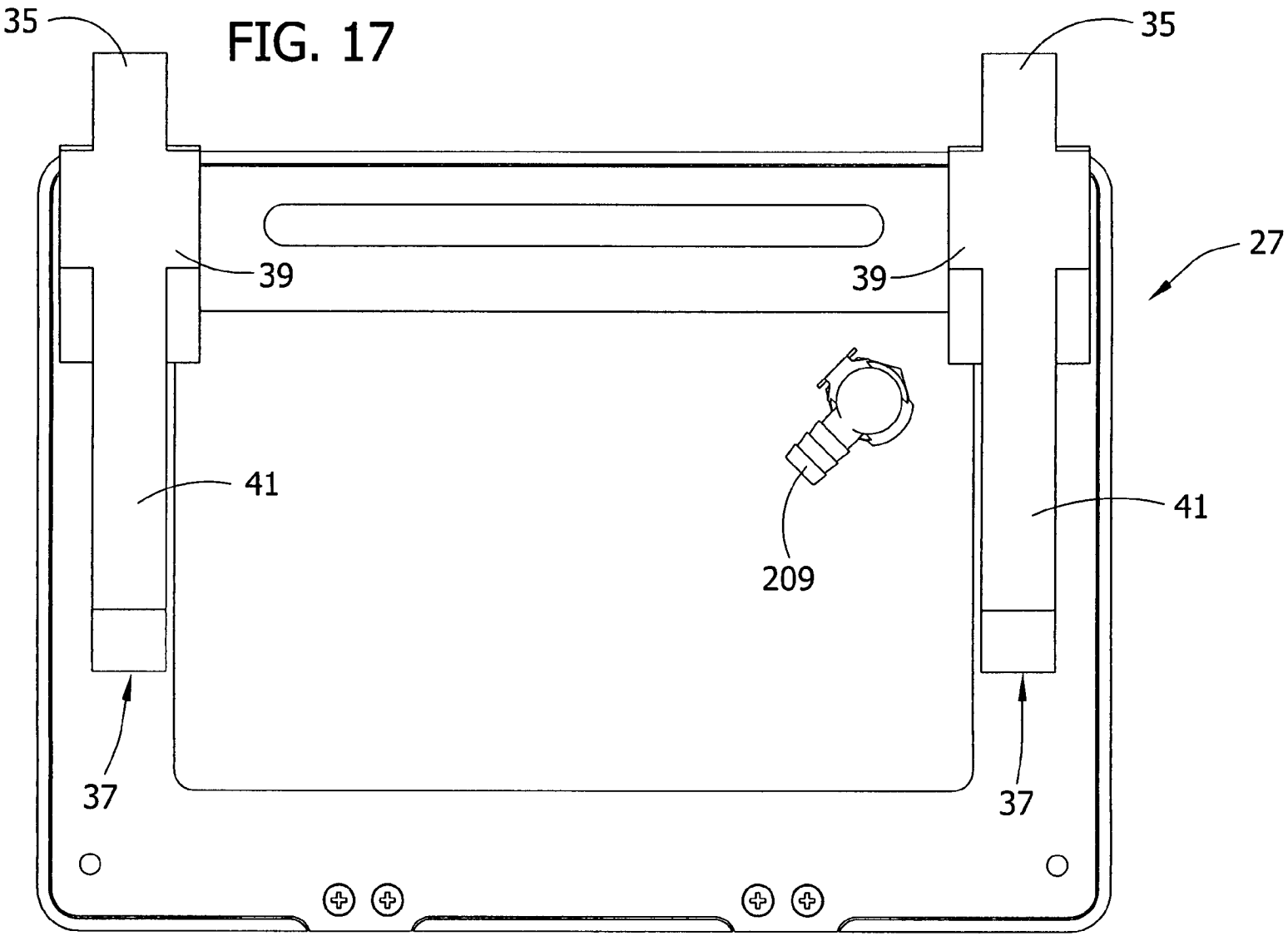
FIG. 17 is a front elevation of a pivoting shell member of the flow control apparatus.
Figure 18:
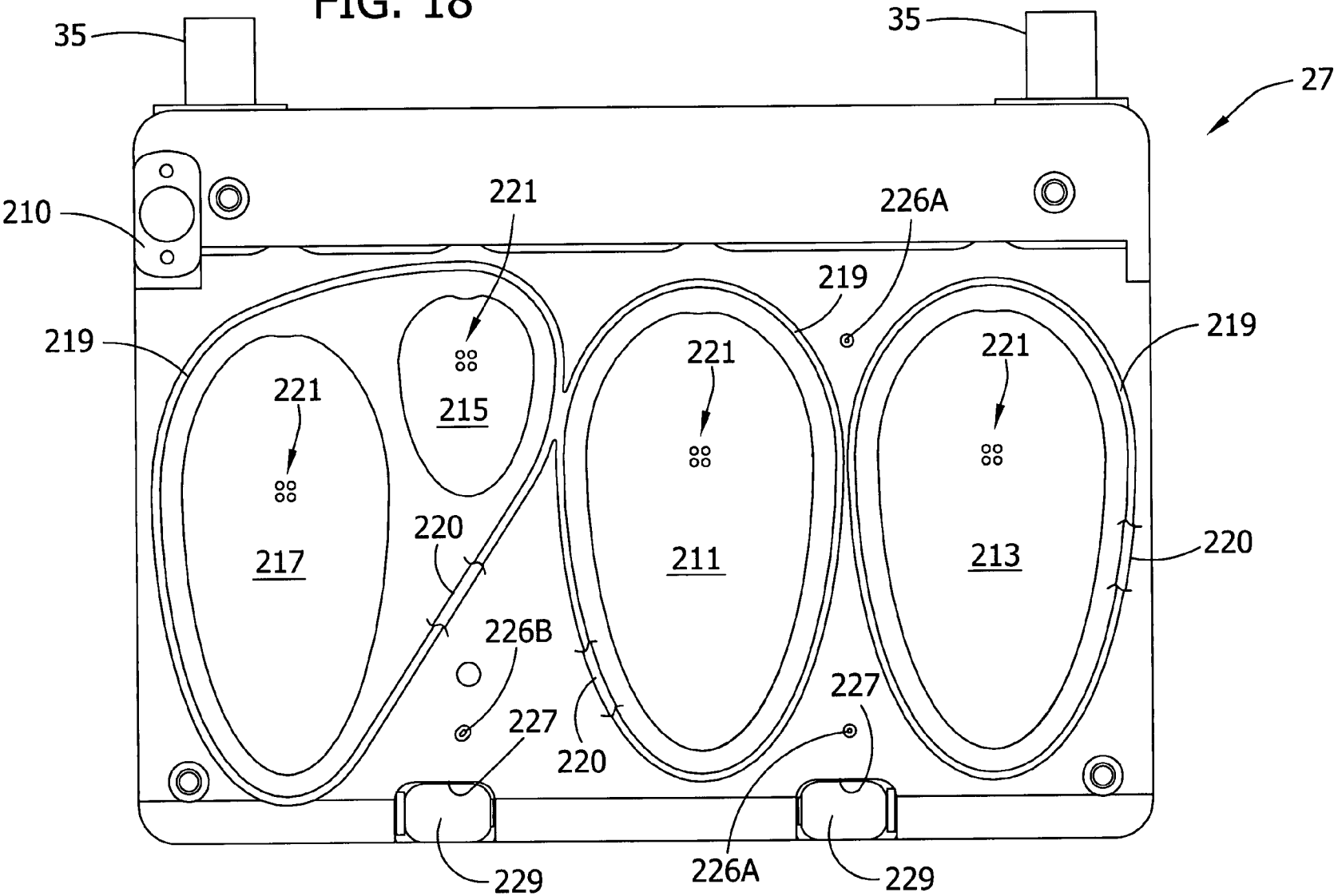
FIG. 18 is a rear elevation thereof.

Referring now to FIGS. 17 and 18, the pivoting shell member 27 mounts on its outer face (FIG. 17) the previously described latching mechanisms 37 used to secure the pivoting shell member to the fixed shell member 25 in the closed position. A quick release connector 209 is capable of releasable, sealing attachment of a water line hose (not shown) thereto for supplying water (the diluent) to the flow control apparatus 7. The water passes from the connector 209 through the inner face of the pivoting shell member 27 to a shuttle connector 210. The shuttle connector punctures the second sheet 57 of the flexible bag 9 when the pivoting shell member 27 is closed, and seals with the circular frame element (inlet) 115 in the manifold 95 (e.g., as by engagement of an O-ring in the frame element). However, other structures for making the water connection, including a strictly manual connection, are contemplated. The inner face of the pivoting shell member 27 has recesses (designated 211, 213, respectively) to receive respective halves of the mixing cells 73, 77, a recess 215 to receive half of the concentrate dosing cell 65 and a recess 217 to receive half of the water dosing cell 69.

Figure 29:
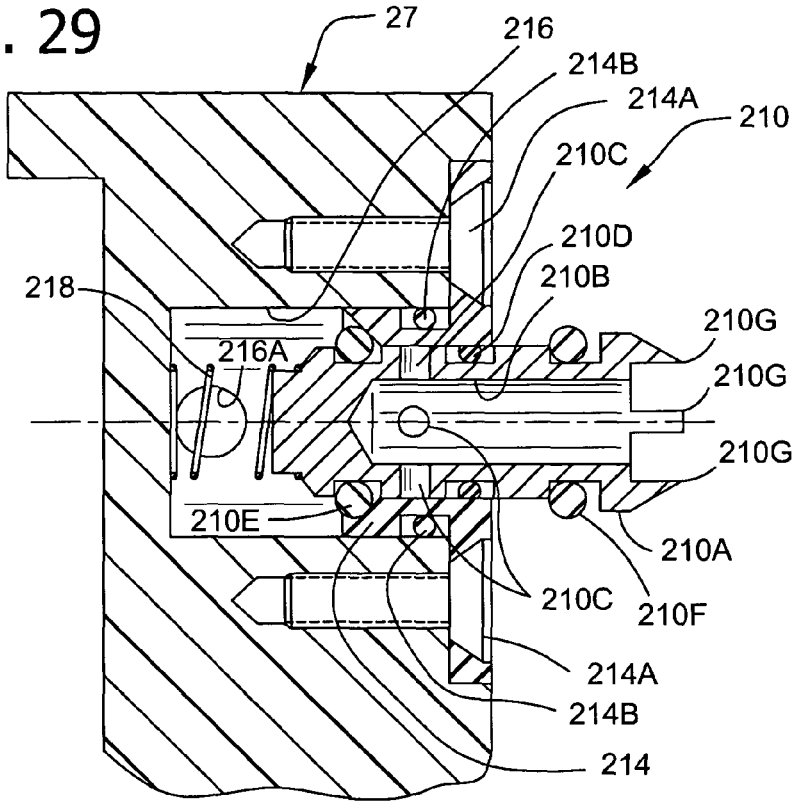
FIG. 29 is a fragmentary, schematic vertical section of the pivoting shell member taken generally as indicated by line 29—29 of FIG. 4 and showing a quick-connect shuttle connector.

The operation of the shuttle connector 210 is illustrated in detail in FIGS. 29–32. FIG. 29 is a schematic section taken generally as indicated by line 29–29 of FIG. 4, showing a fragmentary portion of the pivoting shell member 27 spaced away from the fixed shell member 25 (not shown in FIG. 29) in the open position of the pivoting shell member. The shuttle connector 210 includes a shuttle 210A slidably mounted by a seat element 214 in a cavity 216 in the pivoting shell member 27. Screws 214A attach the seat element 214 to the pivoting shell member 27 generally in the cavity. An O-ring 214B around a tubular portion of the seat element 214 within the cavity 216 seals between the seat element and the pivoting shell member 27 in the cavity for preventing leakage of water around the seat element. The shuttle 210A is slidingly received in the tubular portion of the seat element 214 and biased outward from the seat element and cavity 216 by a coil spring 218. The shuttle has an internal passage 210B which opens at the distal end of the shuttle 210A and has four radial ports 210C (three of which are shown) nearer the proximal end of the internal passage. The shuttle 210A further includes a first O-ring 210D received around a central portion of the shuttle and preventing water from passing between the shuttle and seat element 214 within the tubular portion of the seat element. A second O-ring 210E located at the proximal end of the shuttle 210A is normally biased by spring 218 to engage the seal element 214 at the inner end of its tubular portion to prevent water from entering the tubular portion of the seat. The second O-ring 210E can be moved off the seat element 214, as will be described. A third O-ring 210F is provided for engaging the seat element 214 and the manifold 95 within the circular frame element 115 for a fluid tight seal as explained more fully hereinafter. Sharpened prongs 210G at the distal end of the shuttle 210A around the open end of the internal passage 210B are useful for puncturing the sheet 57 of the flexible bag 9. The cavity 216 has a port 216A for communication of water from the water hose (not shown) attached to the connector 209 (see FIG. 17) of the pivoting shell member 27 into the cavity.

Figure 2:
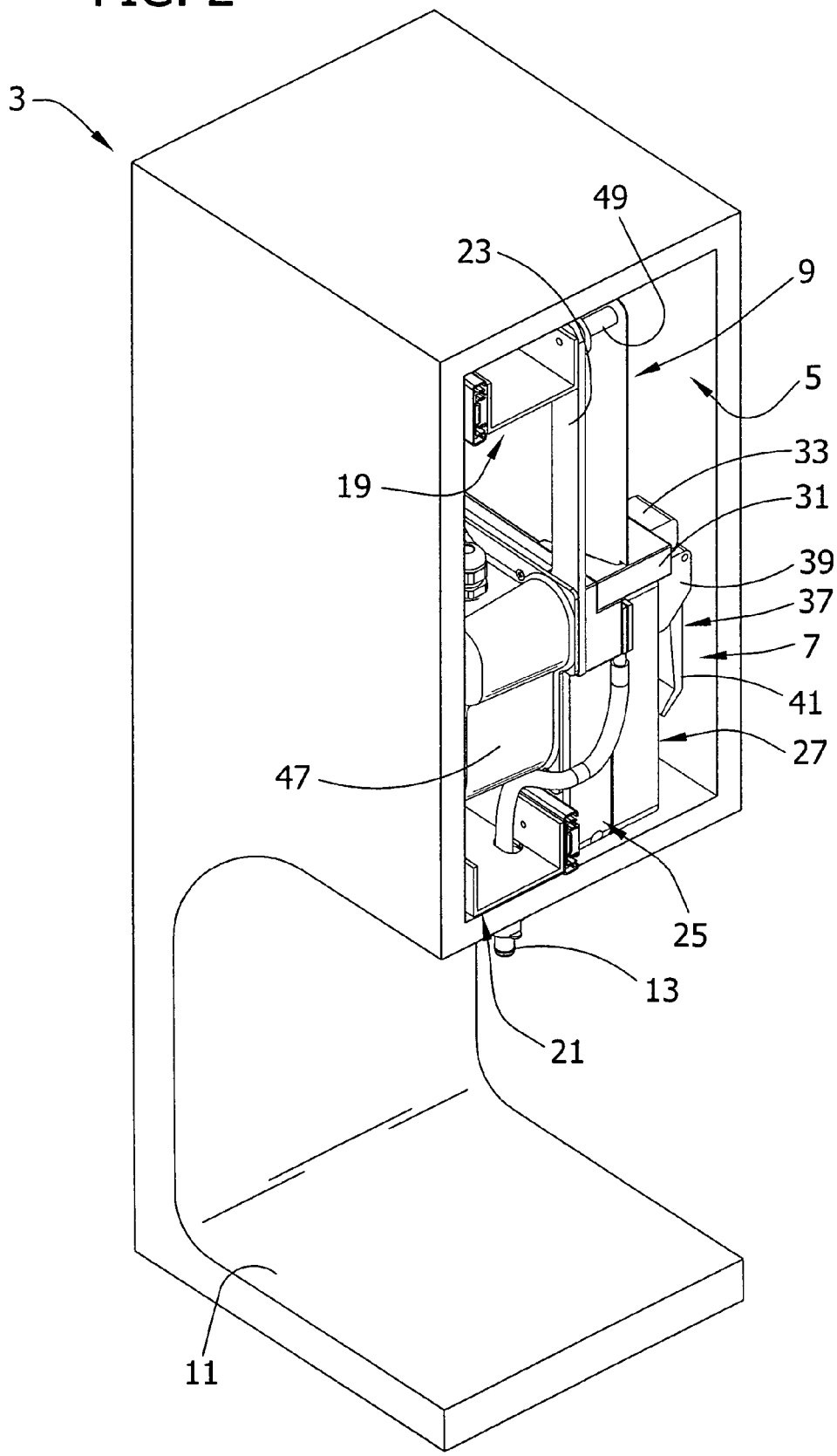
FIG. 2 is the perspective of FIG. 1, but with a front door of the dispenser housing removed to show internal flow control apparatus of the dispenser.
Figure 30:
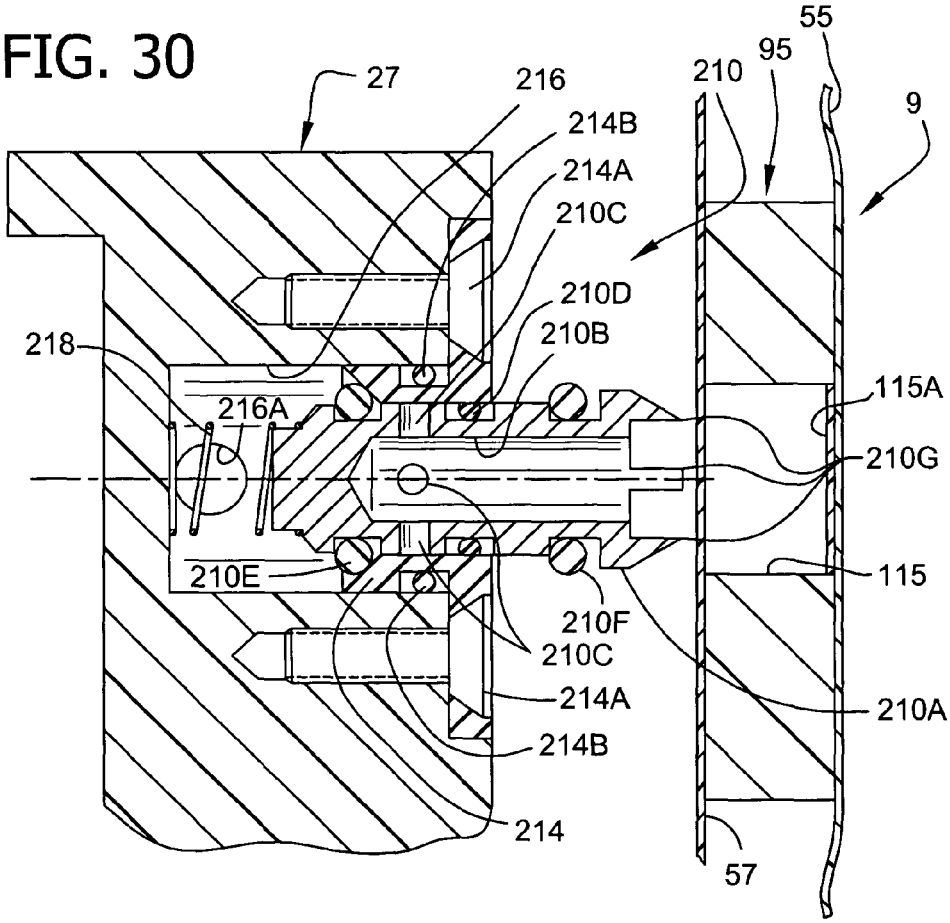
FIGS. 30–32 are the section of FIG. 29, but illustrating stages of the connection of the shuttle connector with the flexible bag of FIG. 4.
Figure 31:
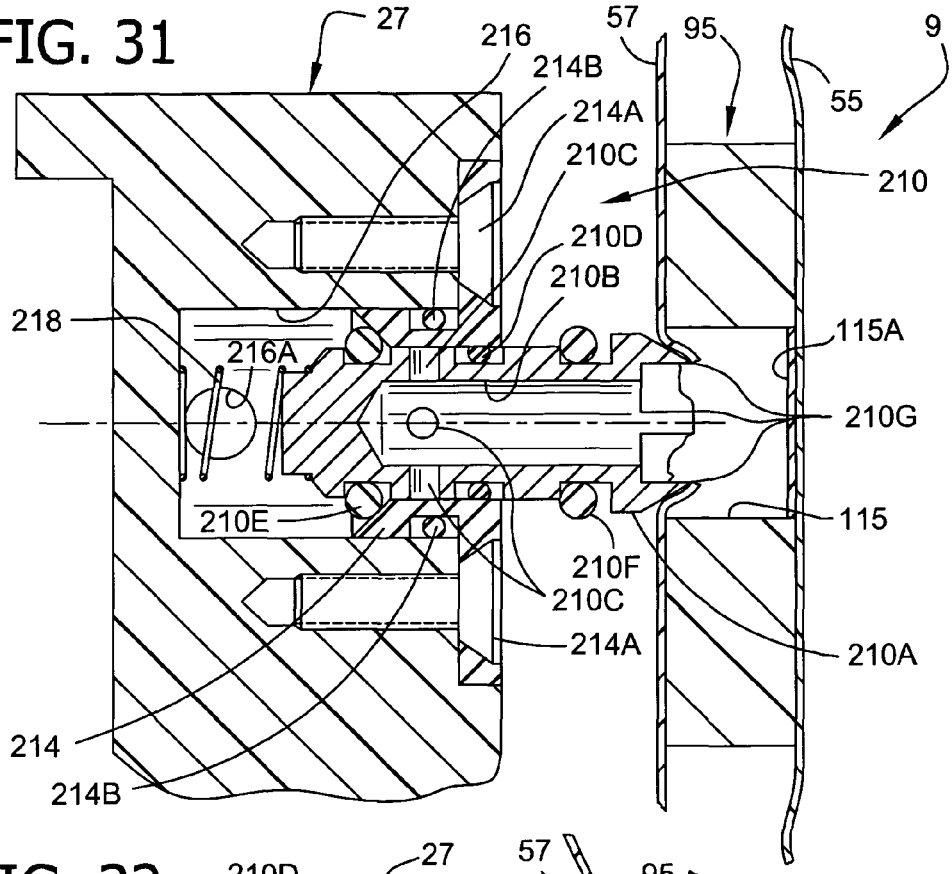
Figure 32:
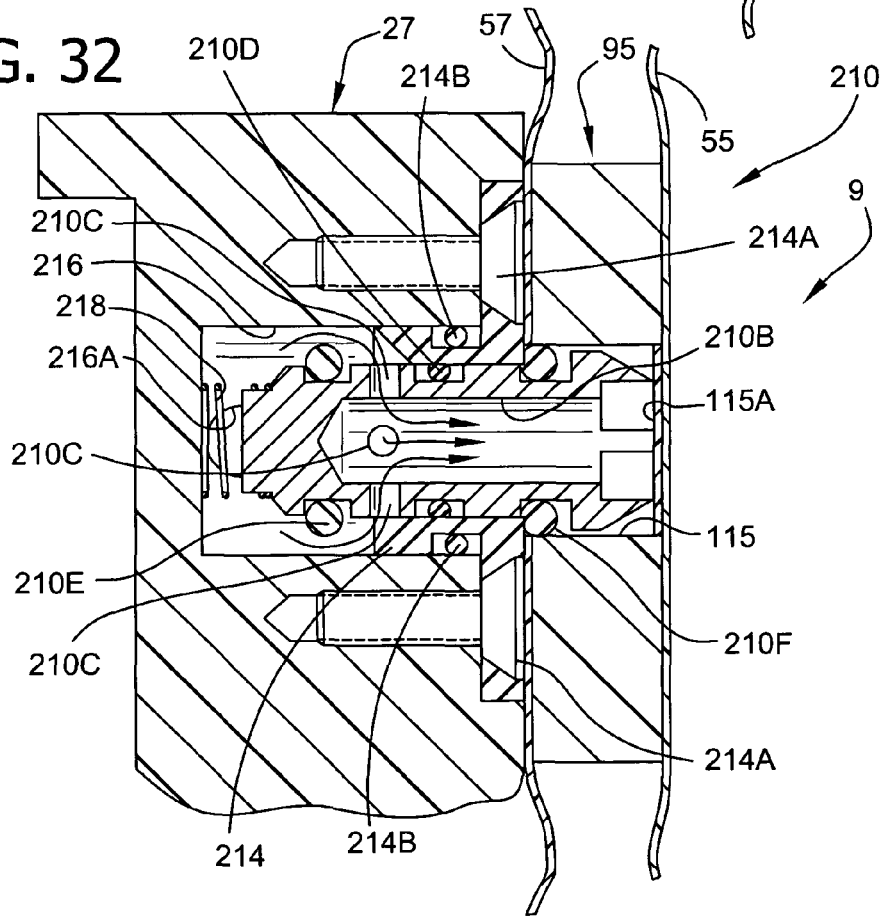

After the flexible bag 9 is hung on the frame 23 and positioned between the V-blocks 31 so that respective portions of the cells 65, 69, 73, 77 are received in recesses 189, 191, 185, 187, (see FIG. 5), the pivoting shell member 27 may be swung up from the position shown in FIG. 4 to the closed position shown in FIGS. 2 and 3. FIG. 30 schematically illustrates the shuttle connector as it approaches the fixed shell member (not illustrated in FIG. 30) and the flexible bag 9, but prior to engagement. The shuttle connector 210 generally lines up with one of the circular frame elements 115 of the manifold 95 as the pivoting shell member 27 approaches the flexible bag 9 arranged on the fixed shell member 25. The sharpened prongs 210G of the shuttle engage the sheet 57 of the flexible bag 9, puncturing the sheet where it overlies the circular frame element 115. FIG. 31 illustrates the condition just after the shuttle prongs 210G engage and puncture the sheet 57 of the flexible bag 9. The shuttle 210A then continues into the opening defined by the circular frame element 115 and engages a bottom wall 115A of the circular frame element, and the third O-ring 210F engages the manifold 95 in the circular frame element 115 and also the seat element 214, forming a seal. As the pivoting shell member 27 continues toward the closed position, the shuttle 210A slides backward into the cavity 216 against the bias of the spring 218 so that the second O-ring 210E moves off of the seat member, exposing the radial ports 210C to the interior of the cavity. FIG. 32 illustrates the pivoting shell member 27 after it has reached the closed position. Water is allowed to enter the internal passage 210B through the radial ports 210C and pass out of the shuttle 210A into the manifold 95 for diluting the concentrate.

When the pivoting shell member 27 is moved again to the open position after the concentrate in the flexible bag 9 is exhausted, the shuttle 210A is able to automatically close to shut off the flow of water. More particularly, the spring 218 moves the shuttle 210A outward from the cavity 216 as the pivoting shell member 27 moves away from the flexible bag 9 so that the second O-ring 210E seats against the seat element 214 to prevent water from entering the internal passage 210D through the radial ports 210C. Thus, water is shut off automatically when the pivoting shell member 27 is moved away from the closed position next to the fixed shell member 25 toward the open position. The shuttle 210A is withdrawn from the circle frame member 115 of the manifold 95 upon continued movement of the pivoting shell member 27, providing for dry disconnect of the water to the flexible bag 9.

Referring to FIG. 18, the mixing cell recesses 211, 213 are each surrounded by grooves 219 which contain respective O-rings 220 adapted for sealing engagement with the flexible bag 9 to isolate the recess from the other recess and from ambient. A single groove 219 and O-ring 220 surrounds a region including the recess 215 for the concentrate dosing cell 65 and the recess 217 for the water dosing cell 69. The single O-ring 220 isolates these two recesses 215, 217 from the other recesses 211, 213 and from ambient. Only fragmentary portions of the O-rings 220 are shown in FIG. 18, but they extend the full length of the grooves 219. A grouping of four small ports (the grouping indicated generally at 221) in each recess provides fluid communication for vacuum pressure to the half of the cells 73, 77, 65, 69 in the recesses 211, 213, 215, 217. This vacuum pressure is communicated from the fixed shell member 25 through the opening 175 in the inner face of the fixed shell member which is sealingly engaged through the oval passage 87 in the flexible bag 9 with the inner face of the pivoting shell member 27 around an opening (see FIG. 4). The opening communicates with internal passages generally indicated at 225 in the pivoting shell member 27 (see FIG. 19) to communicate the vacuum pressure to each of the groupings of ports 221.

Figure 19:
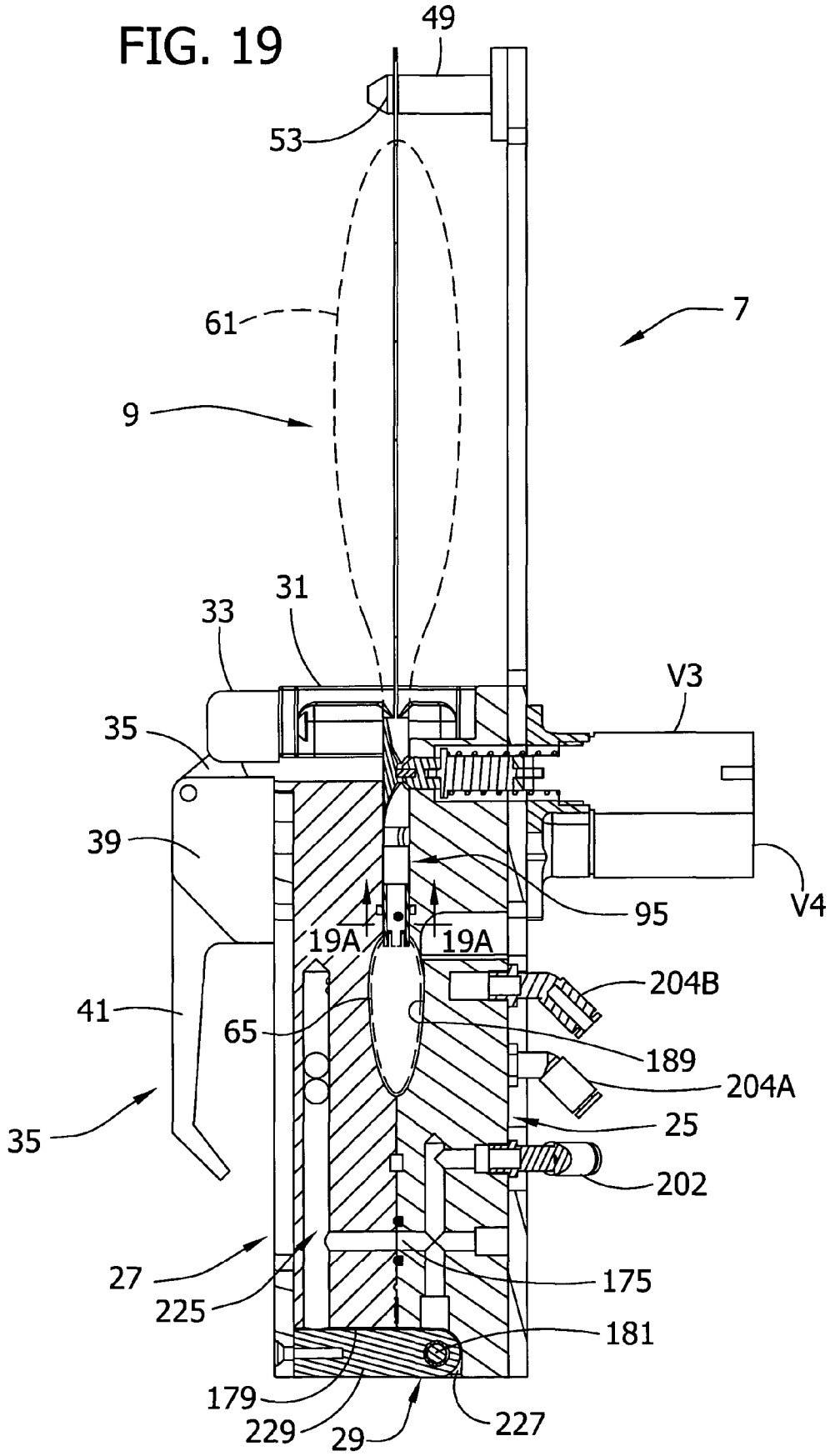
FIG. 19 is a vertical section of the flow control apparatus including the flexible bag.
Figure 19A:
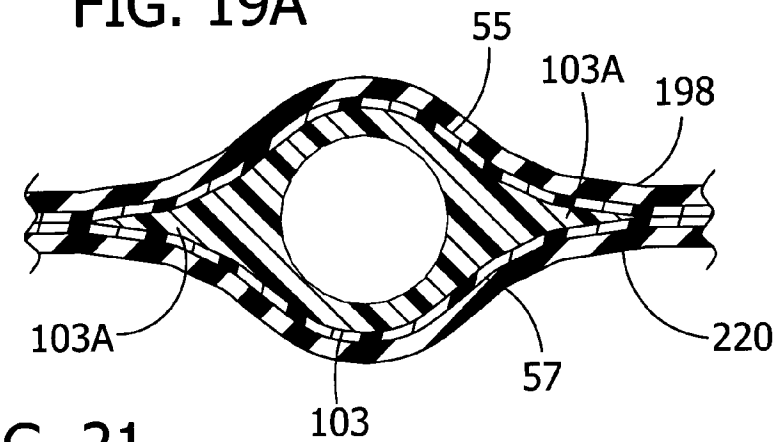
FIG. 19A is a schematic section taken generally along line 19A—19A of FIG. 19.

FIG. 19A schematically illustrates the advantageous construction of the tube wings 103A of the tube 103 in the pneumatic isolation of the region including the recesses 189, 191 of the fixed shell member 25 and the two recesses 215, 217 of the pivoting shell member 27. The tapered shape of the wing 103A allows the O-rings 198, 220 to gradually transition over the tube 103 so that the O-rings maintain continuous contact with respective ones of the first and second sheets 55, 57 of the bag 9. A sharp transition over a rigid tube (not shown) could produce a gap in contact between the seals 198, 220 and their corresponding sheet 55, 57 resulting in leakage from the isolated region and loss of positive or vacuum pressure in the region. The wings 101A, 105A, 107A of the other tubes 101, 105, 107 facilitate continuous sealing of the O-rings 198, 220 with the flexible bag 9 in the same way as described for tube 103. Thus it will be understood that the region including recesses 185 and 211, and the region including recesses 187 and 213 are similarly maintained in pneumatic isolation.

Referring again to FIG. 19, cavities 227 at the lower edge margin of the pivoting shell member 27 receive hinge blocks 229 fixedly attached to the pivoting shell member and projecting outwardly therefrom. The hinge blocks 229 extend into the cavities 179 at the lower edge margin of the fixed shell member 25 where they are pivotally mounted on the fixed shell member by the hinge pins 181. This arrangement is best seen in FIG. 19, which illustrates the fixed and pivoting shell members 25, 27 in a closed position. Thus, the pivoting shell member 27 is capable of pivoting with respect to the fixed shell member 25 between the open and closed positions. Two circular slots 226A, and an elongate slot 226B (FIG. 18) are adapted to receive conical locator pins 228A and elongate, tapered tab 228B (FIG. 15) to align the fixed and pivoting shell members 25, 27 when they are closed. The conical and tapered shape of the pins 228A and tab 228B allow mating with the corresponding slots even though the pivoting shell member 27 moves along a circular arc into engagement with the fixed shell member 25.

Figure 20:
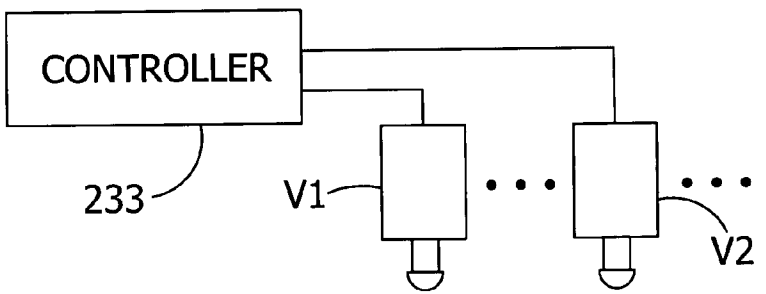
FIG. 20 is a simplified electrical schematic of the flow control apparatus.
Figure 21:
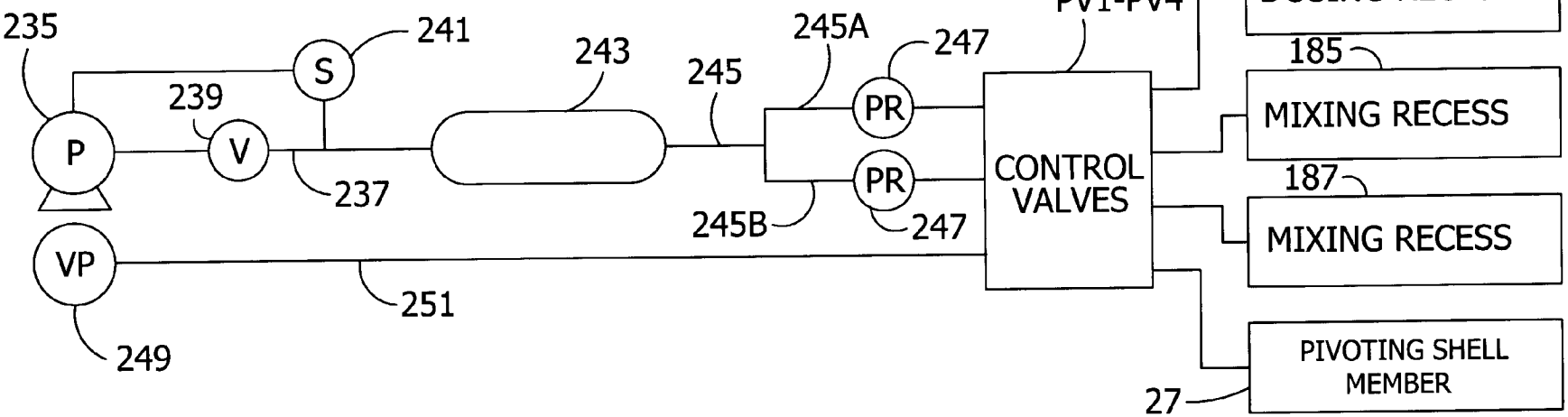
FIG. 21 is a simplified pneumatic circuit of the flow control apparatus.

Before describing another embodiment, the general operation of the first embodiment will be described. Referring first to FIG. 20, a controller 233 (e.g., a programmable logic controller) is connected to the solenoid valves V1–V8 (only two of which are illustrated) to activate and deactivate the valves according to a preset program of operation. The controller 233 is also connected to the control valves PV1–PV4 (not shown in FIG. 21). The control valves PV1–PV4 could be controlled by a separate controller (not shown) without departing from the scope of the present invention. The pneumatic system of the flow control apparatus 7 includes a pump 235 for providing suitable fluid pressures above atmospheric. A line 237 from the pump 235 extends through a control valve 239 and past a pressure sensor 241 to a tank 243. Another line 245 extending from the tank 243 breaks into two branches (245A, 245B), each having its own pressure regulator 247. The branches 245A, 245B are then connected to the control valves PV1–PV4 as previously stated. A vacuum pump 249 is also connected to the control valves PV1–PV4 by a line 251. In one example, the pump 235 is operated to maintain the pressure in the tank 243 at about 50 psi. When the pressure sensor 241 detects that the pressure has reached 50 psi or above, it shuts down the pump and/or shuts off the valve 239. The upper pressure regulator 247 in the schematic can be operated to control the pressure in the branch 245A to about 40 psi and the lower pressure regulator can be operated to control the pressure in the branch 245B to about 10 psi. The vacuum supplied to the control valve PV1–PV4 by the vacuum pump 249 may be at about −7 psi, as stated previously. The 40 psi pressure is used to drive the control valves PV1–PV4 to change between the application of positive pressure to the recesses 185, 187, 189, 191 in the fixed shell member 25 and the application of vacuum pressure. In this embodiment, a constant vacuum pressure is applied to the parts of the cells 65, 69, 73, 77 formed by the second sheet 57 of the flexible bag 9. These parts of the cells 65, 69, 73, 77 are received in respective ones of the recesses 215, 217, 211, 213 in the pivoting shell member 27.

Orange juice concentrate may be packaged in the flexible bag 9 at one location under aseptic conditions (or sterilized after packaging) and shipped with other flexible bags to another location (e.g., a restaurant or cafeteria) where the drink dispenser 1 is located. It will be readily appreciated that one flexible bag 9 may be replaced with another by opening the pivoting shell member 27 (FIG. 4), lifting the one bag off of the pins 49 and hanging a new bag on the pins. The new flexible bag 9 is guided between the V-blocks 31, and the notches 89 in the vertical sides of the bag are placed in registration with the V-blocks. The pivoting shell member 27 is swung up to the closed position and the latch bolts 35 lock in the receptacles 33. The reservoir cell 61 is located above the fixed and pivoting shell members 25, 27. The concentrate dosing cell 65, the water dosing cell 69 and the mixing cells 73, 77 are received in the recesses 189/215, 191/217, 185/211, 187/213 of the fixed and pivoting shell members 25, 27. A water line is attached to the quick release connector 209 on the outer face of the pivoting shell member 27 and an output line 253 (FIG. 2) is connected to the outlet tube 109 extending down from the manifold 95. The entire flow control apparatus 7 may then be slid back into the cabinet 3 by collapsing the telescoping sections 19A, 19B, 21A, 21B of the slides 19, 21. Any connections which were removed to allow the flow control apparatus 7 to slide out of the cabinet compartment 5 are restored.

The controller 233 may then automatically operate the cycle so that any air in the mixing cells 73, 77 or dosing cells 65, 69 is eliminated and the flow control apparatus 7 is primed. For example all of the mixing cells 73, 77 and dosing cells 65, 69 may first be collapsed to purge air, which is exhausted through the outlet tube. Both of the dosing cells 65, 69 may be filled with water which is subsequently delivered to the first mixing cell 73. Then the dosing cells 65, 69 refill with water as the water in the mixing cell 73 is discharged through the outlet tube 109. The second mixing cell 77 is filled with water from the dosing cells 65, 69. This time as the second mixing cell 77 is discharging the water through the outlet tube 109, the concentrate dosing cell 65 is filled with orange juice concentrate from the reservoir cell 61, and the water dosing cell 69 is filled with water. The combined volume of the recesses 189 and 215 receiving the dosing cell 65, and the combined volume of the recesses 191 and 217 receiving the water dosing cell 69 in the closed position of the fixed and pivoting shell members is selected so that the appropriate dilution of the orange juice concentrate is achieved. The dosing cells 65, 69 themselves are sized sufficiently large to fill their respective containing volumes. The total combined volume of the recess 189, 215, 191, 217 may be four ounces, and the volume of each pair of recesses 185/211 and 187/213, holding mixing cells 73 and 77, respectively, may be four ounces. To continue with the priming operation, the contents of the dosing cells 65, 69 are pumped to the first mixing cell 73. No agitation of the concentrate and water in the mixing cells 73 or 77 is done. The turbulence of the flow of orange juice concentrate and water when it enters the mixing cells 73, 77 is sufficient for mixture. However, additional agitation could be used, such as by applying positive and vacuum pressure cyclically to the mixing cell 73, 77 while holding the liquids in the mixing cell. The mixing cell 73 discharges the mixture through the outlet tube 109 as the concentrate dosing cell 65 and water dosing cell 69 refill with orange juice and water, respectively. The second mixing cell 77 is then filled with the contents of the dosing cells 65, 69. The dosing cells refill and the flow control apparatus 7 is ready for operation.

Figure 22:
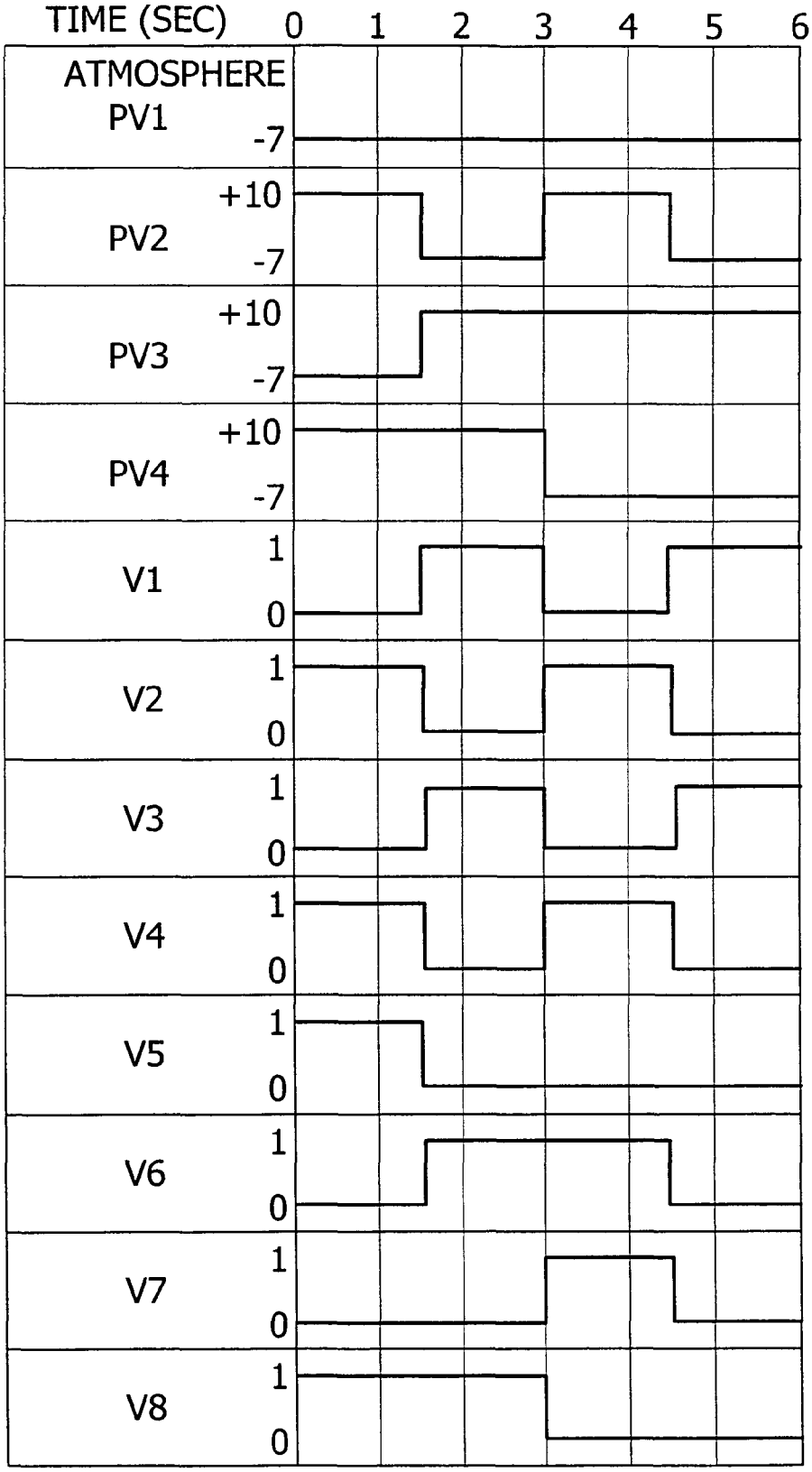
FIG. 22 is a chart illustrating operation of the flow control apparatus in a fixed volume dispensing mode.

Referring now to FIG. 22, a chart indicating operation of the flow control apparatus 7 to dispense a fixed volume of liquid (e.g., eight ounces of orange juice diluted from concentrate) over a single six second cycle is shown. The exact amount of time is an example and may be other than six seconds. The plot for control valve PV1 represents the pressure which is applied to the sides of the mixing cells 73, 77 and dosing cells 65, 69 which are received in the recesses 211, 213, 215, 217 of the pivoting shell member 27. As stated previously, a constant vacuum pressure is applied throughout the cycle so that these halves of the cells 73, 77, 65, 69 are constantly held against the pivoting shell member 27 in their respective recesses 211, 213, 215, 217. Control valve PV1 operates either to apply vacuum pressure (−7 psi) to the recesses 211, 213, 215, 217 of the pivoting shell member 27 or to vent the recesses to atmosphere. The plot for control valve PV2 illustrates the application of pressure to the recesses 189, 191 of the fixed shell member 25 receiving the concentrate dosing cell 65 and the water dosing cell 69, respectively. It will be readily appreciated that these cells 65, 69 are always expanded and collapsed at the same time in operation of the flow control apparatus 7. The plots for control valves PV3 and PV4 represent the expansion and collapse of the mixing cells 73, 77, as controlled by those control valves. A line at "+10 psi" indicates positive pressure is applied (i.e., the cell is collapsed) and a line a "−7 psi" indicates that a vacuum is applied (i.e., the cell is expanded). The exact pressures shown are illustrative and not limiting. For each of the solenoid valves V1–V8, a horizontal line at "1" means that the valve is open, allowing liquid to flow past the valve seat 123, and a line at "0" means the valve is closed, blocking flow of liquid past the valve seat. The condition of the mixing cells 73, 77 and dosing cells 65, 69 and the positions of the solenoid valves V1–V8 at any given instant can be seen by reading down along a vertical line in the chart.

Operation begins by pressing the button 17 on the exterior of the drink dispenser 1 (FIG. 1) and the controller 233 (FIG. 20) initiates operation of the cycle. Positive pressure is applied through the control valve PV4 and the mixing cell 77 is urged to collapse. Valve V8 is open and valve V7 is closed so that the mixture which was previously delivered to the mixing cell 77 during the purge and prime operation described above, is discharged to the cup C (FIG. 1). At the same time, positive pressure is applied through the control valve PV2 to the dosing cells 65, 69 discharging the contents of both cells (filled in the purge and prime operation) into the manifold passage 117 through their respective tubes 101, 103. Valve V1 is closed so no additional water passes into the manifold 95 and there is no backflow into the water system. Valves V2, V4 and V5 are open, while valves V6 and V7 are closed and the mixing cell 73 is expanded by operation of PV3 so that the contents of the dosing cells 65, 69 are received in the mixing cell. V3 is closed, shutting off the reservoir cell 61 from the manifold 95. This condition is maintained for about 1.5 seconds.

It is now time for the mixing cell 73 to discharge and the dosing cells 65, 69 to refill with orange juice concentrate from the reservoir cell 61 and water from the water inlet 115, respectively. Thus, positive pressure is applied through control valve PV3 to the mixing cell, valve V6 is opened and valve V5 is closed so that the orange juice mix is discharged through the outlet tube 109. Positive pressure remains on the mixing cell 77 and valve V8 remains open to discharge any remaining liquid from the mixing cell. Vacuum pressure is applied via PV2 to expand the dosing cells 65, 69. Valves V1 to the water line and V3 to the reservoir cell 61 are opened, while valves V4 and V2 are closed so that the concentrate dosing cell 65 is filled with concentrated orange juice from the reservoir cell and the water dosing cell 69 is filled with water.

In the next 1.5 second period, pressure is again applied through PV2 to the dosing cells 65, 69 and valves V2, V4 and V7 are open, while V5 and V8 are closed so that the water and orange juice concentrate are delivered through the top branch 117A of the passage to mixing cell 77 on which a vacuum pressure is applied by PV4. Positive pressure continues to be applied through PV3 to the mixing cell 73 and valve V6 remains open so that remaining contents of the mixing cell can be discharged. In the last 1.5 second period, the dosing cells 65, 69 are refilled. Vacuum pressure is applied to the dosing cells 65, 69 by PV2 and valves V1 and V3 are opened. The full eight ounces was previously discharged in the last period, so vacuum pressure is maintained on the mixing cell 77 by control valve PV4. The flow control apparatus 7 is then prepared to repeat the cycle the next time this button 17 is pressed.

Figure 23:
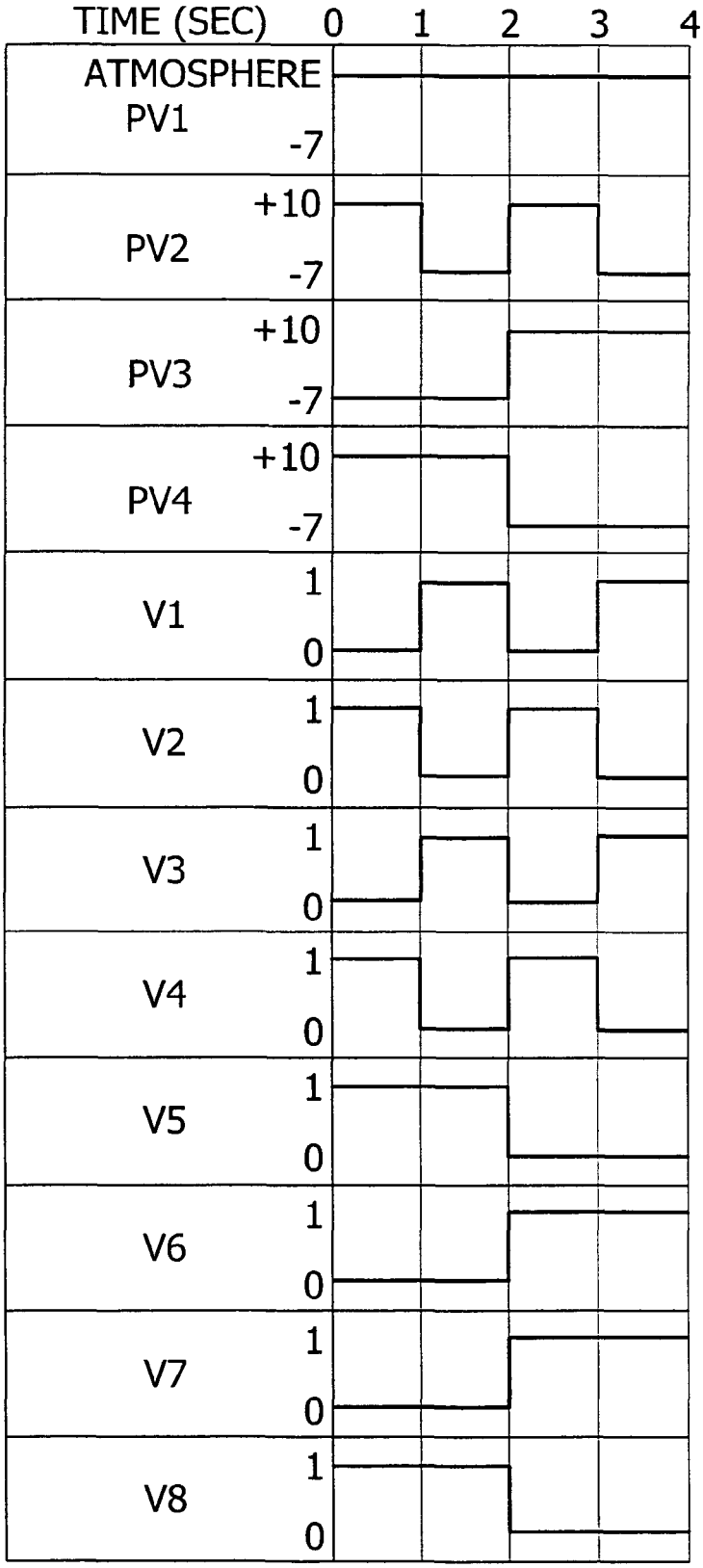
FIG. 23 is a chart illustrating operation of the flow control apparatus in a continuous flow dispensing mode.

Continuous flow operation of the flow control apparatus 7 is illustrated by the chart in FIG. 23, and follows the same initial purge and prime operation described. The operation is illustrated as a four second repeating cycle. The dosing cells 65, 69 empty and fill every two seconds, while the mixing cells 73, 77 fill for two seconds and dispense for two seconds. Reference is made to FIG. 23 for the details as to which solenoid valves V1–V8 are open or closed. It is noted that the recesses 211, 213, 215, 217 of the pivoting shell member 27 are maintained at ambient pressure in this example. The flow control apparatus 7 operates to dispense orange juice continuously so long as the button 17 continues to be depressed.

Figure 24:
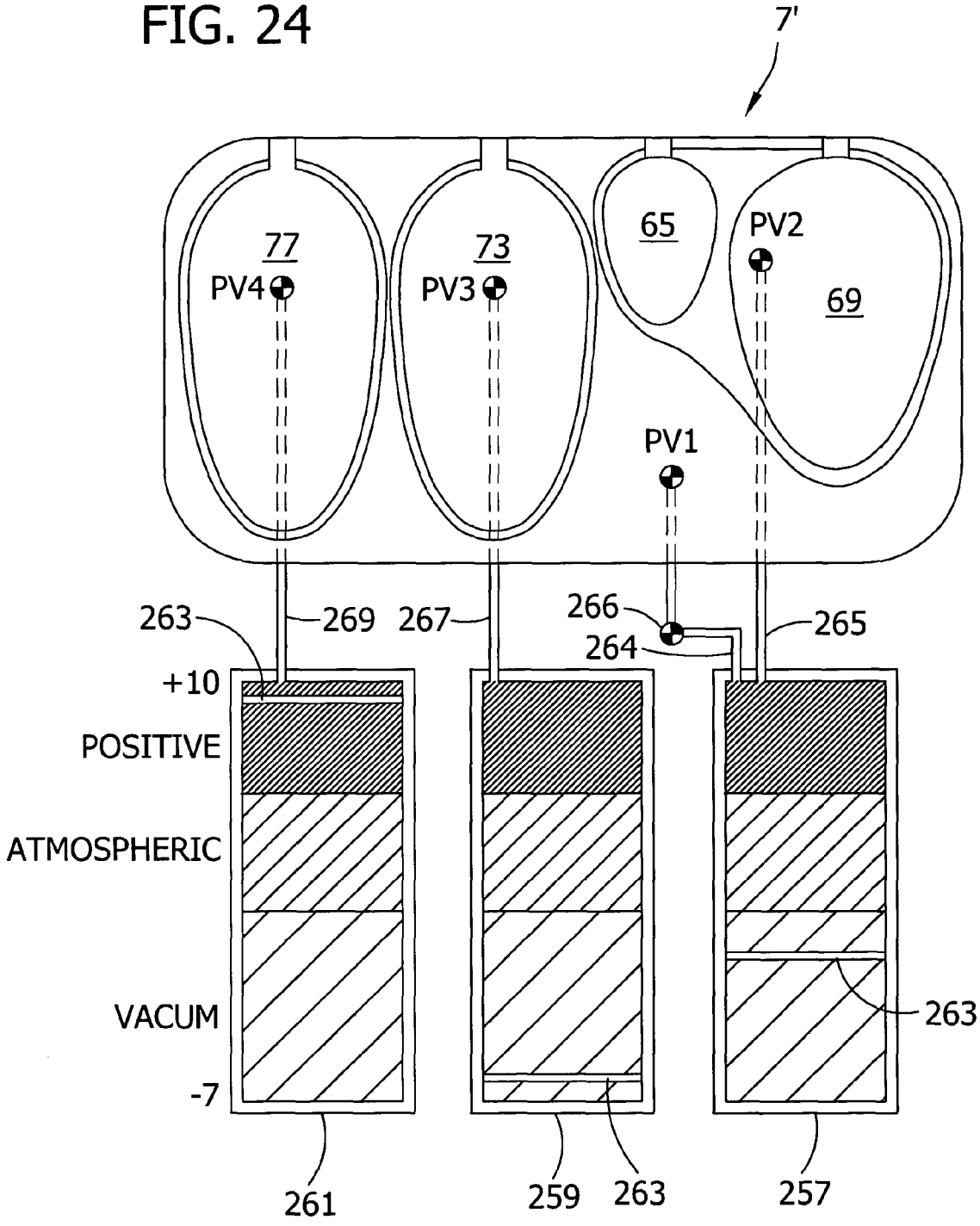
FIG. 24 is a schematic illustration of a pneumatic circuit of a flow apparatus of a second embodiment including double acting cylinders.

A portion of a flow control apparatus 7' of a second embodiment is schematically illustrated in FIG. 24. The construction of the flow control apparatus may be essentially identical to the flow control apparatus 7 of the first embodiment except that the pump 235 and control valves PV1–PV4 of the first embodiment are replaced with three cylinders, designated 257, 259 and 261, respectively. The cylinders 257, 259, 261 (and the cylinders of the various versions of the second embodiment) have the advantage of being able to fit in a very small volume and to operate silently. The cylinders 257, 259, 261 are connected in a closed pneumatic loop with a volume acted on by the cylinders. Moreover, the cylinders 257, 259, 261 provide substantially instant operation (i.e., instant application of vacuum and positive pressure) without the provision of a holding or accumulator tank (e.g., tank 243 shown in FIG. 21). Each of the cylinders 257, 259, 261 has a piston head 263 movable lengthwise of the cylinder. Pressure/vacuum lines 265, 267, 269 extend from each cylinder 257, 259, 261 to the fixed shell member 25 and acts on a respective one of the mixing cells 73, 77, or on both of the dosing cells 65, 69.

The cylinders 257, 259, 261 are each an essentially closed pneumatic system. Movement of the piston head 263 toward the discharge end of the cylinder 257, 259, 261 applies a pressure to the cell 65, 69, 73, 77 to collapse the cell, and movement of the head toward the opposite end applies a vacuum pressure to expand the cell. Regions within the cylinders where positive, atmospheric and vacuum pressures are applied have been delineated in the drawing. The same lines or cross-hatching is used in FIGS. 25–28 to show whether positive, atmospheric or vacuum pressure is being applied at a given location of a piston head. Preferably in when the piston head 263 is in the atmospheric region, there is an automatically opening valve (not shown) which vents the cylinder 257, 259, 261 to atmosphere to keep the position of the head at which a particular pressure is applied from drifting.

Figure 25:
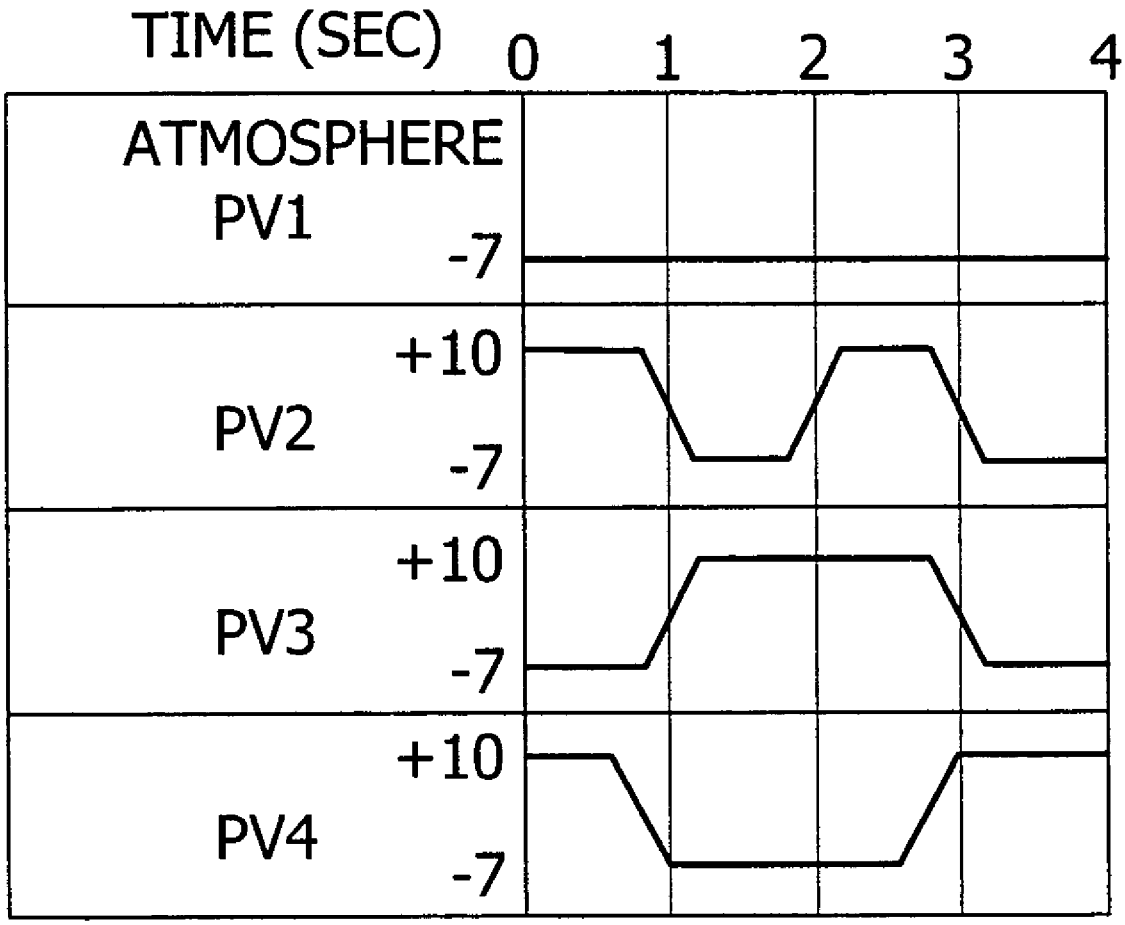
FIG. 25 is a chart illustrating operation of the flow control apparatus of the second embodiment.

A cycle of operation of the pneumatic part of the operation of the flow control apparatus is illustrated in FIG. 25. The operation is not materially different from the continuous flow operation of the first embodiment. However, because the cylinders 257, 259, 261 are used, the changeover from positive to vacuum pressure (and vice versa) is not substantially instantaneous. Accordingly the pressure changes along a steep, but discernable slope from one pressure to the other and back. Moreover, a constant vacuum pressure is applied to the pivoting shell member 27 (and thence to the recesses 211, 213, 215, 217) through control valve PV1 by a line 264 (see FIG. 24) connecting PV1 to one or more of the cylinders 257, 259, 261 (illustrated as cylinder 257 in the drawing). The line 264 contains a check valve 266 which allows a vacuum to be drawn in the pivoting shell member 27 when a vacuum is drawn in the corresponding cylinder(s), but does not allow positive air pressure to enter. Ideally, once an initial vacuum is drawn on the pivoting shell member it would hold without further action by the cylinder 257. However, if needed this cylinder 257 can restore any loss of vacuum.

Figure 26:
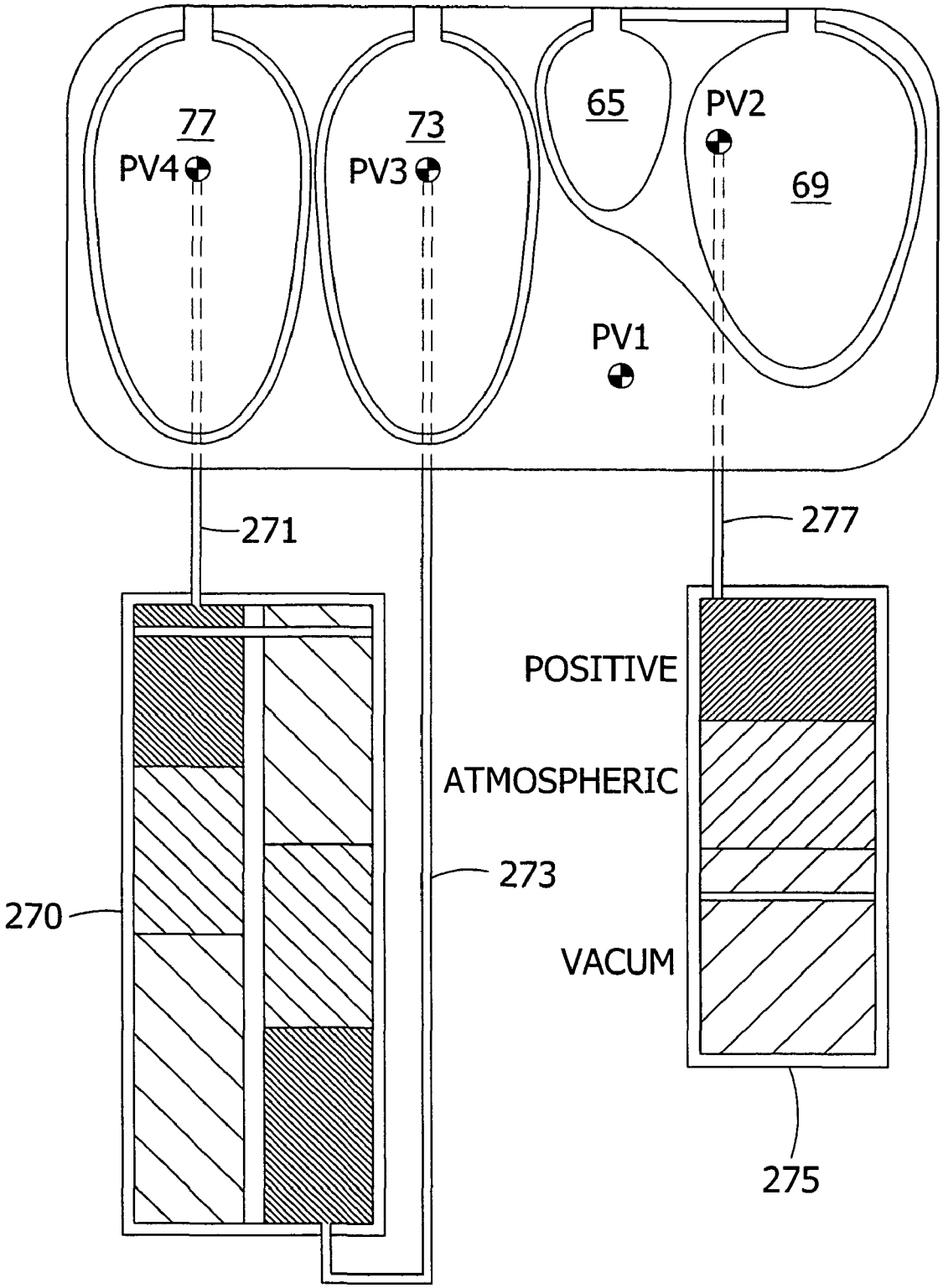
FIG. 26 is another version of the flow control apparatus of the second embodiment.

A second version of the flow control apparatus 7' of the second embodiment is schematically shown in FIG. 26. The construction is nearly the same as the first version, but the mixing cells 73, 77 are now operated by one double acting cylinder 270. The line and check valve for applying vacuum pressure to the pivoting shell member 27 are not illustrated in FIG. 26. As may be seen, pressure lines, designated 271, 273 extend from both ends of the cylinder 270. The cylinder is again a closed pneumatic system. Thus, as a piston head 272 moves toward one end of the cylinder 270, pressure is applied through one line 271, while vacuum is applied through the other line 273. Because the mixing cells 73, 77 are operated in precisely the opposite manner at all times, such an arrangement is possible and provides even more compactness and efficiency of construction and operation. Another cylinder 275 connected by line 277 operates to expand and compress dosing cells 65, 69.

Figure 27:
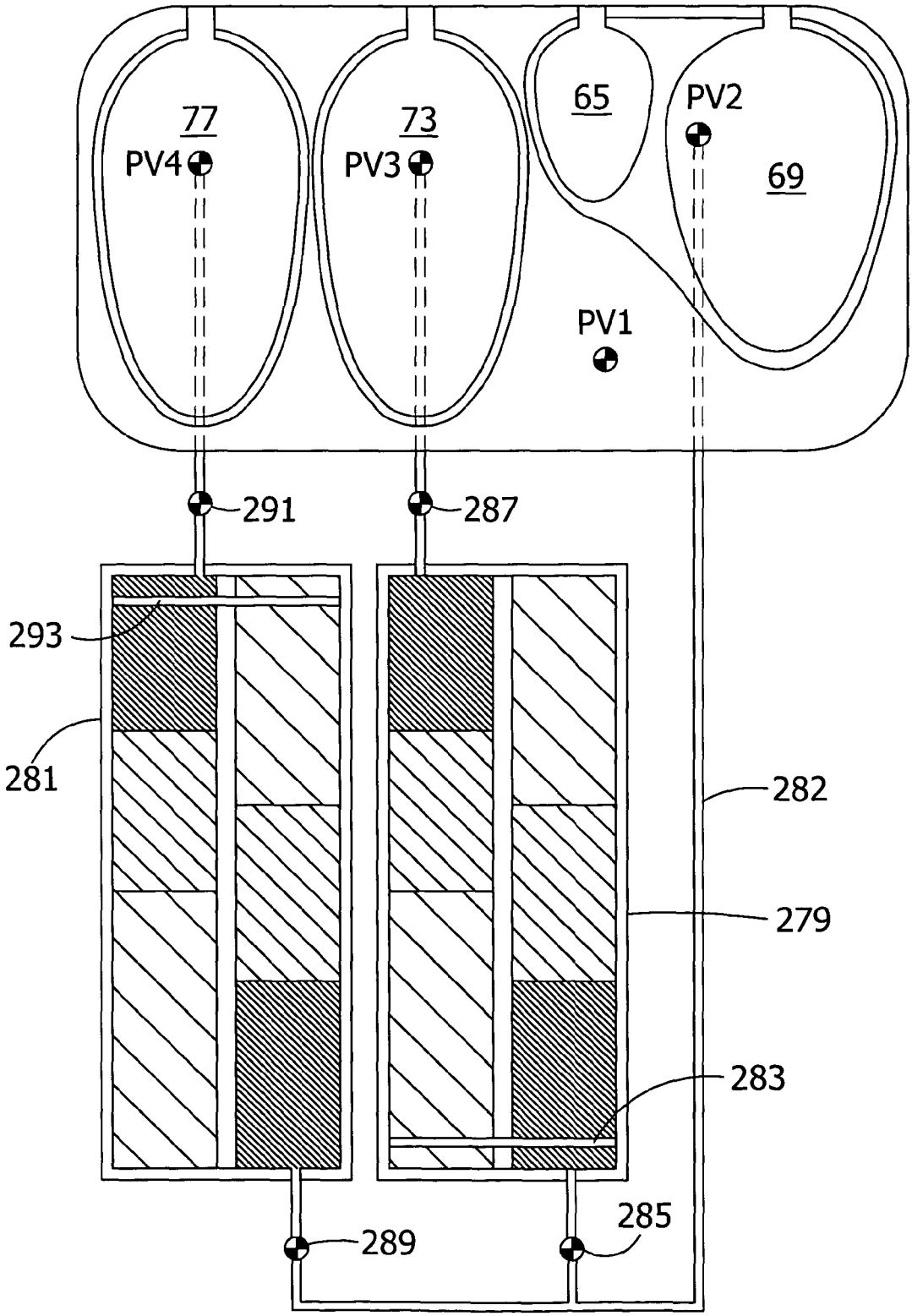
FIG. 27 is still another version of the flow control apparatus of the second embodiment.

A third version of the flow control apparatus of the second embodiment 7' is schematically shown in FIG. 27. In this version, the dedicated cylinder for the dosing cells 65, 69 is eliminated. However, additional control valves are required because the dosing cells 65, 69 must cycle (fill/discharge) twice as fast as the mixing cells 73, 77. The drawing shows the third version in an initial part of the cycle where a right-hand cylinder 279 is used (by opening the appropriate valves) to apply pressure to the dosing cells 65, 69 and vacuum to the mixing cell 73. The other cylinder 281 applies positive pressure to the mixing cell 77 for dispensing its contents. A line 282 to the dosing cells 65, 69 can remain in communication with the same cylinder 279 as its piston head 283 shifts to place positive pressure on the mixing cell 73 and vacuum pressure on the dosing cells 65, 69 to discharge to the contents of the mixing cell 73 and refill the dosing cells. Piston head 293 moves to apply a vacuum to the mixing cell 77. Lines are drawn in the cylinders 279, 281 to indicate whether a positive or vacuum pressure is being applied at given locations of the piston heads 283, 293. The pressures are different for each line attached to each cylinder. Thus, two sets of lines are shown in each cylinder (279, 281). The cylinders 279, 281 are not internally divided into different regions.

The dosing cells 65, 69 will discharge again while the mixing cell 73 is still dispensing. In order to discharge liquid from the dosing cells 65, 69, a valve 285 to the cylinder 279 is closed, as is a valve 287 to the mixing cell 73. A valve 289 to the other cylinder 281 is opened, allowing positive pressure to flow to compress the dosing cells 65, 69 and discharge their contents to the mixing cell 77. A valve 291 from the cylinder 281 to the mixing cell 77 is then opened and the piston head 293 is moved to discharge the contents of the mixing cell 77. The cylinder 281 simultaneously applies a vacuum to the dosing cells 65, 69 for refilling. Switches or sensors (not shown) may be provided along each of the cylinders 279, 281 to detect the position of the piston heads 283, 293 for operating the valves 285, 287, 289, 291. For example, two sets of such switches or sensors could be provided, one set for detecting the piston head on (283, 293) the down stroke and one set for the return stroke. The valves 285, 287, 289, 291 could also be operated mechanically by a cam or through signals from an encoder monitoring rotation of a motor shaft. The line and check valve for applying vacuum pressure to the pivoting shell member 27 is not illustrated in FIG. 27.

Figure 28:
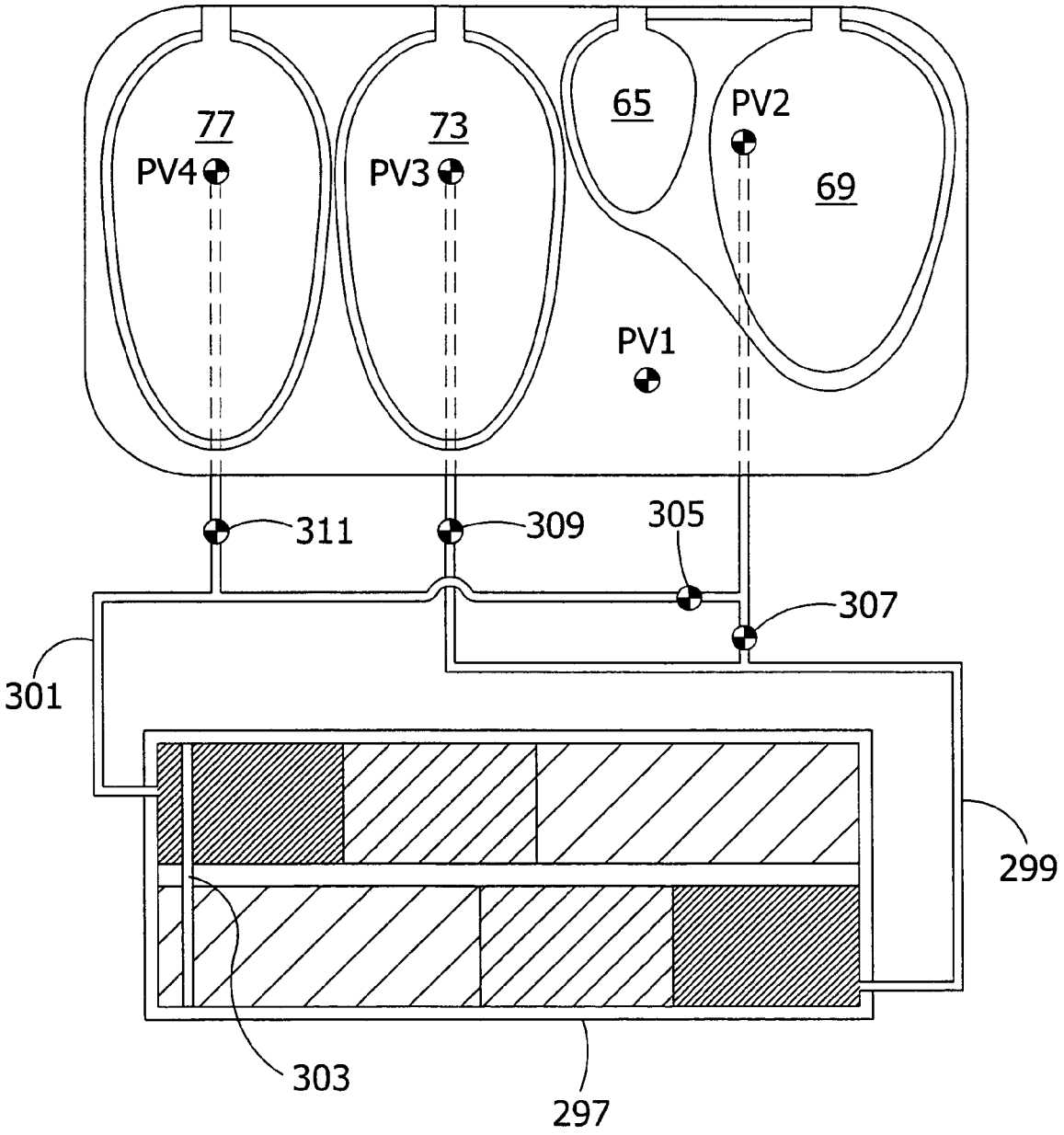
FIG. 28 is a further version of the flow control apparatus of the second embodiment.

A fourth version of the flow control apparatus of the second embodiment 7' is schematically shown in FIG. 28 to comprise a single cylinder 297 and control valves to operate each mixing cell 73, 77 and the dosing cells 65, 69. Lines are drawn within the cylinder 297 to illustrate the different pressures applied to two fluid lines (designated 299, 301, respectively) extending from opposite ends of the cylinder as a function of the position a piston head 303. The cylinder 297 is not structurally bifurcated into two chambers. In the initial position illustrated in FIG. 28, a valve 305 is open to place the line 301 in communication with the location of the dosing cells 65, 69 to collapse them, while a valve 307 to the other line 299 from the cylinder 297 is shut. The piston head 303 will then move to the right to apply positive pressure to the mixing cell 73. The valve 307 to the line 299 with the positive pressure will be closed and the valve 305 to the line 301 now experiencing vacuum pressure will be opened to refill the dosing cells 65, 69. Next the dosing cells must be discharged while neither of the mixing cells 73, 77 changes state. Thus, a valve 309 to the mixing cell 73 and the valve 305 to the line from the dosing cells 65, 69 are closed. A valve 311 to the mixing cell 77 is also closed, but the valve 307 from the dosing cells 65, 69 to the line 299 is open, so that positive pressure is delivered to the dosing cells. The piston head 303 will then move back to the left in the cylinder 297. The valves 309, 311 to the mixing cells 73, 77 are opened again as this movement occurs. The cycle of operation is then repeated. The cycle of the piston head 303 is about four seconds, with two strokes (one down, one back) making up a cycle. Switches or sensors (not shown) may be provided along the cylinder 297 to detect the position of the piston head 303 for operating the valves 305, 307, 309, 311. For example, two sets of such switches or sensors could be provided, one set for detecting the piston head 303 on the down stroke and one set for the return stroke. The valves 305, 307, 309, 311 could also be operated mechanically by a cam or through signals from an encoder monitoring rotation of a motor shaft. The line and check valve for applying vacuum pressure to the pivoting shell member 27 is not illustrated in FIG. 28.

Figure 33:
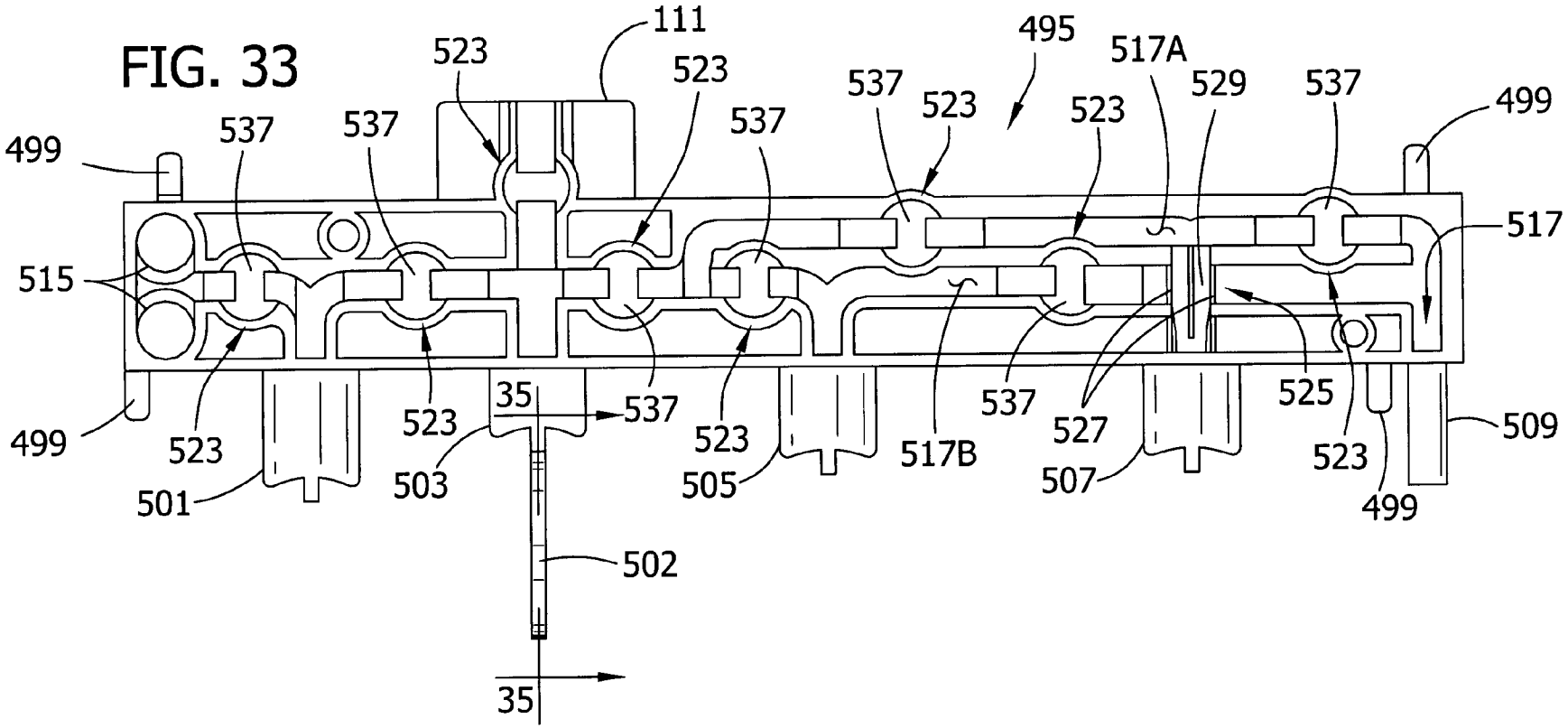
FIG. 33 is a plan view of another version of a manifold having a volume control feature.
Figure 34:
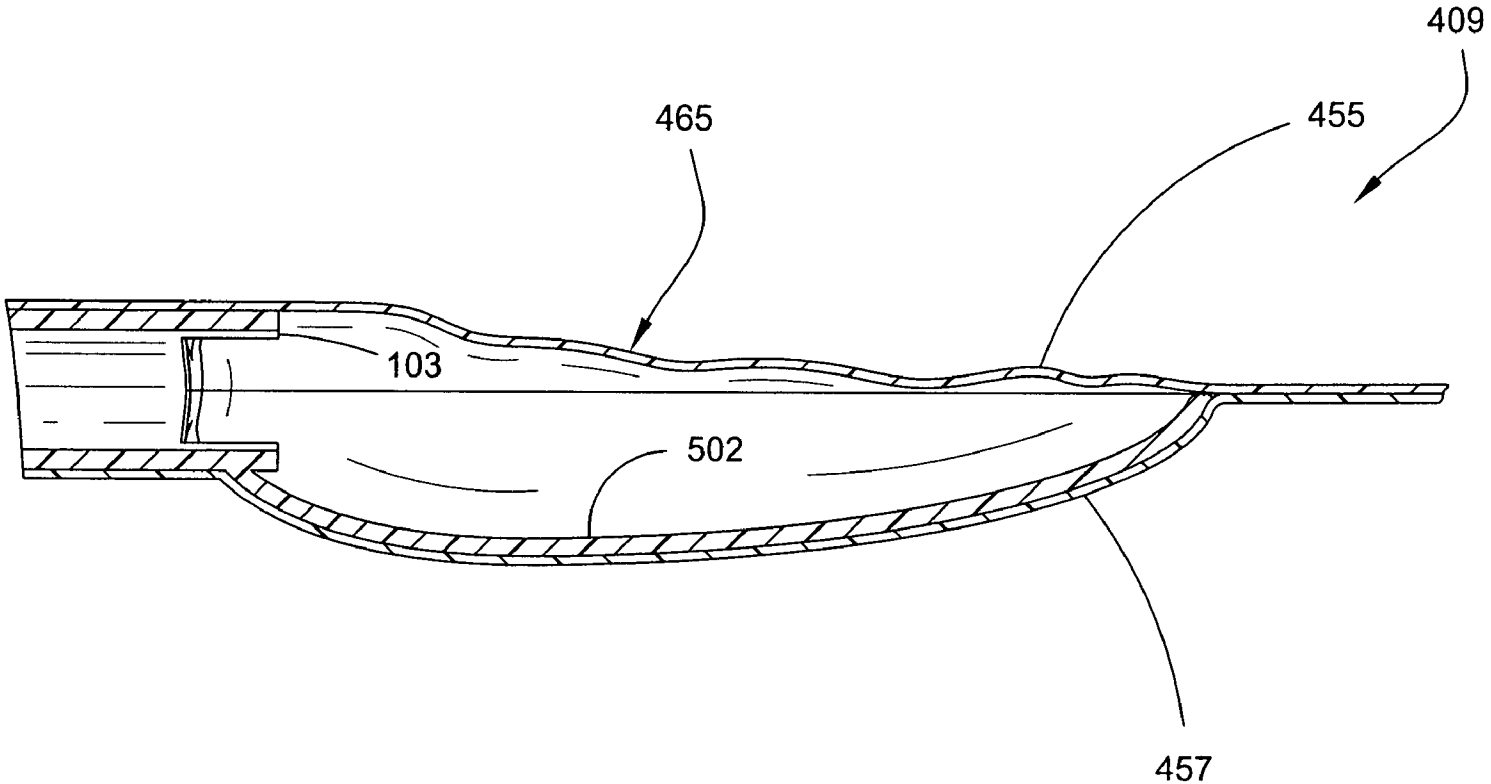
FIG. 34 is a fragmentary cross section of the manifold of FIG. 33 as incorporated in a flexible bag.
Figure 35:
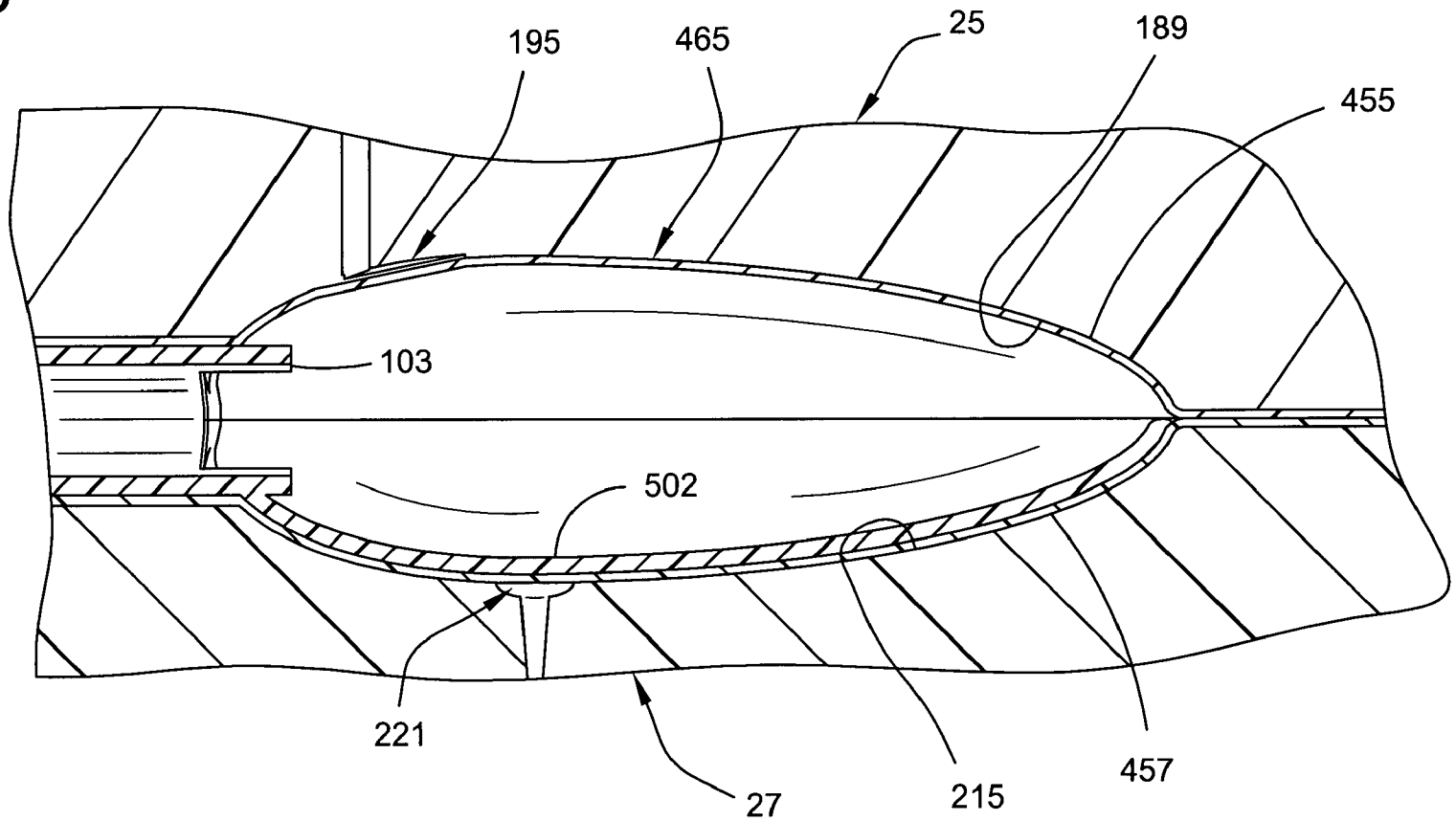
FIG. 35 is the fragmentary section of FIG. 34 showing the bag as received in a flow control apparatus of the present invention.

Referring now to FIGS. 33–35, a flexible bag 409 for use in the flow control apparatus 7 of the drink dispenser 1 of FIGS. 1–4 provides a different ratio of concentrate to diluent without modification of the flow control apparatus. The reference numbers for the flexible bag 409 correspond to those of the flexible bag 9, plus "400". Not all corresponding reference numbers will be called out in this text for parts of identically the same construction as for the flexible bag 9. Different drinks will require different dilution ratios with water to be acceptable for drinking. For example, orange juice concentrate might be diluted in a ratio of 4:1 diluent to concentrate whereas cranberry juice might be diluted in a ratio of 12:1. The flexible bag 409 may be used with the same flow control apparatus 7 to achieve a different (higher) dilution than the flexible bag 9.

In that regard, the manifold 495 is formed with a curved tongue 502 extending outwardly from the concentrate dosing cell tube 503. The tongue 502 is disposed within the cell 465 of the flexible bag 409 and is shaped and arranged to conform to the shape of the recess 215 in the pivoting shell member 27. The volume of the tongue 502 is selected to reduce the volume of the cell 465, while the exterior size and shape of the cell remains the same in conformance with the recesses 189, 215 of the shell members 25, 27 which receive the concentrate dosing cell 465. The concentrate dosing cell as received in the recesses 189, 215 is shown in FIG. 35. The operation of the flow control 7 is unchanged, but when concentrate is drawn into the cell 46, a lesser volume is received because of the volume within the cell occupied by the tongue 502. Accordingly, when the volume of concentrate in the cell 465 is later discharged to one of the mixing cells (not shown, but like cells 73 and 77 of the flexible bag 9), it is diluted to a greater extent before dispensing. It will be appreciated that the volume of the tongue 502 can be selected to achieve the dilution required. Moreover, the tongue 502 may be used for dispensing substances other than beverages, including substances not intended for human consumption (e.g., paint). Thus, by use of the flexible bag 409 with an appropriately sized tongue 502, many different dilution ratios can be achieved by the same dispenser 1 without any alteration of the flow control apparatus 7.

Figure 36:
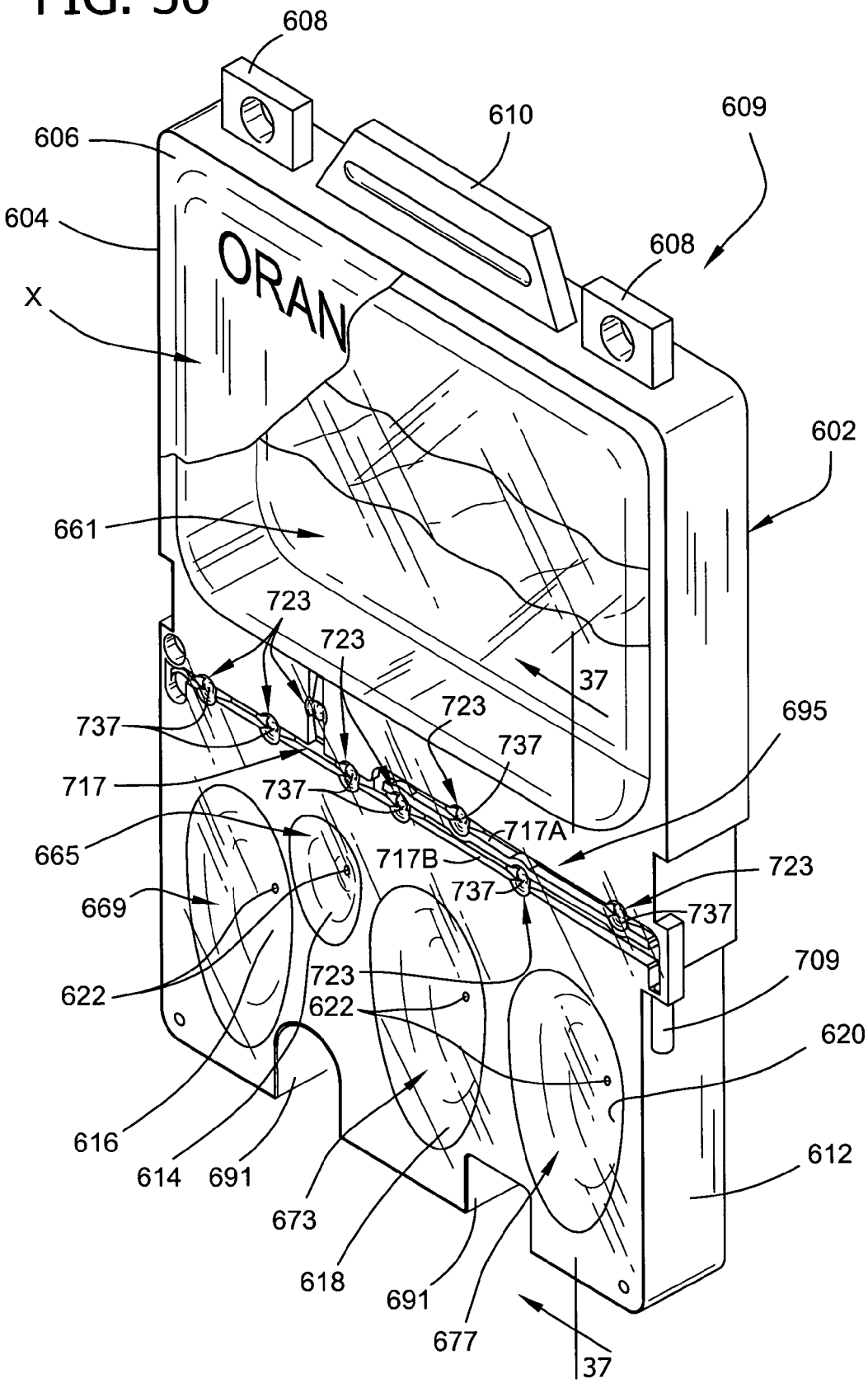
FIG. 36 is a perspective of a flexible container having a frame.
Figure 37:
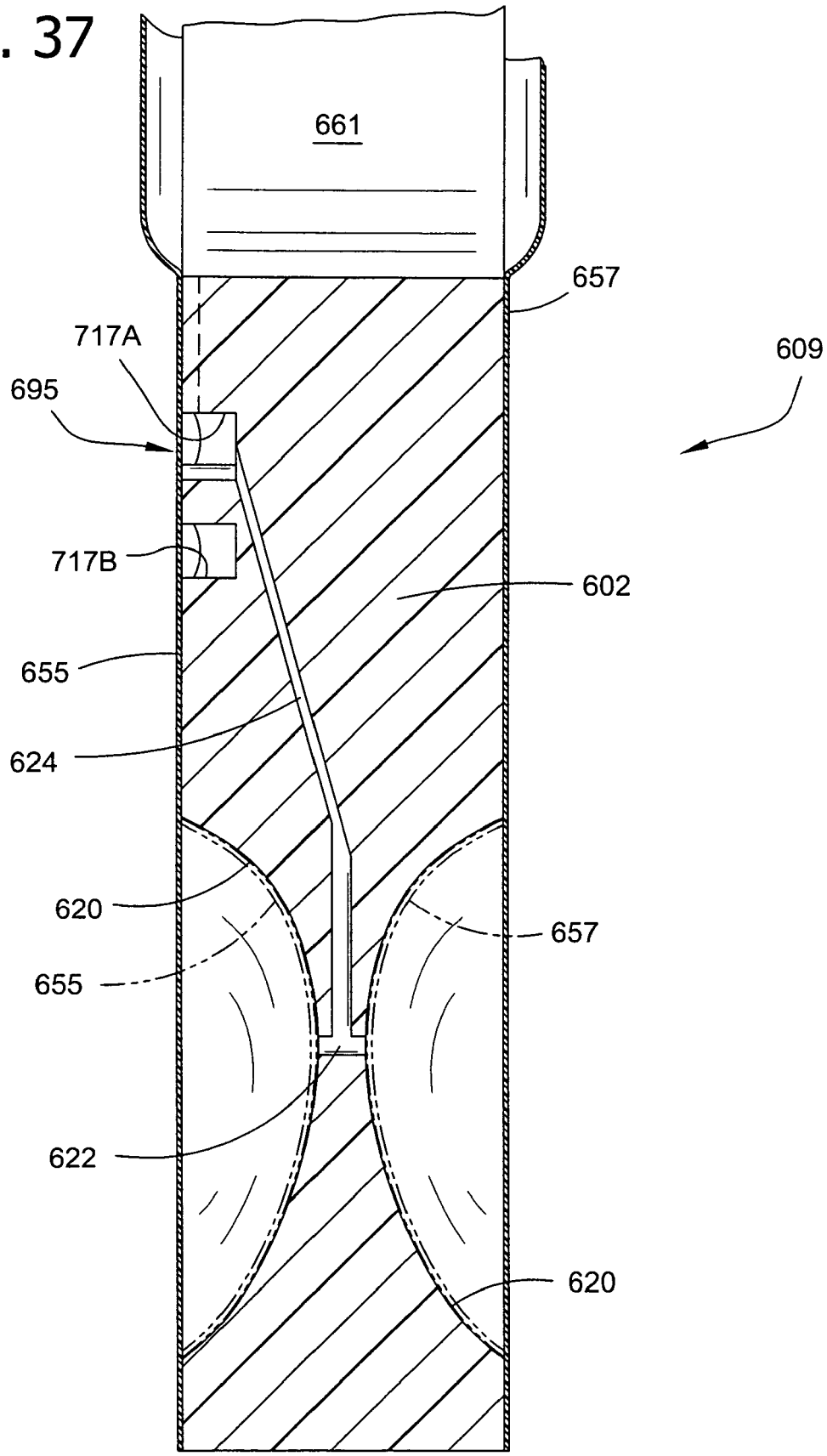
FIG. 37 is a section taken in the plane including line 37—37 of FIG. 36.
Figure 38:
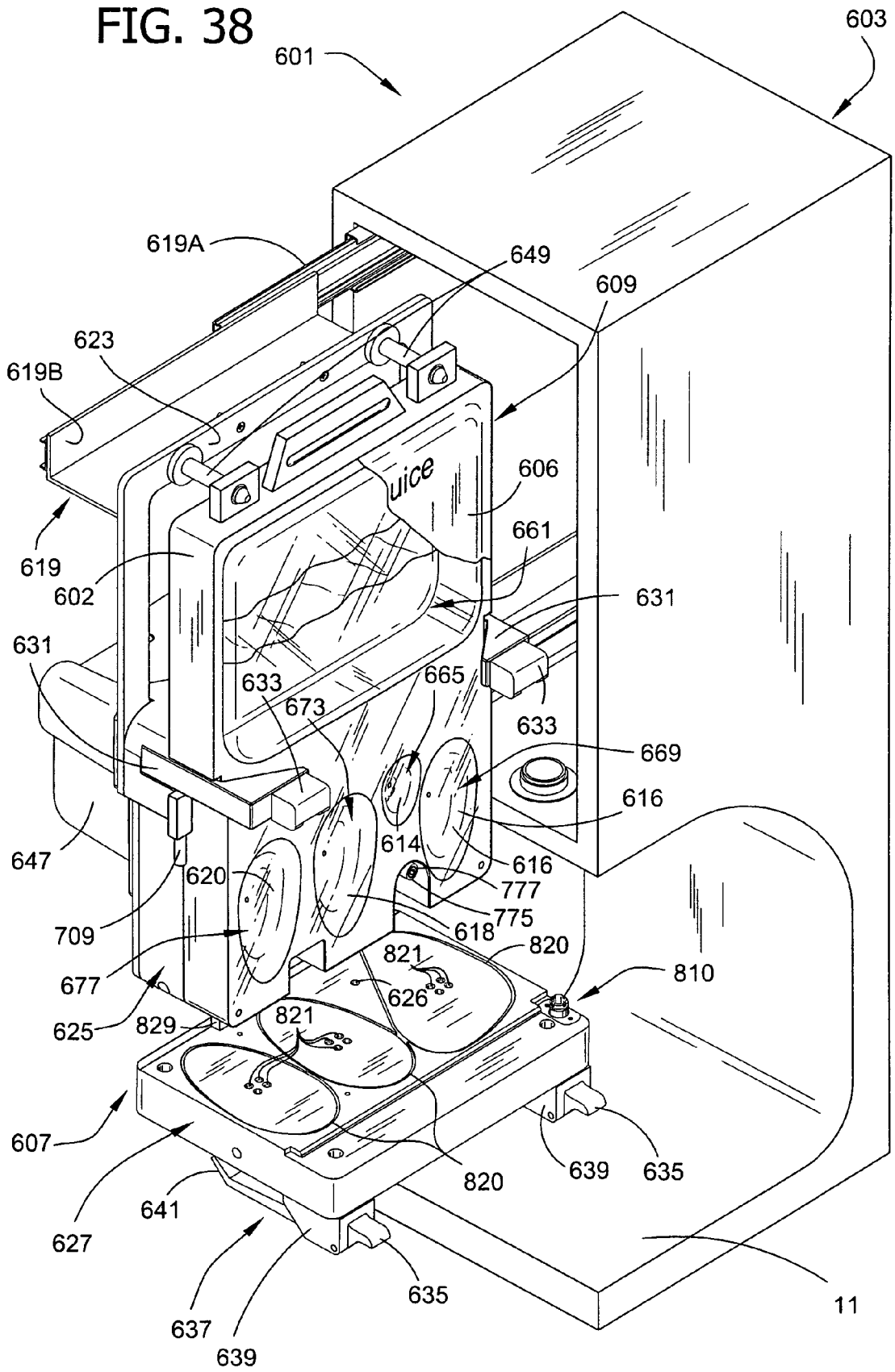
FIG. 38 is a perspective of a drink dispenser capable of using the flexible container of FIG. 36.

Still another version of the flexible bag indicated at 609 in FIGS. 36–38 has a rigid frame 602 which defines not only the manifold 695, but also all of the cells 661, 665, 669, 673, 677 of the flexible bag. The reference numbers for the flexible bag 609 correspond to those of the flexible bag 9, plus "600". Not all corresponding reference numbers will be called out in this text for parts of identically the same construction as for the flexible bag 9. The reservoir cell 661 is defined on its top, bottom and sides by an upper section 604 of the frame 602. The open front and rear of the upper section 604 are covered with flexible sheets 655 and 657 to enclose a space and define the reservoir cell 661. The reservoir cell is illustrated in FIG. 36 as containing concentrated orange juice in liquid form. The frame permits, among other things, the ready mounting of a paper covering 606 (substantially broken away in FIG. 36) over the frame on which images, such as text X are readily imprinted. The material may be other than paper, but may beneficially be a material which facilitates printing more readily than the material of the flexible sheets 655, 657. The frame 602 is integrally formed with mounting tabs 608 and a handle 610 on the top wall of the upper section 604. The mounting tabs 608 are received on pins or other suitable structure of the flow control apparatus 607 (described below) for supporting the flexible bag 609 in the flow control apparatus. The frame 602 will allow the bag 609 to be held in place with a minimum of locating structure.

A manifold 695 is formed in a middle section of the frame 602. The manifold 695 has essentially the same structure as the manifold 95, but appears somewhat different because the various flow passages are formed integrally with the frame 602 do not extend through the full thickness of the frame, although the passages could be formed that way. A lower section 612 of the frame 602 is formed to define a concentrate dosing cell 665, a water dosing cell 669, a first mixing cell 673 and a second mixing cell 677. Unlike the corresponding cells 65, 69, 73, 77, of the flexible bag 9, which were defined entirely by the flexible sheets 55, 57, the cells 665, 669, 671, 677 are formed in substantial part by the frame 602. More specifically, the frame 602 has depressions 614 on opposite sides of the lower section 612 defining a majority of the concentrate dosing cell 665, depressions 616 defining the water dosing cell 669, depressions 618 defining mixing cell 673 and depressions 620 defining mixing cell 677. Only one of the depressions for each cell may be seen in FIG. 36. FIG. 37 illustrates mixing cell 677, which is representative of the construction of all of the cells 665, 669, 671, 677. The depressions 620 open outwardly on opposite sides of the frame 602 and are sealed by the flexible sheets 655 and 657, respectively, which are sealed with the frame around the depressions. Thus, the cell 677 includes both depressions 620 and the portions of the flexible sheets 655, 657 sealed over the depressions.

The depressions 620 are in fluid communication with each other by way of a passage 622 extending between the depressions within the frame 602. The passage 622 is connected to an internal channel 624 leading from the passage to branch 717A of passage 717 in the manifold 695. Thus, the manifold 695 does not have the channel element 125 of the flexible bag 9 because it is not necessary for fluid from the cell 677 to cross the branch 717B to reach branch 717A for the flexible bag 609. It will be appreciated that fluid may enter and exit the depressions from the branch 717A by way of the passage 622 and internal channel 624. To discharge fluid from the cell 677, air pressure is applied to both of the flexible sheets 655, 657, deflecting them to the positions shown in phantom in FIG. 37. The sheets 655, 657 force fluid in the depressions into the passage 622 and internal channel 624, and out into the branch 717A of the manifold 695. Vacuum pressure is applied to the sheets 655, 657 over the depressions 620 to draw them out and facilitate entry of fluid from the branch 717A into the depressions through the internal channel 624 and passage 622. The other cells 665, 667 and 673 are constructed and connected in fluid communication with the passage 717 of the manifold 695 in closely similar ways. The locations of fluid entry into the passage 717 are closely similar to those of the manifold 95, but the entry point (like that of internal channel 624) is from the back side rather than from the bottom side of the manifold. Other configurations of the manifold and fluid connections with the cells may be employed without departing from the scope of the present invention.

A drink dispenser 601 having a flow control apparatus 607 for use with the flexible bag 609 is shown in FIG. 38. Except as described hereinafter, the construction and operation of the dispenser 601 and flow control 607 is substantially identical to the drink dispenser 1 and flow control 7 shown in FIGS. 1–4. Parts of the drink dispenser 601 corresponding to those of drink dispenser 1 will be indicated by the same reference numerals, plus "600". Not all corresponding reference numerals for the drink dispenser 601 will be called out in this text. The flow control 607 is modified to work with the flexible bag 609. Blocks 631 mounting latch bolt receptacles 633 are hingedly attached to fixed shell member 625 so that they may pivot out of the way to allow mounting and dismounting of the flexible bag 609 in the flow control apparatus 607 (i.e., by hanging on pins 649). The opposite side of the flexible bag 609 of FIG. 36 is shown in FIG. 38, so that among other things, the manifold 695 is hidden from view in FIG. 38. Pivoting shell member 627 is pivotally attached to fixed shell member 625 by hinge blocks 829 (only a portion of one of which being shown in the drawings). These blocks 829 are longer than hinge blocks 229 (see FIG. 19) so that the spacing between the fixed and pivoting shell members 625, 627 in the closed position is greater to accommodate the relatively thick frame 602 of the flexible bag 609. In the closed position of the shell members 625, 627, notches 691 in the flexible bag 609 pass the hinge blocks 829 through the flexible bag to the fixed shell member 625 to which they are pivotally connected.

The interior, opposed faces of the fixed and pivoting shell members 625, 627 are generally flat, lacking the recesses (e.g., recesses 185, 187, 189, 191 and 211, 213, 215, 217) of the fixed and pivoting shell members 25, 27 shown in FIGS. 15 and 18. The flexible bag 609 provides the "recesses" in the form of depressions 614, 616, 618, 620 in the frame 602, so it is not necessary for the flexible sheets 655, 657 to expand into either the fixed or pivoting shell members 625, 627. Only the interior face of the pivoting shell member 627 is shown in FIG. 38, but it will be understood that the interior face of the fixed shell member 625 is similarly configured. Grooves containing O-rings 820 are provided on the interior face of the pivoting shell member 627 to fluidically isolate the regions surrounding the mixing cells 673 and 677, and the region surrounding both the concentrate dosing cell 665 and the water dosing cell 669 for independent application of positive and vacuum pressure to these regions. The function of the O-rings 820 is substantially the same as for the O-rings 220 of the flow control apparatus 7. O-rings (not shown) on the face of the fixed shell member 625 establish substantially similar regions on the other side of the flexible bag 609. It will be appreciated that regions directly opposite each other may operate independently of each other, although in the illustrated embodiment, they operate substantially at the same time with the same or similar pressures.

The flow control apparatus 607 operates to apply both vacuum pressure and positive pressure to the sheets 655, 657 of the flexible bag 609 on both sides of the flexible bag. Accordingly, air connections must be made through the flexible bag 609. Because of the frame 602, the flexible bag 609 has a greater thickness than the flexible bag 9. A fitting 775 projects outward from the interior face of the fixed shell member 625 through one of the notches 691 into engagement with the interior face of the pivoting shell member 627 around an opening 626 in the interior face. The distal end of the fitting 775 has an O-ring 777 which engages the interior face of the pivoting shell member 627 in the closed position to seal around the opening 626. The fitting 775 communicates both positive and vacuum pressure to ports 821 on the interior face of the pivoting shell member 627 for acting on the flexible sheet 657. The operation of the flow control apparatus 607 is the same as the flow control apparatus 7.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A flow control apparatus for controlling the flow of a fluent material, the flow control apparatus comprising:

a flexible container comprising, a first flexible sheet;

a second flexible sheet at least partially in opposed relation with the first sheet such that the first and second sheets define at least one cell capable of holding the fluent material;

a manifold located between the first and second sheets for passaging fluent material within the container, the manifold including port structure extending into said cell and defining a port providing fluid communication between the cell and the manifold, the port structure being substantially rigid;

a shell sized and shaped for receiving at least a portion of the flexible container therein;

a fluid pressure system capable of selectively applying positive pressure and vacuum pressure to the flexible container for deforming at least one of the first and second flexible sheets to move fluent material within the container, the port structure of the manifold holding the port open as the fluid pressure system deforms the flexible material.

2. Flow control apparatus as set forth in claim 1 wherein the port structure comprises a tube projecting outwardly from the manifold into the cell.

3. Flow control apparatus as set forth in claim 2 wherein the cell is formed by joining the first and second flexible sheets to each other to define a volume constituting the cell.

4. Flow control apparatus as set forth in claim 2 further comprising a multiplicity of said cells and a tube for each of said cells providing fluid communication with the manifold.

5. A flexible container for delivery of metered quantities of fluent material therefrom, the container comprising:

a first flexible sheet;

a second flexible sheet at least partially in opposed relationship with the first sheet such that the first and second sheets define at least one cell capable of holding the fluent material, the first and second sheets being capable of movement toward and away from one another for use in drawing fluent material into the cell and discharging fluent material from the cell;

a manifold located between the first and second sheets for passaging fluent material within the container, the manifold including port structure extending into said cell and defining a port providing fluid communication between the cell and the manifold, the port structure being substantially rigid for holding the first and second sheets apart and maintaining the port in an open condition.

6. A flexible container as set forth in claim 5 wherein the port structure comprises a tube projecting outwardly from the manifold into the cell.

7. A flexible container as set forth in claim 6 wherein the cell is formed by joining the first and second flexible sheets to each other.

8. A flexible container as set forth in claim 6 further comprising a multiplicity of said cells and a tube for each of said cells providing fluid communication with the manifold.

9. A flexible container as set forth in claim 8 wherein each of said tubes is sealingly joined to the first and second flexible sheets to block flow into or out of the cells except through the tube.

10. A flexible container as set forth in claim 9 wherein the tubes are formed with radially outwardly tapering surfaces to which the flexible sheets are joined for a smooth sealing connection of the flexible sheets to the tube.

11. A flow control apparatus for controlling the flow of a fluent material containing particulate matter having a known maximum length from a flexible container by acting on the container, the flow control apparatus comprising:

a shell sized and shaped for receiving at least a portion of the flexible container therein;

a valve disposed for movement relative to the shell between an open position in which fluent material may flow within the flexible container in a direction past the location of the valve and a closed position in which fluent material is blocked from flowing within the flexible container past the location of the valve, the valve including a compliant tip adapted to resiliently deform for at least partially enveloping and sealing around particulate matter in the fluent material to inhibit leaking of fluent material past the valve, the compliant tip of the valve engaging the container in the closed position to stop the flow of fluent material, the compliant tip having a sealing surface arranged for engaging the flexible container, the sealing surface having a dimension in the direction of flow which is greater than the maximum length of the particulate matter.

12. Flow control apparatus as set forth in claim 11 wherein the valve includes a plurality of compliant tips having different surface dimensions in the direction of flow of the fluent material past the valve.

13. Flow control apparatus as set forth in claim 12 wherein the surface dimension of each compliant tip is selected according to the size of particulate matter in a particular fluent material to be dispensed.

14. Flow control apparatus as set forth in claim 11 wherein the compliant tip is made of an elastomeric material.

15. Flow control apparatus as set forth in claim 14 wherein the elastomeric material of the compliant tip has a hardness equal to or less than about 55 Shor A.

16. Flow control apparatus as set forth in claim 15 wherein the elastomeric material of the compliant tip has a hardness of less than about 40 Shor A.

17. Flow control apparatus as set forth in claim 16 wherein the elastomeric material of the compliant tip has a hardness of about 25 to 30 Shor A.

18. Flow control apparatus as set forth in claim 17 wherein the elastomeric material is silicone rubber.

19. Flow control apparatus as set forth in claim 11 wherein the valve comprises a valve head having a rigid member mounting the compliant tip thereon.

20. Flow control apparatus as set forth in claim 19 wherein the valve further comprises a driver for selectively driving movement of the valve head between the open and closed positions.

21. Flow control apparatus as set forth in claim 20 wherein the flow control apparatus is adapted to apply positive and negative fluid pressures to the flexible container for moving the fluent material therein.

22. Flow control apparatus as set forth in claim 21 further comprising a valve seat having an arcuate recess of a shape complementary to the sealing surface of the compliant tip.

23. Flow control apparatus as set forth in claim 22 in combination with the flexible container, wherein the valve seat constitutes a portion of the flexible container.

24. Flow control apparatus as set forth in claim 23 wherein the flexible container comprises:

a first flexible sheet;

a second flexible sheet at least partially in opposed relationship with the first sheet such that the first and second sheets define a volume capable of holding the fluent material;

a manifold located between the first and second sheets, the manifold including passage elements comprising spaced apart, opposing walls extending between sides of the manifold, at least portions of the manifold at the sides between the opposing walls being open, the manifold defining the valve seat;

the first and second flexible sheets being sealingly attached to the manifold over opposite ones of said open sides of the manifold thereby to define with the walls a passage for the fluent material within the manifold, the first flexible sheet being elastically deformable by the compliant tip into engagement with the valve seat for occluding the passage.

25. Flow control apparatus as set forth in claim 24 wherein the valve seat is formed with ramps on opposite sides of the arcuate recess, the ramps extending from the arcuate recess to a location adjacent the second flexible sheet.

26. Flow control apparatus as set forth in claim 24 where there are plural valve seats in the manifold.

27. Flow control apparatus as set forth in claim 26 in combination with the fluent material.

28. Flow control apparatus as set forth in claim 26 wherein the fluent material comprises a concentrate.

29. Flow control apparatus as set forth in claim 28 wherein the concentrate is a beverage concentrate.

30. Flow control apparatus set forth in claim 24 in combination with a drink dispenser comprising a housing containing the flow control apparatus and an actuator for initiating operation of the flow control apparatus to dispense fluent material.

31. A flow control apparatus for controlling the flow of a fluent material from a flexible container by acting on the container, the flow control apparatus comprising:

a shell sized and shaped for receiving at least a portion of the flexible container therein;

a valve disposed for movement relative to the shell between an open position in which fluent material may flow within the flexible container in a direction past the location of the valve and a closed position in which fluent material is blocked from flowing within the flexible container past the location of the valve, the valve including a valve tip for engaging the flexible container to stop flow of fluent material past the valve tip, the valve tip being elongate and arranged such that the lengthwise extension of the valve tip is generally perpendicular to the flow direction of the fluent material.

32. Flow control apparatus as set forth in claim 31 wherein the valve tip has an elongate, arcuate engagement surface for engaging the flow container.

33. Flow control apparatus as set forth in claim 32 further comprising a valve seat having an arcuate shape conforming to the shape of the engagement surface of the valve tip.

34. Flow control apparatus as set forth in claim 33 in combination with the flexible container, wherein the valve seat constitutes a portion of the flexible container.

35. Flow control apparatus as set forth in claim 34 wherein the flexible container comprises:

a first flexible sheet;

a second flexible sheet at least partially in opposed relationship with the first sheet such that the first and second sheets define a volume capable of holding the fluent material;

a manifold located between the first and second sheets, the manifold including passage elements comprising spaced apart, opposing walls extending between sides of the manifold, at least portions of the manifold at the sides between the opposing walls being open, the manifold defining the valve seat;

the first and second flexible sheets being sealingly attached to the manifold over opposite ones of said open sides of the manifold thereby to define with the walls a passage for the fluent material within the manifold, the first flexible sheet being elastically deformable by the valve tip into engagement with the valve seat for occluding the passage.

36. A flow control apparatus for controlling the flow of a fluent material from a flexible container by acting on the container, the flow control apparatus comprising:

a shell sized and shaped for receiving at least a portion of the flexible container therein such that passages for flow of fluent material are defined in the flexible container;

a valve disposed for movement relative to the shell between an open position in which fluent material may flow within the flexible container in a direction past the location of the valve and a closed position in which fluent material is blocked from flowing within the flexible container past the location of the valve, the valve including a valve tip for engaging the flexible container to stop flow of fluent material past the valve;

a valve seat located generally opposite the valve for the valve tip to act against in the closed position of the valve, the valve seat, valve and shell being arranged such that the direction of flow remains the same through the valve seat.

37. A flow control apparatus as set forth in claim 36 wherein the valve seat has a width at least as great as a width of the passages defined in the container.

38. A flow control apparatus as set forth in claim 37 in combination with the flexible container, wherein the valve seat constitutes a portion of the flexible container.

39. Flow control apparatus as set forth in claim 38 wherein the flexible container comprises:

a first flexible sheet;

a second flexible sheet at least partially in opposed relationship with the first sheet such that the first and second sheets define a volume capable of holding the fluent material;

a manifold located between the first and second sheets, the manifold including passage elements comprising spaced apart, opposing walls extending between sides of the manifold, at least portions of the manifold at the sides between the opposing walls being open, the manifold defining the valve seat;

the first and second flexible sheets being sealingly attached to the manifold over opposite ones of said open sides of the manifold thereby to define with the walls a passage for the fluent material within the manifold, the first flexible sheet being elastically deformable by the valve tip into engagement with the valve seat for occluding the passage.

40. Flow control apparatus as set forth in claim 39 wherein the valve seat is formed with ramps on opposite sides of the arcuate recess, the ramps extending from the arcuate recess to a location adjacent the second flexible sheet.

41. Flow control apparatus as set forth in claim 39 where there are plural valve seats in the manifold.

42. Flow control apparatus as set forth in claim 41 in combination with the fluent material.

43. Flow control apparatus as set forth in claim 42 wherein the fluent material comprises a concentrate.

44. Flow control apparatus as set forth in claim 43 wherein the concentrate is a beverage concentrate.

45. Flow control apparatus set forth in claim 39 in combination with a drink dispenser comprising a housing containing the flow control apparatus and an actuator for initiating operation of the flow control apparatus to dispense fluent material.

46. A flexible container for delivery of metered quantities of fluent material therefrom, the container comprising:

a first flexible sheet;

a second flexible sheet at least partially in opposed relationship with the first sheet such that the first and second sheets define at least one cell having a volume for holding a quantity of the fluent material;

a manifold located between the first and second sheets and defining at least one passage transporting fluent material within the container, the manifold including a port providing fluid communication between the cell and the manifold and at least one valve seat located in the passage arranged for receiving a deformed portion of one of the first and second flexible sheets to close the passage and block flow therethrough.

47. A flexible container as set forth in claim 46 wherein a portion of the valve seat arranged for receiving the deformed portion of the first flexible sheet has a cross sectional area greater than or equal to a cross sectional area of the passage away from the valve seat.

48. A flexible container as set forth in claim 47 wherein the portion of the valve seat arranged for receiving the deformed portion of the first flexible sheet defines an arcuate recess.

49. A flexible container as set forth in claim 48 wherein the valve seat is formed with ramps on opposite sides of the arcuate recess, the ramps extending from the arcuate recess to a location adjacent the second flexible sheet.

50. A flexible container as set forth in claim 46 where there are plural valve seats in the manifold.

51. A flexible container as set forth in claim 50 in combination with the fluent material.

52. A flexible container as set forth in claim 51 wherein the fluent material comprises paint.

53. A flexible container as set forth in claim 51 wherein the fluent material comprises a concentrate.

54. A flexible container as set forth in claim 46 wherein the valve seat and passage are arranged so that the direction of flow of fluent material through the valve seat is substantially constant.

55. A flow control apparatus for controlling flow of a fluent material from a container, the flow control apparatus comprising:

a frame for locating the container;

a dry connect device for communication of a fluent material into the container, the dry connect device being adapted to pierce the container upon engagement therewith for establishing fluid communication with the interior of the container, the dry connect device being automatically shut off when disengaged from the container to prevent flow of fluid out of the dry connect device, and the dry connect device being automatically opened upon piercing engagement with the container to permit flow of fluid out of the dry connect device into the flexible container.

56. Flow control apparatus as set forth in claim 55 wherein the dry connect device comprises a conduit having a sharp leading edge portion for piercing the flexible container.

57. Flow control apparatus as set forth in claim 56 wherein the sharp leading edge portion comprises a plurality of sharp prongs projecting axially outwardly from one end of the conduit.

58. Flow control apparatus as set forth in claim 56 wherein the frame comprises first and second frame elements movable relative to one another between open and closed positions, the second frame element locating the container, the conduit being slidably mounted on the first frame element for movement relative to the frame element between a shut off position and a flow position.

59. Flow control apparatus as set forth in claim 58 wherein the conduit is biased toward the shut off position, the conduit being slidably moved to the flow position upon movement of the first and second frame members to the closed position and returned to the shut off position upon movement of the first and second frame members to the open position.

60. Flow control apparatus as set forth in claim 59 wherein the flow control device further comprises a spring biasing the conduit to the shut off position.

61. Flow control apparatus as set forth in claim 56 wherein the dry connect device is adapted to seal with the flexible container around the conduit.

62. Flow control apparatus as set forth in claim 61 wherein the dry connect device comprises a sealing collar mounted in the first frame member around the conduit and disposed for sealingly engaging the flexible container.

63. Flow control apparatus as set forth in claim 55 in combination with a drink dispenser comprising a housing for the flow control apparatus and an actuator for actuating the flow control apparatus for dispensing fluent material in the form of a beverage.

64. A flexible container for delivery of metered quantities of fluent material therefrom, the container comprising:

a first flexible sheet;

a second flexible sheet at least partially in opposed relationship with the first sheet such that the first and second sheets define at least one cell having a volume for holding a quantity of the fluent material;

a manifold located between the first and second sheets for passaging fluent material within the container, the manifold including a port providing fluid communication between the cell and the manifold; and a volume control disposed in the cell and occupying a portion of the volume to control the volume of fluent material received into the cell.

65. A flexible container as set forth in claim 64 wherein the volume control is attached to the manifold.

66. A flexible container as set forth in claim 65 wherein the volume control is formed as one piece with the manifold.

67. A flexible container as set forth in claim 66 wherein the volume control is curved.

68. A flexible container as set forth in claim 67 wherein the volume control has an elongate shape.

69. A flexible container as set forth in claim 64 in combination with other flexible containers, at least some of said other flexible containers having the same construction as the flexible container and at least some others of other flexible containers having the same construction but being free of any volume control in the cell.

70. A flexible container as set forth in claim 64 in combination with a flow control device comprising a shell including first and second shell members sized and shaped for receiving at least a portion of the flexible container therein, at least one of the shell members having a recess therein for sealingly receiving the cell, the flow control device being adapted for applying selectively variable fluid pressure to the cell for moving the first and second flexible sheets toward and away from each other to collapse and expand the cell.

71. The combination set forth in claim 70 wherein the volume control is received in the recess of said one of the first and second shell members.

72. The combination set forth in claim 71 wherein the volume control and said one shell member have complementary shapes.

73. A drink dispenser comprising the flexible container and flow control apparatus as set forth in claim 70, a housing for the flow control apparatus and an actuator for actuating the flow control apparatus for dispensing fluent material in the form of a beverage.

74. A drink dispenser as set forth in claim 73 in combination with other flexible containers, at least some of said other flexible containers having the same construction as the flexible container and at least some others of other flexible containers having the same construction but being free of any volume control in the cell whereby different volumes of fluent material are received in the cell and discharged from the cell received in the recess depending upon which flexible container is received therein.

75. A method of changing the concentration of a concentrate present in a mixture of fluent material dispensed by a dispenser from a flexible container prefilled with the concentrate, the method comprising the steps of:

installing a first flexible container having a first cell with a first concentrate volume into a flow control apparatus of the dispenser such that the first cell is received in a pressure chamber of the flow control apparatus;

applying a selectively variable fluid pressure to the first cell in the pressure chamber such that the first cell expands to draw concentrate into the first cell and collapses to discharge concentrate from the first cell;

diluting the concentrate discharged from the first cell with a quantity of diluent to a first concentration;

dispensing concentrate in the first concentration;

removing the first flexible container from the flow control apparatus;

installing a second flexible container having a second cell with a second concentrate volume into the flow control apparatus such that the second cell is received in the pressure chamber;

applying a selectively variable fluid pressure to the second cell in the pressure chamber such that the second cell expands to draw concentrate into the second cell and collapses to discharge concentrate from the second cell;

diluting the concentrate discharged from the second cell with the quantity of diluent to a second concentration different from the first concentration;

dispensing concentrate in the second concentration.

76. A method of manufacturing flexible containers prefilled with a fluent concentrate for use in a flow control apparatus capable of acting on the flexible container to dispense fluent material including the concentrate, the method comprising the steps of:

forming a first flexible container by operatively joining first and second sheets of flexible material together in sealing relation such that at least a first cell is defined between the first and second sheets having a first volume capable of receiving concentrate in a first quantity for dilution to a first concentration;

filling at least a portion of the first flexible container with concentrate;

forming a second flexible container by operatively joining third and fourth sheets of flexible material together in sealing relation such that at least a second cell is defined between the third and fourth sheets having the first volume, said step of forming including locating a volume control in the second cell for reducing the volume capable of receiving concentrate so that the second cell receives concentrate in a second quantity for dilution to a second concentration more dilute than the first concentration;

filling at least a portion of the second flexible container with concentrate.

77. A method as set forth in claim 76 wherein said step of forming the first flexible container includes placing a substantially rigid first manifold between the first and second sheets, the first manifold defining passaging therein for flow of the concentrate, and said step of forming the second flexible container includes placing a substantially rigid second manifold between the third and fourth sheets, the second manifold defining passaging therein for flow of the concentrate.

78. A method as set forth in claim 77 wherein the volume control is associated with the second manifold.

79. A method as set forth in claim 78 further comprising the step of forming the second manifold and volume control as one piece.

80. A flexible container for delivery of metered quantities of fluent material therefrom, the container comprising:

a first flexible sheet;

a second flexible sheet;

a container frame defining a space including an open front and an open back generally aligned with the open front;

the first flexible sheet being joined to the frame over the open front and the second flexible sheet being joined to the frame over the open back to enclose the space, making the space capable of containing a fluent material, the first and second flexible sheets being deformable to move the fluent material within the enclosed space.

81. A flexible container as set forth in claim 80 wherein the frame includes a manifold portion having passaging therein for flow of fluent material within the flexible container.

82. A flexible container as set forth in claim 81 wherein the frame further includes cell formations in the space defined by the frame, the first and second flexible sheets being joined to the cell formations to define separate cells for containing separate volumes of fluent material.

83. A flexible container as set forth in claim 82 wherein the manifold portion includes ports opening into respective ones of the cells.

84. A flexible container as set forth in claim 83 wherein each cell formation comprises a forward cavity opening toward the open front of the frame and facing the first sheet, and a rearward cavity opening toward the open back of the frame and facing the second sheet, the first sheet being deformable into the forward cavity generally against the cell formation to discharge fluent material in the forward cavity into the manifold portion, the second sheet being deformable into the rearward cavity generally against the cell formation to discharge fluent material in the rearward cavity into the manifold portion.

85. A flexible container as set forth in claim 84 wherein the forward and rearward cavities are in fluid communication with each other and with a corresponding one of the ports in the manifold portion.

86. A flexible container as set forth in claim 80 wherein the space defined by the frame constitutes a first space, the frame defining a second space separate from the first space, the second space having an open front and an open back, the first sheet being joined to the frame over the open front of the second space and the second sheet being joined to the frame over the open back of the second space.

87. A flexible container as set forth in claim 86 wherein the second space is larger than the first space and contains fluent material.

88. A flexible container as set forth in claim 87 wherein the frame further comprises a manifold portion having passaging therein for flow of fluent material within the flexible container.

89. A flexible container as set forth in claim 88 wherein the manifold portion separates the first space from the second space.

90. A flexible container as set forth in claim 88 wherein the frame is formed as one piece.

91. A flexible container as set forth in claim 90 wherein the frame further includes a handle.

92. A flexible container as set forth in claim 80 wherein the first and second sheets are made of a polymeric material, the flexible container further comprising paper covering a portion of at least one of the first and second sheets.

93. A flexible container as set forth in claim 80 in combination with flow control apparatus capable of acting on the flexible container to cause flow of fluent material within the flexible container, the flow control apparatus comprising a shell adapted to receive at least a portion of the flexible container including said space, the flow control apparatus being adapted to apply positive and negative pressure to both the first and second sheets for causing flow of fluent material within the flexible container.

94. The combination of claim 93 further in combination with a drink dispenser comprising a housing containing the flow control apparatus and an actuator for initiating operation of the flow control apparatus to dispense fluent material.

95. A method of making a flexible container comprising the steps of:

forming a frame defining a space having an open front and an open back;

joining a first sheet of flexible material to the frame such that the first sheet covers the open front;

joining a second sheet of flexible material to the frame such that the second sheet covers the open back, the first and second sheets enclosing the space for containing a fluent material therein.

96. A method as set forth in claim 95 wherein said step of forming includes forming the frame with a manifold portion having passaging for directing flow of fluent material within the flexible container.

97. A method as set forth in claim 96 wherein said step of forming includes forming cell formations disposed in the space, and wherein said steps of joining the first and second flexible sheets comprise joining the sheets to the cell formations to define separate cells capable of receiving and discharging fluent material.

98. A flow control apparatus for controlling the flow of a fluent material, the flow control apparatus comprising:

a shell sized and shaped for receiving at least a portion of the flexible container therein, the shell defining at least one region for fluidically isolating the flexible container for application of fluid pressures thereto;

a fluid pressure system capable of selectively applying positive pressure and vacuum pressure to the flexible container in the shell in said at least one region for deforming at least one of the first and second flexible sheets to move fluent material within the container, the fluid pressure system being adapted to deliver a selected fluid pressure on demand free of any positive or negative fluid pressure accumulators.

99. Flow control apparatus as set forth in claim 98 wherein the fluid pressure system comprises a variable volume device having an interior adapted for fluid communication with said at least one region in the shell, the variable volume device being capable of reducing the volume of the interior in communication with said region to apply positive pressure to said region, and increasing the volume of the interior to apply vacuum pressure to said region.

100. Flow control apparatus as set forth in claim 99 wherein the variable volume device comprises a cylinder having a hollow interior and a piston therein dividing the hollow interior into two sections, one of the two sections being connected for fluid communication with said region in the shell.

101. Flow control apparatus as set forth in claim 100 wherein the shell defines multiple distinct regions for fluidically isolating the flexible container for application of fluid pressures thereto.

102. Flow control apparatus as set forth in claim 101 the fluid pressure system comprises one cylinder for each region in the shell, an interior section of each cylinder being connected for fluid communication with a respective one of the regions.

103. Flow control apparatus as set forth in claim 102 wherein at least two regions of the shell are connected for fluid communication with the interior of the cylinder, a first of the regions being in communication with one of said interior sections of the cylinder and a second of said regions being connected for communication with the other of said interior sections of the cylinder, such that one of said interior sections is capable of applying positive pressure to the first region while the other of said interior sections applies vacuum pressure to the second regions.

104. Flow control apparatus as set forth in claim 103 wherein the cylinder constitutes a first cylinder and the fluid pressure system further comprises a second cylinder having a hollow interior and a piston therein dividing the hollow interior into two sections, a third region of the shell being connected for fluid communication with one of said two interior sections of the second cylinder.

105. Flow control apparatus as set forth in claim 104 wherein the other of said two interior sections of the second cylinder is connected for fluid communication with the second region.

106. Flow control apparatus as set forth in claim 105 wherein the fluid pressure system comprises a valve disposed for alternatively placing the second region in fluid communication with said other interior section of the first cylinder and said other interior section of the second cylinder.

107. Flow control apparatus as set forth in claim 103 wherein a third region defined by the shell is connected for fluid communication with both interior sections of the cylinder, the fluid pressure system further comprising valving for alternatively placing the third region in fluid communication with the one interior section and the other interior section of the cylinder.

108. Flow control apparatus as set forth in claim 107 wherein the fluid pressure system still further comprises a valve for each of the first and second regions, each valve being adapted to place its corresponding region with a respective interior section of the cylinder.

109. Flow control apparatus as set forth in claim 108 wherein the fluid pressure system comprises a valve control for controlling the valves associated with the first and second regions and the valving association with the third region.

110. Flow control apparatus as set forth in claim 109 wherein the valve control includes sensors operable to detect the position of the piston in the cylinder, the valve control opening and closing the valves and valving in response to the detected position of the piston.

111. Flow control apparatus set forth in claim 110 in combination with a drink dispenser, the drink dispenser comprising a housing for the flow control apparatus and an actuator for actuating the flow control apparatus for dispensing fluent material in the form of a beverage.

* * * * *